US012042064B1

(12) United States Patent
Deo et al.

(10) Patent No.: US 12,042,064 B1
(45) **Date of Patent: *Jul. 23, 2024**

(54) SUBSTRATE WITH INTEGRATED MULTI-LAYER POUCH/POCKET

(71) Applicant: Stabulum Group, LLC, Ames, IA (US)

(72) Inventors: Trung Lo Deo, Urbandale, IA (US); Cameron James Lynch, Iowa City, IA (US); Okaydo Van Duong, Des Moines, IA (US); James Edward Fay, Boulder, CO (US)

(73) Assignee: Stabulum Group, LLC, Ames, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/133,329

(22) Filed: Apr. 11, 2023

Related U.S. Application Data

(63) Continuation of application No. 17/862,002, filed on Jul. 11, 2022, now Pat. No. 11,622,638.

(60) Provisional application No. 63/220,501, filed on Jul. 10, 2021, provisional application No. 63/220,499, filed on Jul. 10, 2021.

(51) Int. Cl.
*A47D 5/00* (2006.01)
*A47D 15/00* (2006.01)

(52) U.S. Cl.
CPC ..... *A47D 5/006* (2013.01); *A47D 15/003* (2013.01); *A47D 5/00* (2013.01); *A47D 15/00* (2013.01); *A47D 15/001* (2013.01)

(58) Field of Classification Search
CPC ..... A47D 5/006; A47D 5/00; A47D 9/005; A47D 9/00; A47D 15/003; A47D 15/001; A47D 15/00
USPC ..... 5/652, 655, 657
See application file for complete search history.

(56) References Cited

U.S. PATENT DOCUMENTS

| | | | |
|---|---|---|---|
| 3,489,194 | A | 1/1970 | Hoover |
| 4,154,323 | A | 5/1979 | Sneider |
| 4,566,130 | A | 1/1986 | Coates |
| 4,886,150 | A | 12/1989 | Fitzsimmons |
| 5,692,257 | A | 12/1997 | Albertieri |
| 6,052,634 | A | 4/2000 | Pathe et al. |

(Continued)

FOREIGN PATENT DOCUMENTS

| | | | |
|---|---|---|---|
| CA | 2571076 | A1 | 1/2006 |
| CA | 2750751 | A1 | 2/2012 |

(Continued)

*Primary Examiner* — Robert G Santos
(74) *Attorney, Agent, or Firm* — Nyemaster Goode P.C.

(57) ABSTRACT

A foldable diaper changing mat that includes a foldable base layer having a surface engaging side and an upward facing side and a top edge and a bottom edge; and an infant buttocks receiving pad portion having a top end facing the top edge of the foldable base layer and a bottom end facing the bottom edge of the foldable base layer, wherein the infant buttocks receiving pad portion is engaged with the upward facing side and proximate the bottom edge of the foldable base layer. The infant buttocks receiving pad portion has at least one intermediate layer and a top, adsorbent-containing layer. The infant buttocks receiving pad portion typically has a top edge facing pocket and a bottom edge facing pocket that are separated from one another.

20 Claims, 48 Drawing Sheets

(56) References Cited

U.S. PATENT DOCUMENTS

| | | | | |
|---|---|---|---|---|
| 6,298,509 | B1 | 10/2001 | Vickers | |
| 6,327,726 | B1 | 12/2001 | Weber | |
| 6,421,856 | B1 | 7/2002 | Furnback | |
| 6,694,552 | B1 | 2/2004 | Vickers | |
| 7,520,010 | B2 | 4/2009 | Welch | |
| 7,752,692 | B1 | 7/2010 | Sanders et al. | |
| 8,341,783 | B2 | 1/2013 | Beck | |
| 8,732,873 | B2 | 5/2014 | Iskowitz | |
| 8,732,880 | B2 | 5/2014 | Carrothers-Smith | |
| 8,990,986 | B2 | 3/2015 | Sanders et al. | |
| 9,120,398 | B2 | 9/2015 | Iskowitz | |
| 9,826,809 | B2 | 11/2017 | Carter | |
| 11,622,638 | B1 * | 4/2023 | Deo | A47D 5/006 5/652 |
| 2004/0124116 | A1 | 7/2004 | Long | |
| 2005/0081297 | A1 | 4/2005 | Woodward et al. | |
| 2005/0278855 | A1 | 12/2005 | Welch | |
| 2005/0278856 | A1 | 12/2005 | Welch | |
| 2006/0191074 | A1 | 8/2006 | Welch | |
| 2006/0289582 | A1 | 12/2006 | Killilea | |
| 2007/0122066 | A1 | 5/2007 | Landay | |
| 2007/0220674 | A1 * | 9/2007 | Haskins | A47G 9/0223 2/69.5 |
| 2007/0220675 | A1 * | 9/2007 | Haskins | A01K 29/00 5/655 |
| 2011/0023236 | A1 | 2/2011 | Sanders et al. | |
| 2012/0030877 | A1 | 2/2012 | Beck | |
| 2012/0311788 | A1 | 12/2012 | Jackson, II | |
| 2013/0104310 | A1 | 5/2013 | Carrothers-Smith | |
| 2013/0312197 | A1 | 11/2013 | Sanders et al. | |
| 2014/0101860 | A1 | 4/2014 | Iskowitz | |
| 2014/0259394 | A1 | 9/2014 | Iskowitz | |
| 2015/0257500 | A1 | 9/2015 | Carter | |

FOREIGN PATENT DOCUMENTS

| | | | |
|---|---|---|---|
| GB | 2524786 | A | 10/2015 |
| WO | 2006010001 | A2 | 1/2006 |
| WO | 2006010001 | A3 | 4/2006 |
| WO | 2006091664 | A1 | 8/2006 |

* cited by examiner

SUBSTRATE WITH INTEGRATED MULTI-LAYER POUCH/POCKET

CROSS-REFERENCE TO RELATED APPLICATION

This application is a continuation of U.S. patent application Ser. No. 17/862,002, filed on Jul. 11, 2022, entitled "SUBSTRATE WITH INTEGRATED MULTI-LAYER POUCH/POCKET," now U.S. Pat. No. 11,622,638, which claims priority to and benefit of U.S. Provisional Application No. 63/220,501, filed on Jul. 10, 2021, entitled "SUBSTRATE WITH INTEGRATED MULTI-LAYER POUCH/POCKET" and U.S. Provisional Application No. 63/220,499, filed on Jul. 10, 2021, entitled "SUBSTRATE WITH INTEGRATED MULTI-LAYER POUCH/POCKET," the disclosures of these applications are hereby incorporated herein by reference in their entirety.

BACKGROUND

There are various bags or other products produced from cloth, plastic, or elastomeric materials that are designed to enclose, contain, or carry materials. Traditional plastic grocery bags, for example, are routinely used to carry items. The traditional plastic grocery bags are sometimes used by people walking their dogs or other pets that may or have defecated on the lawn or while they are being walked on another person's property or elsewhere. When this is done users typically either scoop the fecal matter up off the ground with a tool or other implement and deposit the fecal matter in the bag or they may grab the fecal matter with their hands using the grocery bag as a thin barrier between their hand(s) and the fecal matter and then the entire bag is inverted inside out so that the fecal matter is in the inside volume of the plastic grocery bag, but, of course, the thin plastic grocery bag retains its identical, but inverted shape. Sometimes the canine or other animal fecal matter is not well retained when a regular plastic grocery bag is used regardless of how it is placed into the bag. Additionally, the smell of the fecal matter is profound and may not be contained within a thin single layer of a plastic grocery bag, which often rip and/or have holes. Nevertheless, these bags or similar dog fecal matter bags are employed despite these drawbacks. The negative effects of disposal of canine fecal matter in such a fashion is tolerated primarily due to the unavailability of any alternatives at relatively similar prices to those of grocery or plastic canine fecal matter disposal bags or any alternative that provides enhanced value at potentially higher costs. Commercially acceptable alternatives simply do not currently exist.

Similarly, plastic bags are used by parents, guardians, or humans in charge of the care of infants and toddlers who wear and urinate or defecate in their diapers. The plastic bags are often used by such individuals to place used diapers in and dispose of those diapers. The infant is placed on a floor, changing table surface or on a cushioned changing mat that the parent often carries with them or is permanently located at the location where most diaper changing occurs. Thereafter, the soiled (urine and/or feces) containing diaper is attempted to be sealed using the straps of the diaper itself and then placed into the plastic bag. Thereafter, the plastic bag is typically tied and the bag with the used diaper is thrown away in the trash or a used diaper receptacle such as a DIAPER GENIE®. Unfortunately, the liquid form of feces from an infant often leak out of the diaper while the infant is being changed or prior to the clothes being removed from the infant. In addition to comfort, the use of a washable diaper changing pad is sometimes employed to protect the floor or other surface that the infant or toddler is placed on before removing the clothes and diaper to change the diaper from feces and waste not contained by the diaper and/or clothes worn by the infant or toddler. The washable diaper changing pad is typically a foam pad covered by a washable cloth fabric that may be removed and laundered when soiled by any uncontained fecal and other matter/debris/material that should have been retained within the diaper. Additionally, the traditional diaper changing pads are typically a large pad designed specifically to make sure they cover the entire surface that the infant is laid upon as well as a significant amount of the adjacent area around the infant, all or part of which may be dirty or uneven/uncomfortable for the infant or child if they were laying on that surface without the intervening mat. Sometimes there are angled portions on the sides of the mat or foam roll or other barriers on the sides of the matt to keep an infant in the center and prevent the infant from rolling away from the parent when the infant is placed on the mat. This results in a large area of cloth to be washed when soiled, which as any parent knows, occurs quite often whether the cloth is the cover or the entire mat.

SUMMARY

An aspect of the present disclosure is generally directed toward a foldable diaper changing mat that includes a foldable base layer of plastic film having a surface engaging side and an upward facing side and a top edge and a bottom edge and an infant buttocks receiving pad portion. The infant buttocks receiving pad portion typically has a top end facing the top edge of the foldable base layer of plastic film and a bottom end facing the bottom edge of the foldable base layer of plastic material. The infant buttocks receiving pad portion is engaged with the upward facing side and proximate the bottom edge of the foldable base layer of plastic film. The infant buttocks receiving pad portion has at least one intermediate plastic layer and a top absorbent containing layer. The foldable base layer of plastic film, the at least one intermediate plastic layer and the top absorbent layer are sealed so as to create a top edge facing pocket and a bottom edge facing pocket that are separated from one another such that they do not share the same physical interior volume.

Another aspect of the present disclosure is generally directed to a method of sealing a used diaper within a foldable diaper changing mat that includes at least the following steps: placing a used diaper within a bottom edge facing pocket or a top edge facing pocket of the foldable diaper changing mat to form a diaper containing pocket; reaching on the outside of the diaper containing pocket to physically grasp the diaper without directly physically touching the diaper; and inverting the foldable diaper changing mat by flipping the foldable diaper changing mat inside out a first time to form a single inverted diaper containing mat. The foldable diaper changing mat typically includes a foldable base layer of plastic film having a surface engaging side and an upward facing side and a top edge and a bottom edge; and an infant buttocks receiving pad portion having a top end facing the top edge of the foldable base layer of plastic film and a bottom end facing the bottom edge of the foldable base layer of plastic material. The infant buttocks receiving pad portion is engaged with the upward facing side and proximate the bottom edge of the foldable base layer of plastic film. The infant buttocks receiving pad portion has at least one intermediate plastic layer and a top absorbent containing layer. The foldable base layer of plastic film, the at least one intermediate plastic layer and the top absorbent layer are sealed so as to create a top edge facing pocket and a bottom edge facing pocket that are separated from one another. The top edge facing pocket and the bottom edge facing pocket each may have a flap to allow easier access to the pocket.

Yet another aspect of the present disclosure is generally directed to foldable diaper changing mat that includes a foldable base layer of plastic film having a surface engaging side and an upward facing side and a top edge and a bottom edge and an infant buttocks receiving pad portion having a top end facing the top edge of the foldable base layer of plastic film and a bottom end facing the bottom edge of the foldable base layer of plastic material. The infant buttocks receiving pad portion is engaged with the upward facing side and proximate the bottom edge of the foldable base layer of plastic film. The infant buttocks receiving pad portion includes a first intermediate plastic layer and a second intermediate plastic layer and a top absorbent containing layer. The foldable base layer of plastic film, the at least one intermediate plastic layer and the top absorbent layer are sealed so as to create a top edge facing pocket and a bottom edge facing pocket (or optionally two pockets on different sides from one another in the rectangular configuration of a mat) that are separated from one another and do not share any of the same internal volume.

BRIEF DESCRIPTION OF THE DRAWINGS

In the drawings:

FIG. 8 is an isometric view of the diaper changing mat of DESIGN E.

FIG. 16I is a front perspective view of the completed initial inversion.

DETAILED DESCRIPTION OF EMBODIMENTS

Figure 1:
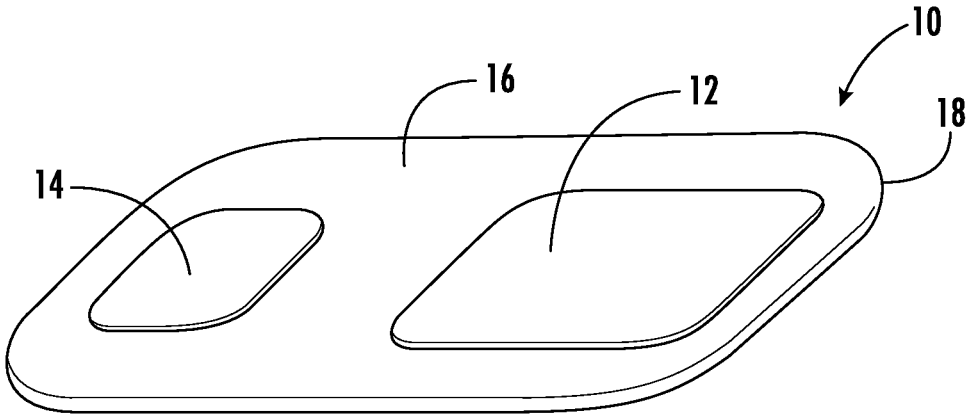
FIG. 1 is an isometric view of an exemplary overall shape and size of a diaper changing mat according to an aspect of the present disclosure.
Figure 2:
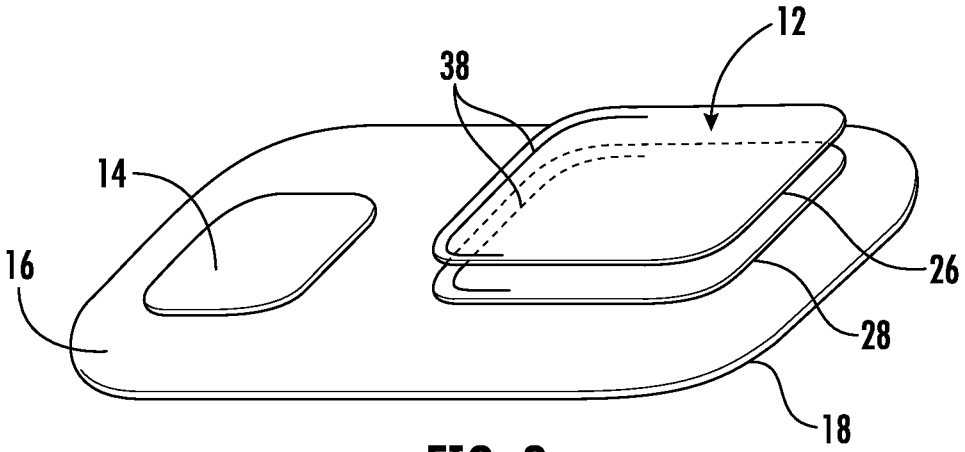
FIG. 2 is an exploded view of the diaper changing mat shown in FIG. 1 and illustrates possible bonding lines between the buttocks absorbent layer, intermediate plastic film, and base plastic film.
Figure 2A:
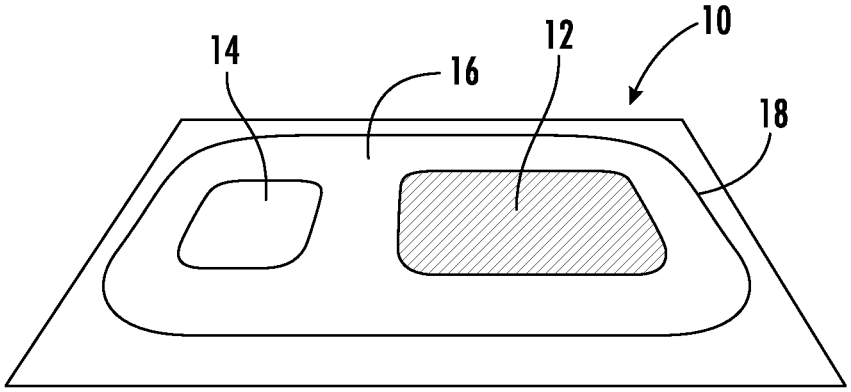
FIG. 2A is a perspective view of a diaper changing mat according to an aspect of the present disclosure—DESIGN A.
Figure 2B:
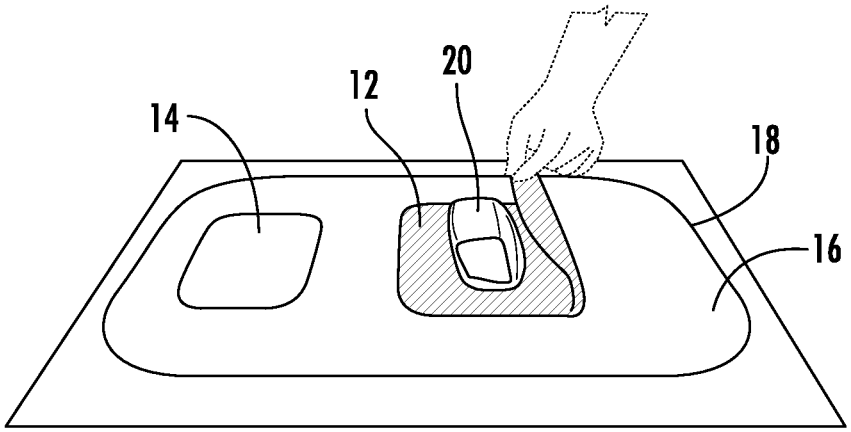
FIG. 2B is a perspective view showing an initial stage of a process for enrobing a diaper or other soiled article within the diaper mat shown in FIG. 2A. The figure shows a dirty diaper placed on the infant buttocks mat portion and a flap grasped and being moved over at least a portion of the dirty diaper.
Figure 2C:
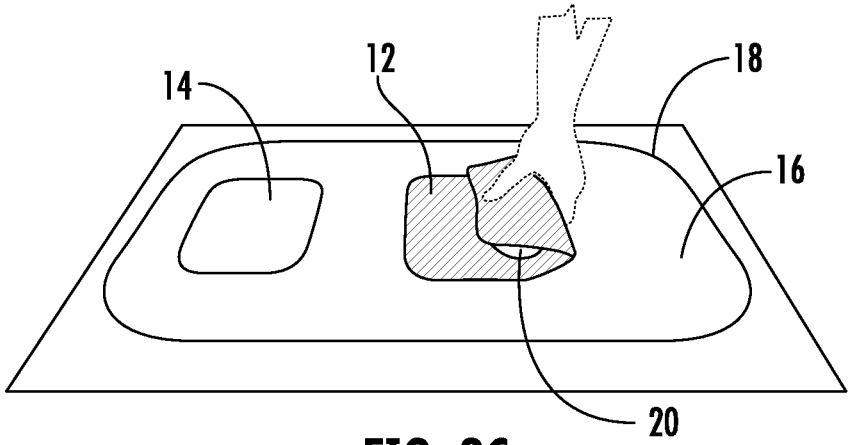
FIG. 2C is a perspective view showing a subsequent stage (after FIG. 2B) of the process of enrobing a dirty diaper within the diaper changing mat shown in FIG. 2A. The flap at the bottom of the infant buttocks mat portion is folded up to reveal a bottom pocket with a portion of a user's hand within the pocket.
Figure 2D:
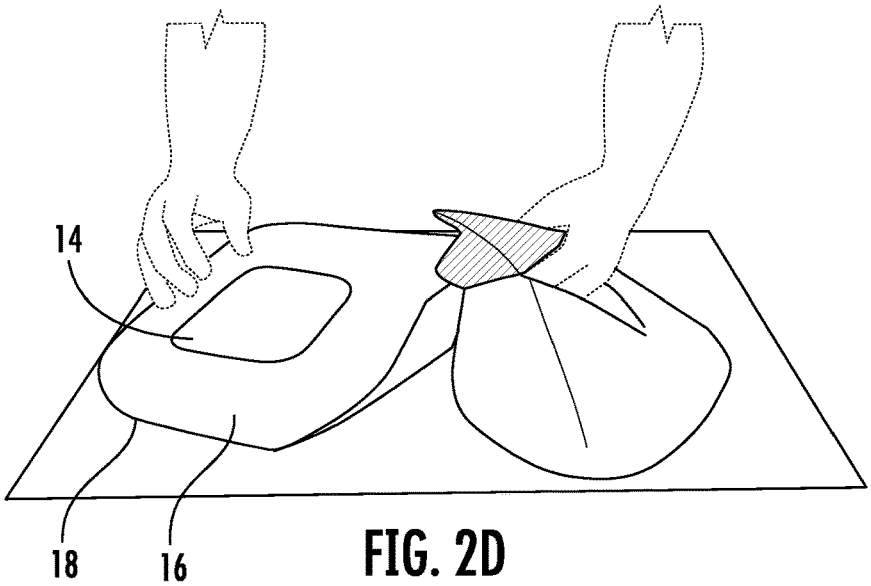
FIG. 2D shows a perspective view of the next stage (after FIG. 2C) of the process of enrobing a dirty diaper using the diaper mat shown in FIG. 2A.
Figure 2E:
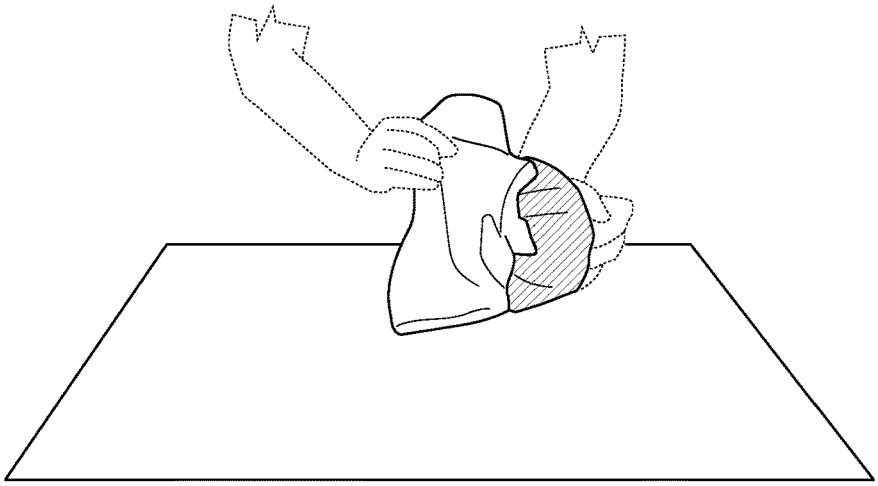
FIG. 2E is a perspective view of the next stage (after FIG. 2D) in the process of enrobing a dirty diaper within the diaper mat shown in FIG. 2A.
Figure 2F:
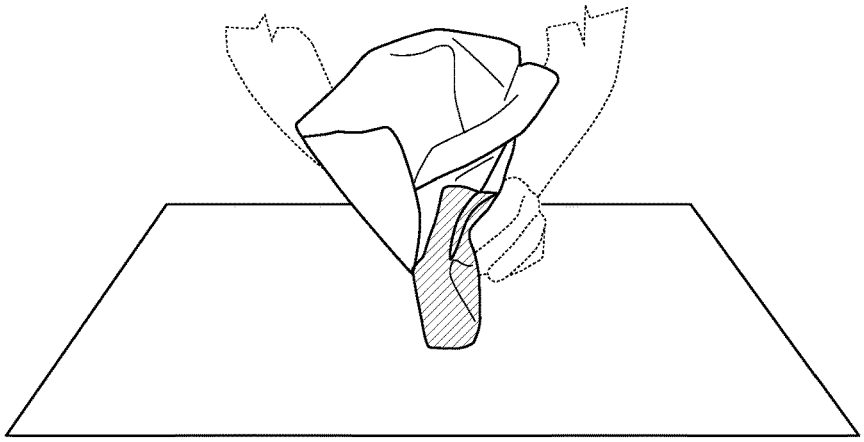
FIG. 2F is a perspective view of a subsequent stage (after FIG. 2E) of the process of enrobing a dirty diaper using the diaper mat of FIG. 2A.
Figure 2G:
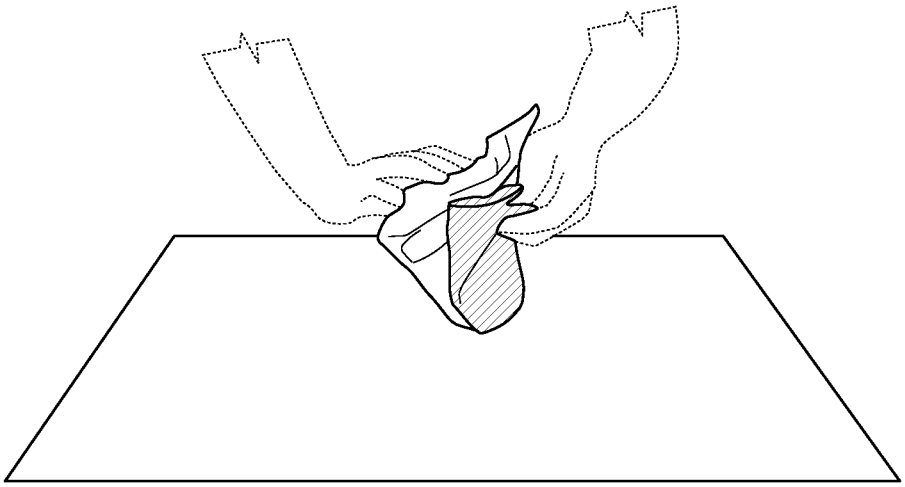
FIG. 2G shows a perspective view of a user continuing the process of enrobing a dirty diaper within the diaper mat shown in FIG. 2A where a pocket is revealed as the mat is inverted and the remaining mat base portion inserted within that pocket.
Figure 2H:
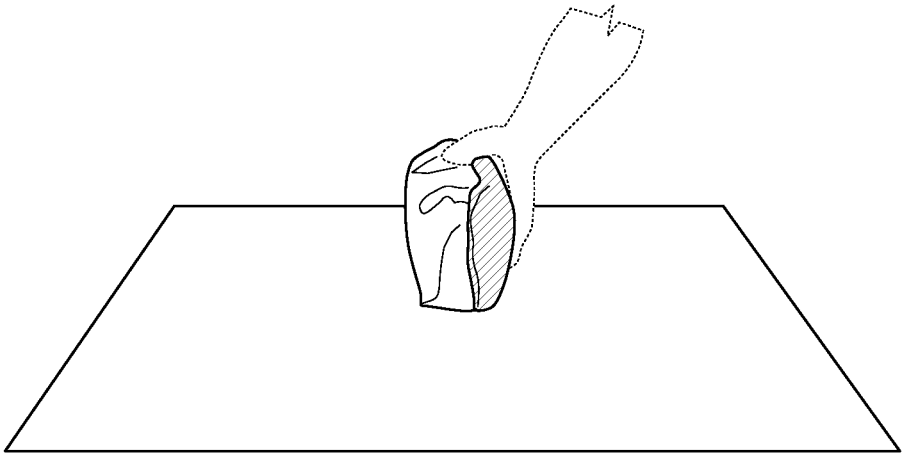
FIG. 2H is a perspective view showing the diaper mat completely enrobing the dirty diaper.
Figure 3A:
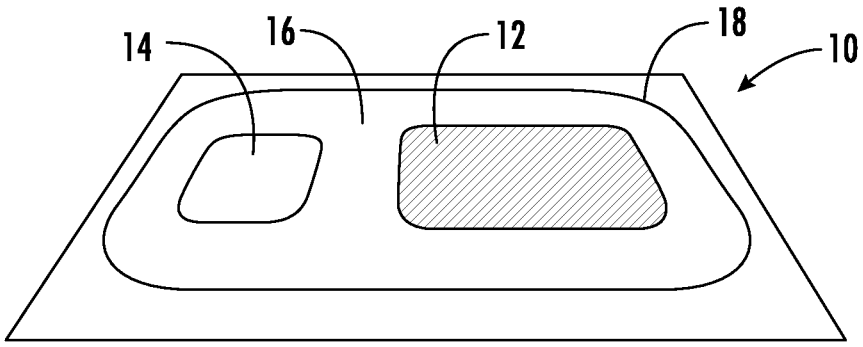
FIG. 3A is a perspective view of another embodiment of a diaper changing mat according to an aspect of the present disclosure—DESIGN B.
Figure 3B:
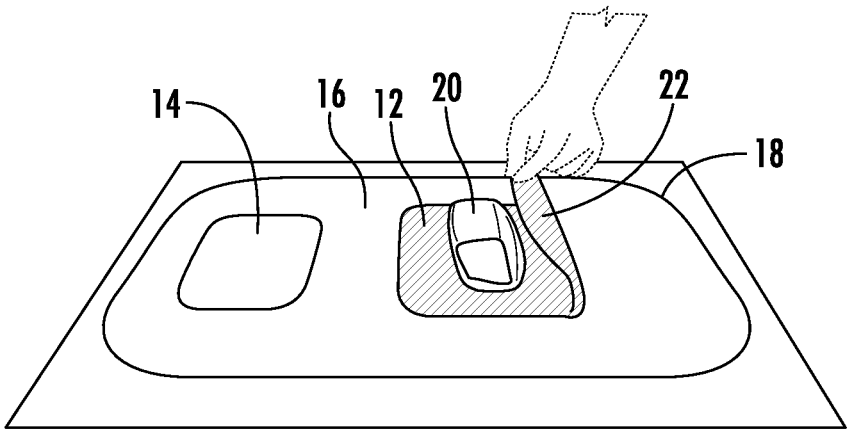
FIG. 3B is a perspective view showing an initial stage of a process for enrobing a diaper or other soiled article within the diaper mat shown in FIG. 3A. The dirty diaper is placed on the infant buttocks mat and flap grasped and rolled on top of at least a portion of the dirty diaper.
Figure 3C:
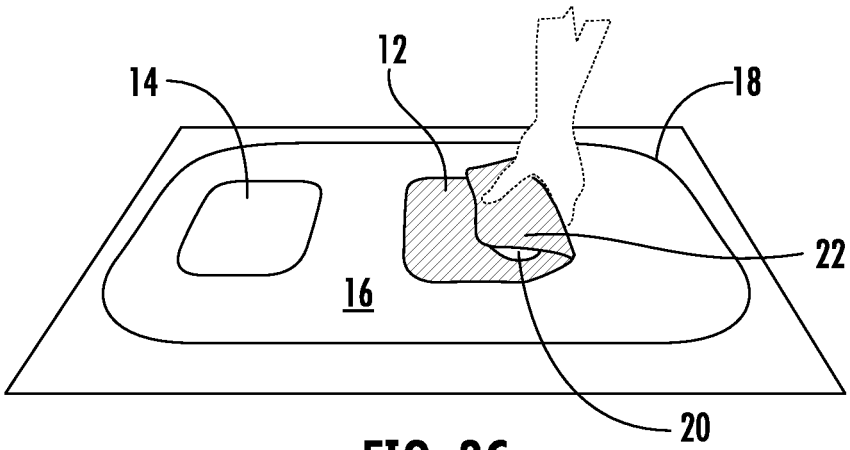
FIG. 3C is a perspective view showing a subsequent stage (after FIG. 3B) of the process of enrobing a dirty diaper within the diaper changing mat shown in FIG. 3A. The flap is folded up to reveal a bottom pocket with the user's hand within the pocket similar to the first step in DESIGN A.
Figure 3D:
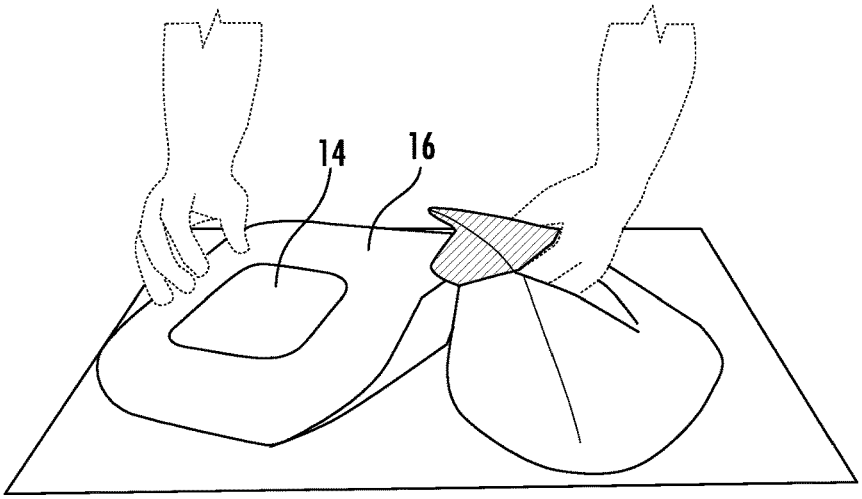
FIG. 3D shows a perspective view of the next stage (after FIG. 3C) of the process of enrobing a dirty diaper using the diaper mat shown in FIG. 3A.
Figure 3E:
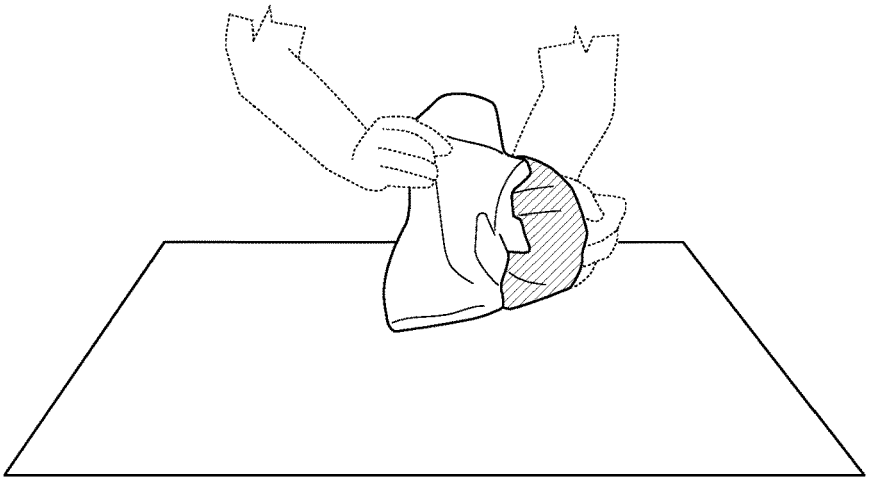
FIG. 3E is a perspective view of the next stage (after FIG. 3D) in the process of enrobing a dirty diaper within the diaper mat shown in FIG. 3A.
Figure 3F:
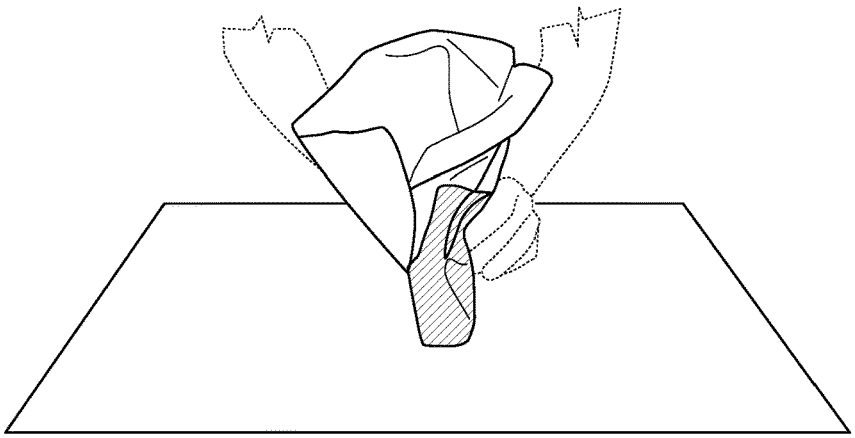
FIG. 3F is a perspective view of a subsequent stage (after FIG. 3E) of the process of enrobing a dirty diaper using the diaper mat of FIG. 3A.
Figure 3G:
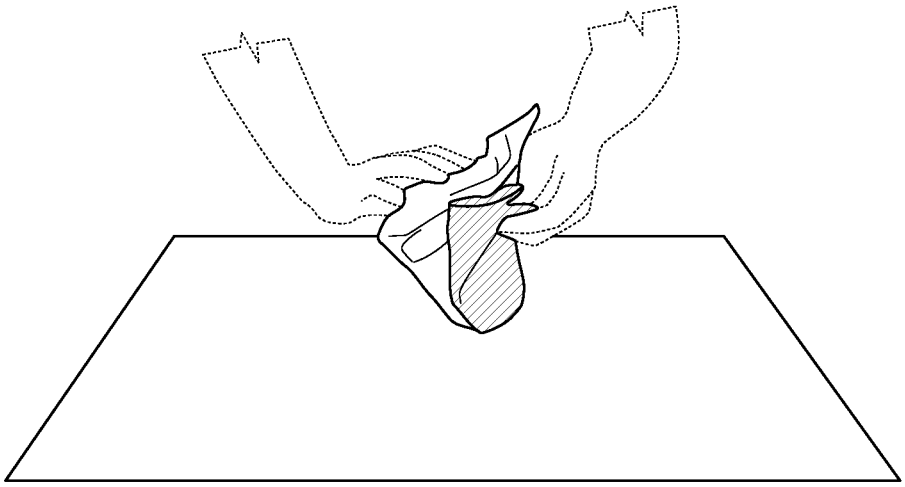
FIG. 3G shows a perspective view of a user continuing the process of enrobing a dirty diaper within the diaper mat shown in FIG. 3A where a pocket is revealed as the mat is inverted and the remaining mat base portion inserted within that pocket.
Figure 3H:
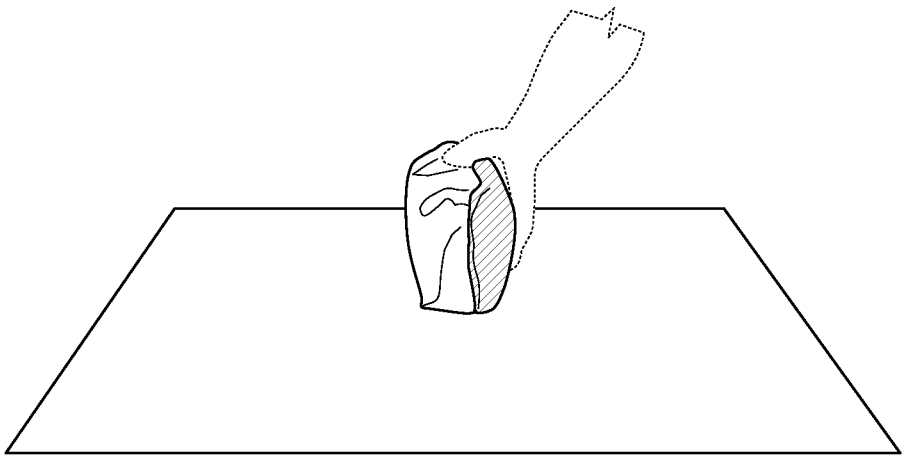
FIG. 3H is a perspective view showing the diaper mat completely enrobing the dirty diaper after an initial inversion of the diaper changing mat around the diaper.
Figure 3I:
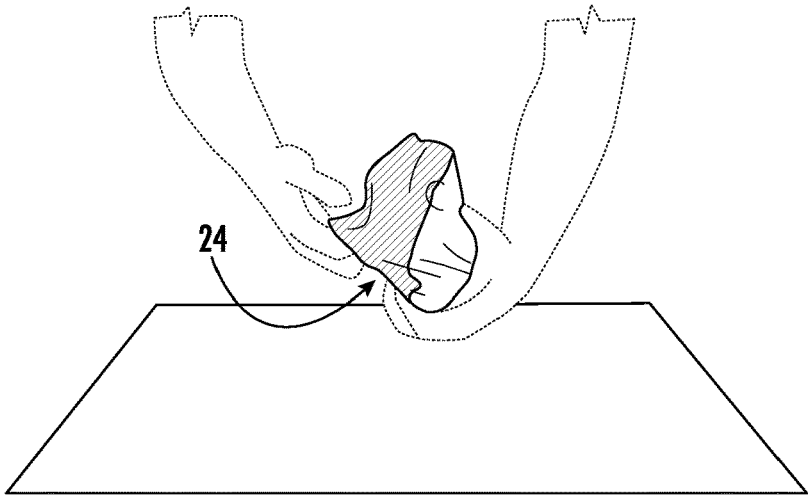
FIG. 3I shows a perspective view of a second inversion in the overall enrobing process of the dirty diaper using the diaper changing mat of FIG. 3A where the pocket revealed by the first inversion is used to receive the dirty diaper and mat a second time such that the second plastic film covers the overall dirty diaper and mat.
Figure 3J:
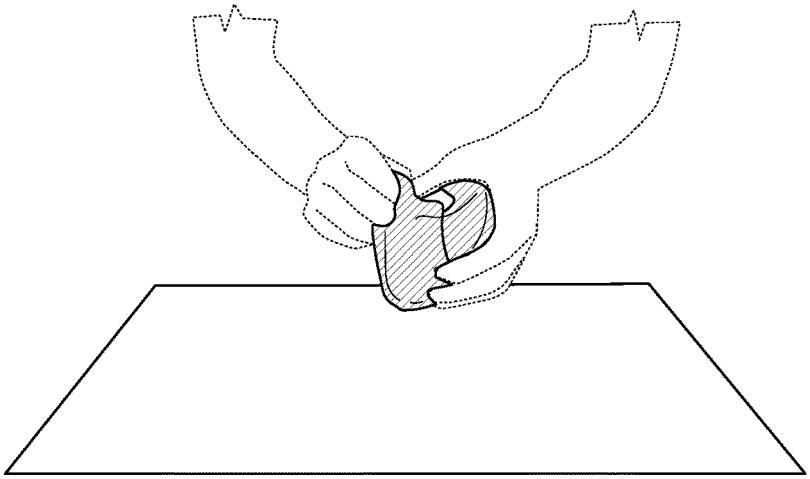
FIG. 3J is a perspective view as the process of inserting the dirty diaper and mat into the second pocket revealed by the first inversion is undertaken.
Figure 3K:
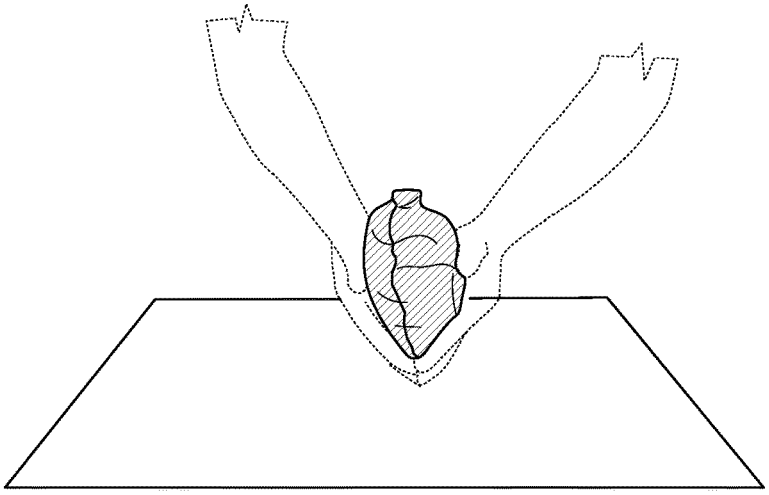
FIG. 3K is a perspective view showing the completed second inversion with the entirety of the base portion of the diaper changing mat completely enrobed by the first plastic film and the second plastic film thus preventing leakage of any contaminants (or at least any substantial leakage of any contaminants) within the diaper by creating a disjointed pathway contaminates would have to travel in order to escape the double inversion of the overall product.

For purposes of description herein, the terms "upper," "lower," "right," "left," "rear," "front," "vertical," "horizontal," and derivatives thereof shall relate to the invention as oriented in FIG. 1. However, it is to be understood that the claimed invention may assume various alternative orientations, except where expressly specified to the contrary. It is also to be understood that the specific devices and processes illustrated in the attached drawings, and described in the following specification are simply exemplary embodiments of the inventive concepts disclosed herein and defined in the appended claims. Hence, specific dimensions and other physical characteristics relating to the embodiments disclosed herein are not to be considered as limiting, unless the claims expressly state otherwise.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the invention as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present disclosure. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structures and methods without departing from the concepts of the present disclosed concepts.

It is to be understood that the disclosed innovations may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise. All ranges and parameters, including but not limited to percentages, parts, and ratios, disclosed herein are understood to encompass any and all sub-ranges assumed and subsumed therein, and every number between the endpoints. For example, a stated range of "1 to 10" should be considered to include any and all sub-ranges beginning with a minimum value of 1 or more and ending with a maximum value of 10 or less (e.g., 1 to 6.1, or 2.3 to 9.4), and to each integer (1, 2, 3, 4, 5, 6, 7, 8, 9, 10) contained within the range. In this specification and the appended claims, the singular forms "a," "an" and "the" include plural reference unless the context clearly dictates otherwise. All combinations of method steps or process steps as used herein can be performed in any order, unless otherwise specified or clearly implied to the contrary by the context in which the referenced combination is made To the extent that the terms "includes" or "including" or "have" or "having" are used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A" or "B" or both "A" and "B". When the Applicant intends to indicate "only A or B but not both" then the term "only A or B but not both" or similar structure will be employed. Thus, use of the term "or" herein is the inclusive, and not the exclusive use. Also, to the extent that the terms "in" or "into" are used in the specification or the claims, it is intended to additionally mean "on" or "onto." In this specification and the appended claims, the singular forms "a," "an" and "the" include plural reference unless the context clearly dictates otherwise.

The present disclosure is generally directed toward a portable and disposable mat 10 to lay an infant or toddler on to change the infant or toddler's diaper. While the present disclosure largely centers on the use of the concepts as a diaper mat, the dimensions may be adjusted to allow for wrapping and containing any substrate where there would be a benefit to do so. For example, the dimensions may be sized downward to be used to enrobe a feminine hygiene product after use, which would avoid wrapping such a product in toilet paper and placing used product with blood potential exposed to another human or animal. While the portable and disposable mat 10 will typically be used with human infants and toddlers wearing a diaper after the diaper is soiled with urine, fecal matter or both, conceivably, the system can be used for other mammals that wear diapers such as monkeys or other primates in particular. Also, the folding over/single or double inversion concepts described herein may be used in other environments including as a functional multi-folding over dog fecal matter bag.

The diaper changing mats 10 of the present disclosure typically provide at least one inversion and, in some aspects of the disclosure, the ability to invert the mat twice to better enclose a dirty diaper or other material within the mat or, if not a diaper, a substrate used to single cover (in the case of one inversion) or double cover (in the case where two inversions occur during use) an object or objects that one might want to contain within an enclosed space. Typically, although not necessarily in every circumstance, the mat 10 is typically constructed such that the pocket where the diaper will be inserted (typically constructed as the buttocks pad 12) has a smaller surface area than the overall mat when the mat is laid in a planar fashion prior to any enrobing of a diaper within the pocket such that when the diaper is enrobed by the inversion or inversions by the user, the overall surface area is less than when the mat was yet to be used to enrobe a diaper or other material so the enrobed diaper or other material is wrapped, typically snuggly wrapped, within the pocket used or created by the mat during use. The snug wrapping prevents leakage of any diaper contents from the diaper within the enrobing layer due to the restricted pathway such liquid would have to travel given the reduced size of the mat, a pathway that is doubled and improved when two inversions are made. The pocket portion, which can make up the entire pocketing substrate, but more typically is constructed as the buttocks pad 12 in the case of the diaper mat 10. The number of layers of material used in the construction of the pocketing portion of the product(s) dictates the number of possible inversions that may be made and thereby the number of layers between the contents of the finished inverted pocketed product (i.e. a dirty diaper, dog feces, or used feminine product or the like). The number of inversions (inside out flips) is n−1 where "n" is the number of layers of material, typically a plastic film. Preferably, the number of layers is at least three. If this is the case, the buttocks portion, in the case of a diaper mat of the present disclosure, is sealed a second time by a second inversion, the end of the mat that was unsealed with one inversion and not pushed closed, especially when the surface area of the pocket/buttocks portion is small enough, is further sealed due to the second inversion.

The diaper changing mats 10 of the present disclosure typically have two separated pads —a large pad under the infant or toddler's buttocks 12, and a typically smaller head pad 14 that is positioned under the infant or toddler's head. The overall diaper changing mat may be formed of multiple layers formed from a single sheet of plastic material as shown in FIGS. 16A-17K, typically plastic film. The layers may be folded over one another and sealed to form the pocket buttocks portion and the head pad in that case.

The diaper changing mat may itself be separate from any traditional cushioned diaper changing mat or laid on a top surface of or engaged to a traditional diaper changing mat and wholly disengaged before wrapping the substrate, typically the diaper, within the layered films. Typically, the buttocks pad portion of the diaper changing mat is typically used and the head pad may or may not be included on a surface of the overall diaper changing mat. The pad for underneath the infant or toddler's head may be omitted, but is most typically included in the overall mat system's design. Both of these pads are typically smaller than the overall dimensions of the diaper changing mat as a whole. The diaper changing mat as a whole is typically defined by a unitary, common base plastic film layer 16. The entire diaper changing pad 10 may be folded to a size of about 2.75 inches wide, about 3.25 inches long, and about ⅜ inch thick. The smaller size of the head pad 14 and the buttocks pad 12 makes the overall product smaller and more compact, and thinner when folded prior to use and before the folded mat is opened and used than if the diaper changing mat were completed covered with padding. It allows a mat to be placed in a user's pocket or purse with ease and pulled out when needed while traveling, for example. Also, as discussed and shown herein, the smaller size of the buttocks pad having a smaller surface area for the buttocks pad than the total diaper mat more tightly holds the diaper when the diaper mat is inverted at least once to contain the diaper therein. The sizing helps better secure the diaper within the inverted diaper mat. If too small the inversion(s) may not be possible and if too large, the seal created by the inversion the diaper would be loose in the containment created. The folded mat is typically sized such that it may be compacted and stuffs easily in its own pocket with the soiled diaper placed in the pocket of the buttocks pad.

The pad under the infant or toddler's head of the present disclosure is typically a physically separate pad and unlinked from the pad under the infant or toddler's buttocks even though both are on the surface of the base plastic film layer 16 so urine, feces or other liquid excrement from the infant or toddler's buttocks from the buttocks pad portion cannot wick through capillary action or otherwise into the head pad portion, which might allow such unsanitary material to contact the infant or toddler's skin or be ingested by the infant or toddler. Of course, both the head pad and the buttock pad may be engaged to the same base plastic film layer defining the overall surface area of the diaper changing mat. The head pad 14 portion may have a fold-out absorbent portion to extend the length of the mat and also may have a pocket in it to receive a cushioning material or pillow that can be removed from the interior volume of the head pad pocket by hand and without the use of tools and without damaging the diaper changing mat. The head pad 14 may also have a fold-out absorbent portion that may be folded out and way from the head mat to facilitate it being torn off from the head pad (See FIG. 25). The folded out portion may be a tear-off dry wipe that may be torn by tearing along a perforation line and used to assist in cleaning big fecal matter and/or urine messes within the diaper. A tear off wipe (shown in FIG. 25) may be removed from a diaper changing mat of the present disclosure and used by the user of the overall mat.

The buttocks pad 12 portion may be positioned under the infant or toddler's buttocks when used as a multilayer pouch. After changing the diaper, the dirty diaper may be placed on top of the buttocks pad or within a pocket thereof and turned inside out/inverted, at least once, but more typically twice thereby sealing the diaper and mess inside. If the overall mat is turned inside out twice all of the surfaces that could be soiled or that touched the ground on the mat is on the inside of the enrobed composite of the entire mat and the dirty diaper, and the entire mat with soiled diaper can be stored in a diaper bag or other location without soiling the diaper bag or other location and the composition diaper and mat disposed of at a later date.

The present disclosure broadly describes a three or more-layered pocket of material that may be constructed to allow for the covering of excrement, urine or any other dirty and/or malodorous/offensively repelling odorous substance with one or multiple layers to more effectively seal the substance within the pocket. The pocket also typically at least substantially or completely seals the substance within the pocket of material therein due to the multiple fold overs employed.

The pocket of material may be independent from any other materials and used alone or such that it functions as a feminine hygiene containment product, as a dog fecal matter bag, or as an infant or toddlers' buttocks pad, which may or may not be part of or placed on an overall diaper mat. When the pocket is independent of and not connected to an underlying mat that is larger than the pocket, the pocket is an effective way to contain the smell and mess associated with adult absorbent undergarments and feminine care pads.

The pad 10 may have an integral pocket. The diaper changing pad may also have a base layer 16 that receives and engages a pocket portion, the buttocks pad 12, that is removably attached to the base layer by hand and without the use of tools, as shown in FIGS. 15A-L, typically by using a resealable adhesive that can be adhesive, cohesive and delamination. All three work in the context of the mats and products of the present disclosure. Pressure Sensitive Acylates (PSA) and/or Peelable Polyolefin Sealants, such as those used in things like breakfast cereal bags, may be used. These are applied and sealed with heat. The user can then peel the seal apart without tearing the film. There are also "cohesive peelable sealants." With a cohesive seal, the sealant itself split apart when peeled. Cohesive peelable sealants are created by blending a contaminant into a base resin. The contaminant will not solubilize in the base resin, which disrupts the resin matrix and makes it fail when subjected to shear or tension. Double sided tape may also be used.

When the pocket is used as a portion of an overall diaper changing mat, the overall diaper changing mat is a portable and disposable mat used to place an infant or toddler who is wearing a diaper on to change the infant or toddler's diaper. There are many alternative ways to produce a pocket system and/or a mat of the present disclosure. The diaper changing mat of the present disclosure may be produced of plastic film and two absorbent pads. The two absorbent pads have additional functionality beyond being absorbent as discussed above.

When the pocket is employed as an enrobing fold over system as a portion of a diaper changing mat, the overall diaper changing mat has distinguishing and significant features that provide features and functional benefits to a diaper changing mat according to the present disclosure.

First, the overall size of the diaper changing mats of the present disclosure are typically different in a meaningful way. While size may not seem like a significant feature, in the case of diaper changing mats it may be very consequential. The overall size of the diaper changing mats of the present disclosure are sized to provide enough surface area to protect an infant or toddler from what is beneath the infant or toddler during diaper changing while also providing enough to protect what is beneath the mat from the digestive and metabolic waste contained within a used diaper and the dirty and/or wet infant or toddler while the infant or toddler's diaper is being changed. The diaper changing mats of the present disclosure are able to provide their protective and portable features while being employed with a width of from about ten (10) inches to not more than 25 inches. More typically width is from about 12 inches to about 22 inches and most typically the width is from about 14 inches to about 20 inches. The length of the diaper changing mats of the present disclosure are typically from about 15 to about 40 inches, more typically from about 20 inches to about 30 inches and most typically from about 22 inches to about 28 inches. These dimensions are taken from the widest portion of the mat. Most typically the mat is a generally rectangular shape and may have curved corners. However, conceivably the mat may be oval, circular or other shape, but this may result in more difficult use or wasted material for the sake of a different overall shape. Functionally, it is presently believed that the generally rectangular shape of the overall mat with the curved corners is best.

Parents, but especially mothers, purchase products that are visually appealing, especially for their babies. Accordingly, the diaper changing mats of the present disclosure are constructed to have a visually appealing overall shape. The overall shape of the diaper changing mats of the present disclosure is a shape that at least roughly conforms to the Golden Ratio. The Golden Ratio is an irrational number that is approximately 1.6 (about 1.618). In mathematics, two quantities are in the golden ratio if their ratio is the same as the ratio of their sum to the larger of the two quantities. The diaper pad of the present disclosure is typically shaped such that it approximates the Golden Ratio. As such, of the overall diaper changing mat typically has a dimensional ratio of about 1.6 (length) to 1 (width). The ratio of the length to width of a diaper mat of the present disclosure is typically in a range of a length of from about 1.8 to about 1.4 to a width of 1, more typically in a range of a length of from about 1.75 to about 1.5 to a width of 1, most typically in a range of a length of from about 1.7 to 1.5 to a width of 1. Typically, the Golden Ratio shape is accompanied by rounded corners, which gives the overall mat a soft and pleasant appeal to the eye, and eliminates excess material resulting in a more compact product when folded. Of course, the corners may be pointed and squared off as well, but this is generally less appealing. Typically, the corner radius of the plastic film that is defined by the Golden Ratio is from 1 to 10 inches, more typically from about 2.5 to about 7.5 inches, and most typically from about 4-6 inches. Typically, the corner radius of the head and buttocks absorbent pads is from about 0.25 inch to about 4 inches, more typically from about 0.5 to about 3 inches, and most typically from about 1 to about 2 inches. A ratio of a length of about 1.6 to a width of 1 may also be employed. Another significantly impactful shaped portion of the diaper mats of the present disclosure is the embossing pattern on the waterproof plastic film that sits on a surface where the diaper mat is placed. The exterior facing surface of the diaper changing mat (the surface that is placed on the ground or other surface where the baby will be laid) of the present disclosure has "peaks" on one side of a film and "valleys" on the other side of the film created by the embossing applied to the plastic. Typically, the exterior, embossed plastic surface of the diaper changing mat is oriented such that the film has the "valleys down," which increases the surface area that touches a floor and minimizing sliding.

The buttocks pad 12 of the disposable mat 10 of the present disclosure is also typically at least about 10% smaller than the overall shape of the entire surface area of the diaper mat in the deployed position. Unlike other diaper changing mats that have absorbent pads that are substantially edge-to-edge with the waterproof mat base layer, which results in a product that does not fold up to a size that is easily fit in the bag or pocket before use, does not fold up tiny after use, and allows urine in the pad to wick off the edge of the product to cause whatever it is laying on to get wet with urine, the diaper mats of the present disclosure utilize a smaller surface area absorbent buttocks pad 12 than the overall surface area of the deployed mat 10. Since the absorbent buttocks pad in the diaper changing mat of the present disclosure is smaller than the waterproof mat base layer, the product folds up smaller before use, and folds up smaller after use. Even more significantly, the smaller absorbent pad (the buttocks pad) or smaller separated absorbent pads (the buttocks pad and the head pad) prevent wicking of urine or other excreted liquid from the absorbent pad from transferring onto whatever is under or next to the mat. The absorbent pad buttocks portion 12 is spaced away from the perimeter edge 18 of the mat 10 by at least about 0.25 inch, more typically at least about 0.5 inch and most typically at least one inch from the perimeter edges. The absorbent may be equally spaced from the perimeter edge of the mat or unevenly spaced away from the perimeter edge of the mat, i.e. spaced away from the perimeter edge different distances at different given points around the perimeter edge of the mat. The lesser surface area of the absorbent material and the disconnected head and buttocks absorbent materials prevent waste materials (urine and fecal matter) from traveling through capillary action or otherwise into other parts of the mat and potentially exposing the infant or toddler to harmful waste substances from the infant or toddler's diaper. The total surface area of the absorbent pad(s), the buttocks pad 12 and the head pad 14, is typically not more than about 90% of the surface area of the overall waterproof mat when unfolded and in the ready to use position. More typically, the surface area of the absorbent pad(s) is/are not more than about 80% and most typically not more than 70% of the overall surface area of the diaper changing mat. Also, typically the absorbent pad surface area of the buttocks pad is not less than 0.25 inch from the perimeter edge 18 of the diaper changing mat, more typically is not less than 0.5 inch from the perimeter edge 18 of the diaper changing mat, and most typically is not less than one inch from the edge of the diaper changing mat.

The diaper changing mat(s) of the present disclosure typically use a minimal amount of urine absorbent, but a sufficient amount to at least absorb urine runoff from the infant or child to prevent urine from leaving the buttocks pad portion of the overall diaper changing mat thereby preventing run off. Instead of a thick absorbent, the diaper changing mat is designed to minimize horizontal flow rate of any urine that a baby passes during a diaper change rather than employing a thicker or more absorbent material to absorb urine more quickly to prevent the same effect. By minimizing the rate of horizontal flow, a caregiver has time to see a problem and contain it before urine flows off the edge of the diaper changing mat. The amount of absorbent material required to minimize horizontal flow rate of urine is less than the material required to absorb urine, so the diaper changing mat is a thinner product that takes up less room in a pocket. Typically, the diaper changing pad limits horizontal flow of 0.5 oz of urine applied over 15 seconds to less than 4 inches in 30 seconds, more typically over 45 seconds and most typically over 60 seconds. Moreover, as discussed herein, the buttocks pad 12 is thermo-sealed on the perimeter or spaced a distance from the perimeter of the overall diaper changing mat. As shown in the FIG. 24 and in the results in TABLE A below, the sealing around the perimeter of the buttock pad prevents leakage of more liquid than the absorbent material can actually hold in a bound state. Absorbents work in two states—"bound" and "unbound." When pressure is applied to an absorbent that is saturated with liquid, unbound liquid is released, while bound liquid is not.

TABLE A

| | Amount of water until leaking starts | | |
|---|---|---|---|
| | Volume | | Height (H) from the top of water to the sealing line |
| TRIAL | ml | oz | inches |
| 1 | N/A | N/A | 1.25 |
| 2 | 80 | 2.71 | 1 |
| 3 | 78 | 2.64 | 1 |
| 4 | 80 | 2.71 | 1 |

Figure 24:
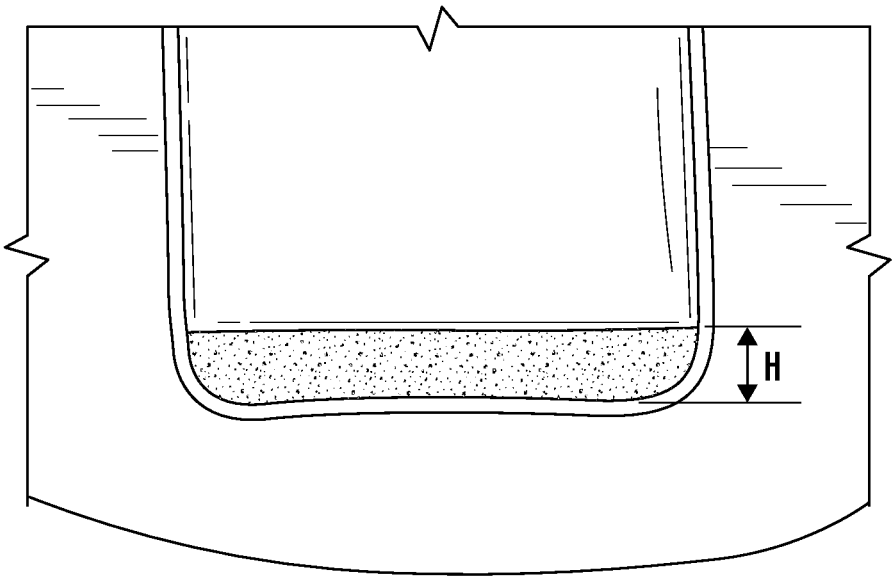
FIG. 24 is an enlarged view of the absorbent pad portion of a diaper changing mat according to an aspect of the present disclosure.

The thermally sealed buttocks pad or buttocks pad portion of the overall diaper pad is shown in FIG. 24 as being tested for liquid retention, the results of such testing are shown in TABLE A. A demonstration of how the Height "H" referenced in Table A is measured is shown in FIG. 24.

The absorbent pad in more traditional diaper changing pads allows urine to wick to the edge of the absorbent pad, run out of the absorbent pad and off the mat onto whatever is beneath the overall diaper changing pad. By contrast, the diaper changing mat of the present disclosure is typically constructed such that it has a wicking absorbent pad in which wicking can be interrupted. When employed, the physical interruption is typically supplied either by thermal bonding of the absorbent pad to another layer of the diaper changing mat, typically the base layer of the mat that contacts the surface the mat is place upon on the opposing side, or by the addition of a material like a thermoplastic adhesive such as a hot melt adhesive also known as a hot-melt glue. Typically, the physical interruption to interrupt wicking is located not less than ⅛ inch from the perimeter edge of the absorbent pad's edge, more typically not less than ¼ inch from the perimeter edge of the absorbent pad's edge, and most typically not less than ⅜ inch from the perimeter edge of the absorbent pad's edge.

The absorbent pad is often covered by another layer that acts as a body-side-liner (BSL) that has the effect of containing a structurally weak absorbent, and preventing the actual absorbent that may contain urine or liquid fecal matter from touching the skin. The absorbent pad and the body-side-liner typically form the absorbent layer as discussed herein. The material of the BSL can be made of any woven or nonwoven material. In the disposable diaper industry, this layer is usually made of nonwoven spunbond polypropylene. This material is naturally hydrophobic, which means that pressure must be applied to liquid to overcome the hydrophobicity of the spunbond to get liquid to penetrate the spunbond and be wicked into the underlying absorbent. In a diaper, pressure is applied by the weight of the baby sitting on the diaper. However, with a diaper changing pad that is typically not wrapped around a baby, the point of entry of urine to the absorbent may not be where the baby is applying pressure. This is a problem because urine can run off the hydrophobic spunbond before it wicks into the absorbent. The solution is to apply surfactant to the surface of the spunbond, making it hydrophilic so urine quickly passes through the spunbond and is wicked into the absorbent. However, this also presents a problem when the total absorbent capacity of the absorbent is minimized in order to minimize the bulk of the product because unbound liquid can be contained within the absorbent when the BSL is hydrophobic. In the case of the present disclosure, the surfactant can be locally printed onto the surface of the spunbond in the interior of the spunbond area, making the spunbond hydrophilic so that urine wicks quickly into the absorbent before running off, and surfactant is not printed onto the perimeter of the spunbond area, making it hydrophobic which resists penetration by unbound liquid as it approaches the perimeter of the spunbond. The result is that urine is quickly wicked into and contained by the underlying absorbent, and urine is retarded from wicking out of a limited amount of absorbent at the perimeter, even when the absorbent is saturated beyond its bound state. Typically, the surfactant is not printed onto the spunbond within 0.25 inches of the perimeter, more typically not within 1.0 inch of the perimeter, and most typically is not within 3.0 inches of the perimeter.

As discussed previously, the diaper changing mat of the present disclosure typically employs separated areas for the head and buttocks. Both the head pad and buttocks may include absorbent materials as discussed above. However, it is also feasible to have a single body side liner (the surface that touches the skin of the baby) covering separated head and buttocks pads, and particularly so if the body side liner connecting the head and buttocks pads is hydrophobic so that wicking between the pads does not occur. Separating the head pad 14 and the buttocks pad 12 from one another on the surface of the base plastic film layer 16 overall diaper changing pad 10 has at least the following advantages: 1) separation prevents urine on buttocks pad from wicking to the baby's head, 2) separation allows for a smaller head pad, which reduces bulk before and after use, 3) separation allows making a head pad with a pocket or a fold-out head pad that will not get wet with urine and provide greater surface area to cushion and/or shield the baby/infant's head, 4) separation allows making a buttocks pad that contains any of several types of pocket and have a smaller surface area than the overall diaper changing mat facilitating a better inversion/wrapping/seal, and 5) separation allows making the head pad and buttocks pad with different materials to optimize the characteristics for each pad. The head pad and the buttocks pad are typically separated by at least from 0.5 inch to 8 inches, more typically by at least from 1 inch to 6 inches, and most typically by at least from 1.5 inches to 5 inches.

The area of a baby's head that touches a diaper changing mat is typically considerably smaller (more than 50% smaller) than the area of a baby's buttocks that touches a diaper changing mat. A head pad 14 that is smaller than the buttocks pad 12 saves material and makes the overall product less bulky before use, so it easily folds and fits in a pocket, and is less bulky after use when it is often stuffed into a diaper bag if there is no place to dispose of a dirty diaper and changing mat. Additionally, the head pad being smaller than the buttocks pad makes it more intuitive for a person to orient the mat correctly under a baby. The head pad typically has a surface area in the range of from about 16 to about 150 square inches, more typically in the range of from about 30 to about 100 square inches, and most typically in a range of from about 35 to about 80 square inches. While the head pad 14 and the buttocks pad 12 are shown in a generally rectangular shape, they could conceivably be any shape so long as the layers of material are applied. They could be oval, circular or triangular, for example, but these shapes would typically not be preferred.

The material for the head pad 14 can be a woven or a nonwoven material that perceptually suggests protection to baby caregivers. In practice, the material can be nonwoven spunbond, spunlace, meltblown, paper, or any combination or layering of these materials. The head pad typically has a thickness under one psi pressure of from about one to about 20 mil (a mil is 1/1000th of an inch), more typically a thickness under one psi pressure of from about two to about 18 mil, and most typically a thickness under one psi pressure of from about 4 to about 16 mil.

The padding that supports a baby's head in other diaper changing mats is typically fixed. The head pad of the present disclosure, as discussed above, may be constructed so that it is open on one side. This open on one side design makes an integrated pocket that can be used by a caregiver, at their option, to stuff additional padding like a baby's t-shirt, a pillow, or other article of clothing or soft material. This further reduces the bulk of the overall product so the folded diaper changing mat easily fits into a pants pocket prior to use, it reduces the after-use bulk so the product takes up minimal space in a diaper bag, and it makes the diaper changing mat easy to flip inside out when the design incorporates a pocket of either single or double fold in the buttocks pad.

The diaper changing mats of the present disclosure may have a fold-out extension of the head pad. Other baby changing mats are a single size, even though babies come in different sizes. The diaper changing mat of the present disclosure has a fold in the head pad along the edge closest to the end of the mat. When the fold is extended, the effective length of the overall matt is increased to accommodate longer babies, or babies with longer torsos.

Diaper changing mats of the present disclosure also may have a baby wipe in head pad. Other baby changing mats are purely mats on which to change a baby's diaper. The diaper changing mat of the present disclosure may incorporate a wipe or wipes into the head pad. When more than one wipe is employed they are typically pleaded/folded to lay on top of one another in an accordion type fold for easy removal and separation along perforated lines between each wipe. The wipe can either be an extension of the head pad material that can be torn off, or it can be an entirely separate piece of material tucked inside a pocket in the head pad, or attached on top of the head pad. When a diaper full of runny fecal matter is changed, cleaning up the mess on a baby's bottom can require a lot of wet wipes because the first few wet wipes do little more than smear the mess around. Wet wipes are designed for cleaning, not absorbing runny fecal matter. A dry wipe substantially free of liquid may be used in the diaper changing mat design. This allows readier and better absorption of runny fecal matter than wet wipes designed for cleaning and not absorption. The dry wipe can be a simple piece of nonwoven, or it can be backed on one side with waterproof plastic film so runny fecal matter does not wick through the wipe and get on the user's hands. Typically, the dry wipe has a surface area of at least from about 5 to about 100 sq. inches, more typically a surface area of from about 10 to about 80 sq. inches, and most typically a surface area from about 25 to about 60 sq. inches.

The buttocks portion of the diaper changing pad or the buttocks pad when it is used separate from a mat of the present disclosure is typically sized in the range of from about 50 to about 200 square inches, more typically in the range of from about 60 to about 170 square inches, and most typically in the range of from about 70 to about 150 square inches. Nominally, the buttocks pad 12 should be in the range of from about 6 to about 15 inches wide and in the range of from about 9 to about 20 inches long.

The material for the buttocks pad can be any woven or nonwoven material including spunbond, spunlace, meltblown, paper, or any combination or layering of these materials. It can be both wicking and absorbent. The material of the buttocks pad typically has a thickness under 1 psi pressure of 1 to 50 mil, more typically a thickness under 1 psi pressure of is 1.5 to 40 mil, and most typically a thickness under 1 psi pressure of 2 to 30 mil.

The buttocks pad portion of a diaper changing mat of the present disclosure or the buttocks pad when it is stand alone can be designed so that it is three layers. It is understood that each layer can be a composite of materials. Plastic films can be built using coextrusion or adhesive lamination to optimize properties like moisture transmission, strength, tear resistance, and odor transmission. Absorbent can be built using cellulose, superabsorbent, urethane foam, meltblown, spunlace, and held together with an overlayer of spunbond. Together, these composite materials each constitute a layer or a single material could constitute a layer as well. Typically, when employed as a diaper changing mat, the buttocks pad 12 contains the absorbent layer, a layer of waterproof plastic film attached on the back side, and the underlying layer of plastic film 16 that is the larger mat. In this configuration, the absorbent is bonded to the middle plastic film layer substantially around its perimeter with optional bonding interior to the perimeter. The plastic film attached to the back side of the absorbent is then attached to the larger layer of plastic film that is the mat on three sides, with one side left open. Best is that the open side is closest to the long end of the mat, but any of the other sides will also work. The side that is left open becomes a pocket that is used to stuff the dirty diaper after changing. This bonding, as mentioned herein typically retains more liquid, typically urine or urine and liquid fecal matter than is independently held by the absorbent material. The bonded perimeter serves to seal in the liquid within the buttocks pad portion.

The buttocks pad can be designed so that it is a 3-layer or a 4-layer design. In the 4-layer design, the absorbent (layer 1) is attached substantially around its perimeter to a layer of waterproof plastic (layer 2). It can also be attached interior to the perimeter. Layer 2 is then attached around its perimeter with a waterproof seal to layer 3 except that it is left unattached on the side that is closest to the head pad. Layer 3 is attached around its perimeter with a waterproof seal to layer 4, which is the underlaying mat, except that it is left unattached on the side closest to the end of underlying mat. To facilitate heat sealing, layer 3 can be made slightly shorter than layer 2 on the end that is proximate to the head pad. When constructed in this manner, the product can be used following these steps to contain a dirty diaper so that everything that touched either the baby or what was beneath the baby is contained inside a waterproof pouch so that nothing that could be contaminated touches a diaper bag, and the outside of the pouch is completely clean. Generally speaking, as shown in FIGS. 3A-3K the process of using such a constructed system includes the following steps: 1) after changing the baby, take the baby off the diaper changing mat and place the dirty diaper 20 on top of the absorbent pad, 2) after flipping up an optional flap 22 reaching inside the pouch opening closest to the end of the mat, grasp the diaper and turn the pouch inside out around the diaper and stuff the entire mat inside, 3) reach inside the newly exposed pouch opening 24, which was opposite the first opening, and turn the pouch inside out a second time. The result is that a dirty diaper is completely contained inside two inside-out operations/inversions, everything that could be dirty is sealed inside, and the diaper cannot leak into a diaper bag. An "indicator" for users of the product is that layer 1 is distinguishable as the absorbent, layers 2 and 3 are one color (white, for example), and layer 4 is a different color (violet, for example). Upon executing the first inside-out maneuver, the pouch is violet on one side and white on the other (See FIG. 3H, for example). Upon executing the second inside-out maneuver, the pouch is white on both sides (See FIG. 3K).

Other diaper changing pads are big when folded before use, and big when wadded up or folded after use. The diaper changing mat of the present disclosure is designed to be folded in a compact form. The design that results in a folded size that fits in a pants pocket, small pocket of a bag or luggage, as discussed herein. The folded diaper changing pads of present disclosure are designed to be as compact as possible while still providing the functionality needed. They are typically smaller than 6 inches by 6 inches by 2.5 inches, more typically smaller than 5 inches by 5 inches by 1.5 inches, and most typically smaller than 4 inches by 4 inches by 1 inch. As discussed above, the folded product may also be 2.75 inches by 3.25 inches by ⅜ inch or less.

Prior diaper changing pads are also typically provided without packaging at the point that they are carried by a caregiver and are intended to be used on multiple occasions and not disposed of after each use. A benefit of the diaper changing mat of the present disclosure is that caregivers can stash this product prior to its use everywhere they may need them to be handy and at the ready so they never run the risk of being caught without a product for changing diapers. Since it may be stashed in many different locations for indeterminate periods of time, the diaper changing mats in the folded state are typically protected from getting contaminated. That protection may come in any of the following three different ways: a) it can be packaged inside a sealed tear-open poly bag that is discarded upon opening, b) it can be folded and then held in its folded position by a piece of tape, and c) it can be designed with a small integrated pouch and the entire folded product can be tucked inside that pouch. To use the product, typically the folded product, which may be a small integrated pouch, is flipped inside out and unfolded. First, the open mat is typically rolled along its long axis and then flattened so the lay-flat dimension is about 4 inches across. Then, it is typically rolled in the other direction so the lay-flat dimension is about 4 inches across. This method of rolling and folding enables quick one-handed deployment of the product by the user, which is often a mother, father, or guardian who may have their hands full of other items and/or trying to manage other children. Another novel way to package this mat is to make the second roll around a 0.5 inch mandrel so that the finished packaged product is shaped like a cigar that is 4 inches long and about 1.5 inches in diameter.

The diaper changing pouch has various features and benefits. First, the diaper changing pouch may have a waterproof mat. The base plastic when the mat is just a pouch or the base plastic film layer may be and typically is a waterproof surface, nominally 2-mil polypropylene plastic film, on which to change a baby's diaper protects baby from whatever is underneath, and protects whatever is underneath from both urine and fecal matter that is in a baby's diaper. The nominal size of the diaper changing pouch is 26 inches by 16 inches, which also happens to be the Golden Ratio that is pleasing to the eye. The diaper changing pad can be made larger or smaller.

The diaper changing pouch of the present disclosure is functional with or without the "head pad." A head pad is typically included.

The head pad 14 protects a baby's head during diaper changing. The head pad 14, nominally about 5.7 inches by about 7 inches, can be made of polypropylene nonwoven spunbond, or spunlace, or melt blown and attached to the about 2-mil plastic film so that it is centered on the 16 inch dimension of the plastic film and about two inches, or two inches or more from the 26 inch edge of the plastic film.

Figure 25:
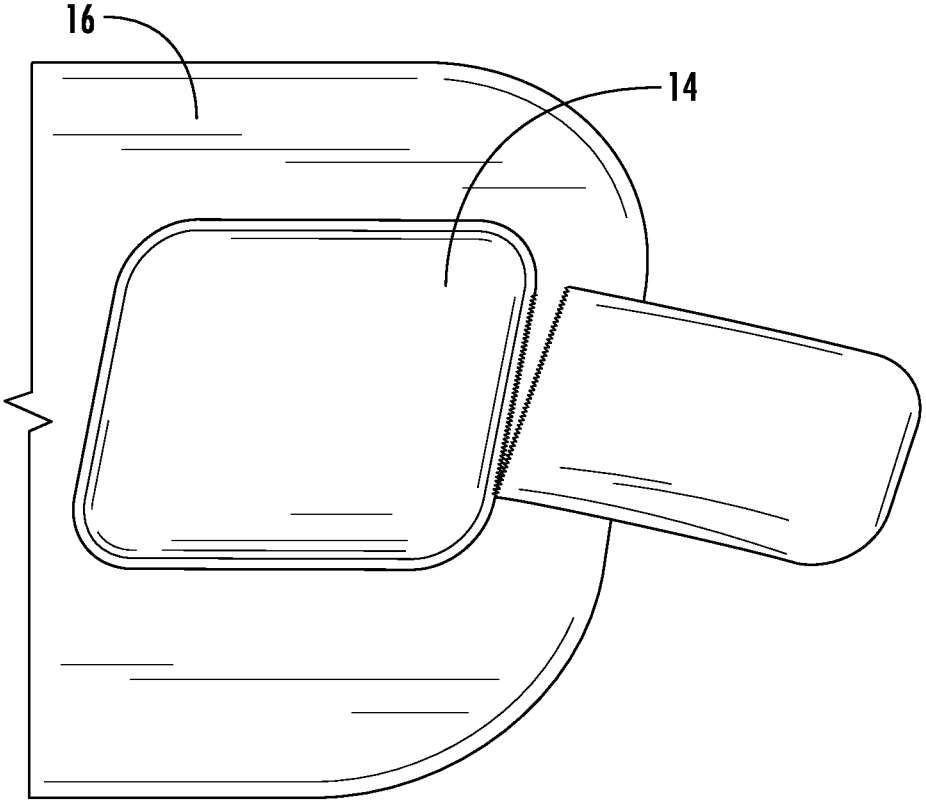
FIG. 25 is a perspective view of the head pad portion of a diaper changing mat according to an aspect of the present disclosure showing a portion of the head pad that will be used as a wipe/cloth being torn away from the head pad portion. The wipe may be used to remove an initial quantity of infant/child urine and/or fecal matter from a surface, typically a human skin surface.

The head pad 14 can be made with a folded layer of nonwoven material. Rather than attaching the head pad around its entire circumference, it can be attached to the base plastic film layer 16 on only three sides with the unattached side closest to the perimeter edge 18 of the plastic film. The extra material can lay on top of the attached portion of the head pad, or can be tucked under the attached portion of the head pad. When done this way, the head pad has three additional benefits:

The extra material in the head pad can be unfolded and extended above the top edge of the plastic film, lengthening the effective area of the diaper changing mat to accommodate longer babies or infants, while still being able to place a baby's buttocks on the buttocks pad. FIG. 25 shows the unfolded and extended head pad.

The extra material in the head pad can be unfolded and torn off as shown in FIG. 25. Perforations along a side of the unfolded head pad make tearing off the head pad easier and perforations may be employed. When torn off, the extra material can be used as a "dry-wipe" to remove the bulk of fecal matter from baby's skin in a particularly messy diaper. One side of the dry wipe can be a dry absorbent and the other side can be coated with a waterproof plastic film or other barrier to prevent particularly messy fecal matter from penetrating the dry wipe and getting on a caregiver's hands. FIG. 25 shows the unfolded head pad being torn off so it can be used as a dry wipe.

When sealed only around three edges, the head pad has an opening at the top that can be used as a storage area during diaper changing or afterward. During diaper changing, as discussed earlier herein, a caregiver can stuff additional padding in this opening to provide additional cushioning and support for baby's head. After diaper changing, a caregiver can stuff used wet or dry wipes inside this opening.

A dry wipe, typically one without added moisture, though a dry wipe can contain a small amount of lotion or surfactant or other similar component to aid in cleaning, can be stuffed inside the open end of the head pad as well or instead of the tear off wipe. The advantage of a dry wipe is that it will be particularly good at removing messy, liquid fecal matter from a baby's bottom.

The buttocks pad 12 (See FIG. 1) protects a baby's bottom during diaper changing and acts as an absorbent to contain both urine and fecal matter that is on baby's skin or that spills out of a diaper 20. The buttocks pad 12, typically is rectangular and measures about 9 inches by about 11.75 inches and is typically made of non-woven and attached to the typically 2-mil base plastic film layer 16 so that it is centered on the 16 inch dimension of the base plastic film layer 16 and about 2.375 inches from the 26 inch edge of the plastic film opposite the head pad.

The buttocks pad 12 can be made in several different ways so that it becomes a pouch that can be used to contain a messy diaper and messy wipes after diaper changing.

In the simplest way, the buttocks pad 12 is attached to the plastic film layer 16 around three edges, leaving one edge open. The dirty diaper 20, dirty wipes, and the entirety of the plastic film can be stuffed inside this opening to contain the diaper and mess. While this first method does accomplish some of the benefits of the present disclosure, it is not the most preferred design because the absorbent is porous, which means a small amount of odor, urine, and/or fecal matter might leak out. Also, if the stuffed pouch is placed in a diaper bag until finding a place for disposal, a dirty part of the pouch might touch the diaper bag.

In a second version employing the concepts of the present disclosure, the operation is the same as described in the first version; however, between the buttocks pad absorbent layer 26 and the large piece of plastic film that is the base plastic film layer 16 is another piece of plastic film, an intermediate plastic layer 28, that is nominally the size of the buttocks pad, i.e. approximately the same size as the buttocks pad. The opening to turn this design inside out is between the two pieces of plastic film. The advantage of this design is that the dirty diaper is contained between two pieces of waterproof plastic film when it is stuffed inside the pouch.

Figure 4:
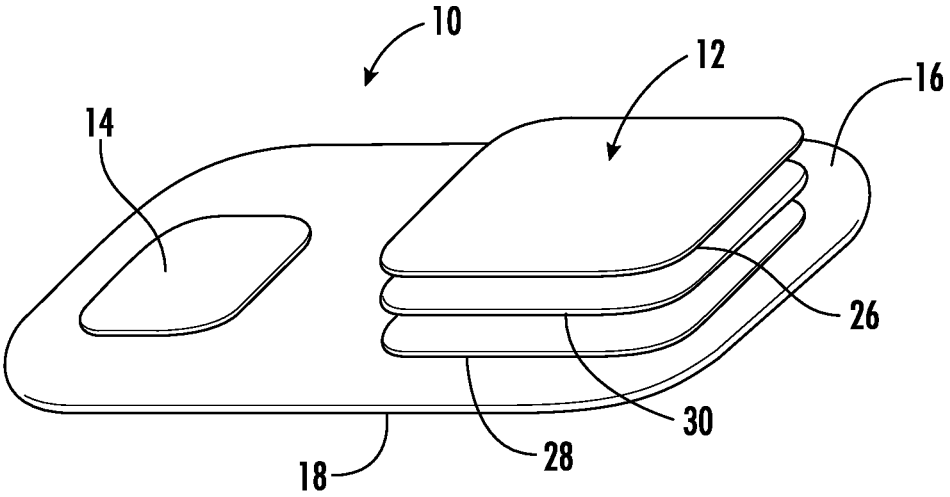
FIG. 4 is an exploded view of a diaper changing mat according to another aspect of the present disclosure—DESIGN C.

In a third design (see, for example, FIG. 4), the buttocks pad 12 is a three-layer design attached to the large piece of plastic film, making it a four-layer design. The four layers are the base plastic film layer 16, the intermediate plastic layer 28, another intermediate plastic layer 30, and the buttocks pad absorbent layer 26 in the figures. The absorbent layer 26 is typically comprised of an absorbent material(s) attached to a layer of waterproof plastic film around its entire perimeter. Intermediate layer 30 is typically attached to intermediate layer 28 around three sides. Intermediate layer 28 is typically attached to the base plastic film layer 16 around 3 sides. In use, a dirty diaper is placed on top of the absorbent layer 26. A hand is reached between the intermediate layer 28 and the base plastic film 16, the diaper is grasped, and the entire mat 10 is flipped over the diaper 20 so the diaper 20 is inside the buttocks pad pouch. Finally, a hand is reached between the intermediate layer 30 and intermediate layer 28 and the turned inside out again. After this double-flip, the diaper is secured between the intermediate layers 28, 30. Neither the absorbent layer 26 or the base plastic film layer 16 is exposed, which means no dirty surface is exposed. A caregiver is signaled that the double-flip was performed correctly because intermediate layer 28 and intermediate layer 30 are typically different colors or separately identifiable from other layers in pattern and/or color from the absorbent layer 26 and the base plastic film layer 16. The dirty diaper 20 (or other object) is contained between intermediate layers 28, 30, for practical purposes, in an at least substantially leakproof manner and in a manner that contains at least most if not all of the odor(s).

The buttocks pad 12 section of the diaper changing mat is designed to absorb and contain wet material. It is typically made of multiple layers consisting of nonwoven absorbent and waterproof plastic films. The top layer is absorbent while the layers underneath are designed to form into pockets (layers usually bonded by u-shape bonding line around the perimeter leaving one side open to form an opening for a pocket) that can be turned inside out to cleanly and securely contain messes. Turning the pockets inside out would mean that the dirty diaper, mess, or anything that touches the dirty surfaces from the outside is contained inside an everted pocket, and the previously untouched surface that is now the outside surface of the everted pocket is completely clean. Depending on the number of layers and how those are being bonded, there are many configurations that can affect the level of containment for messes and smell, number of pockets, pocket volume, and different operation methods.

A simple three-layers design with a single pocket can moderately contain messes. It is designed so that the buttocks pad can only be turned inside out once. The opening of the pocket can be configured so that it can be located at any side of the buttocks pad for this design or other designs discussed herein. More than three layers are typically needed in order to make the diaper changing mat contain messes and smell more securely. In a four-layers design, the additional layer allows the buttocks pad to have two pockets. After turning the diaper changing mat inside out using the first pocket, a second pocket will appear so that it can be turned inside out for a second time. Being able to turn the pockets inside out/invert twice helps contain mess and smell more securely.

Figure 7A:
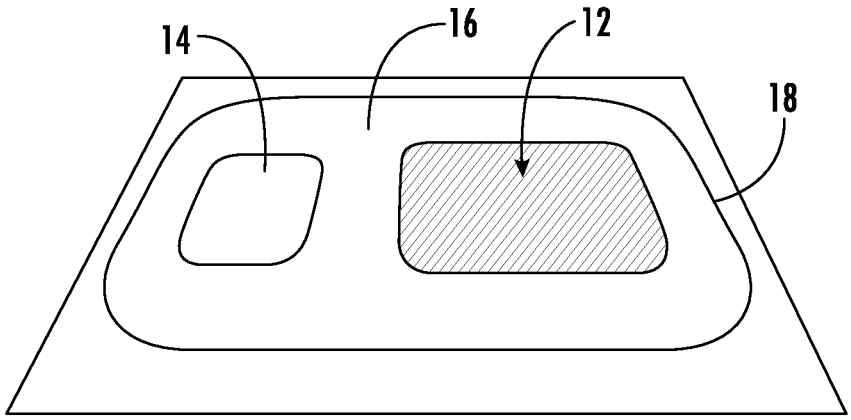
FIG. 7A is a perspective view of the diaper changing mat of DESIGN D prior to use.
Figure 7B:
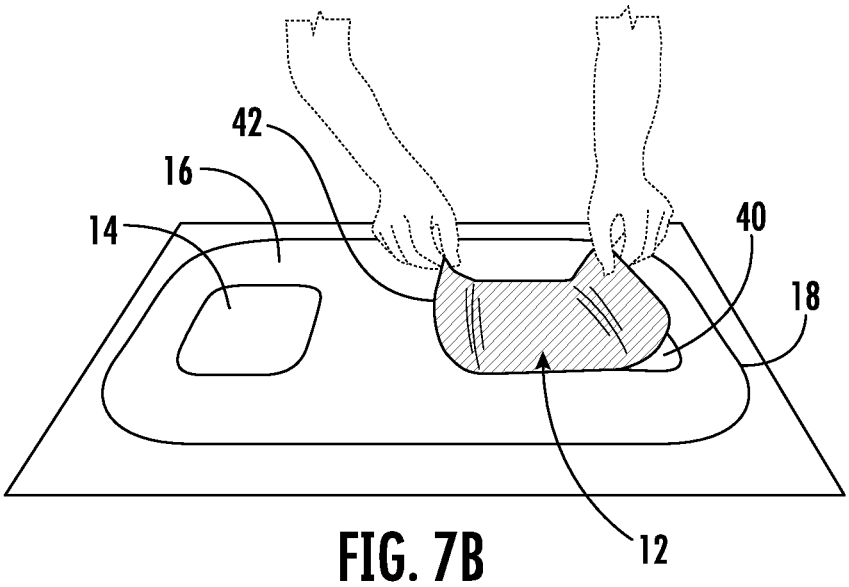
FIG. 7B is a perspective view showing an initial stage of a process for enrobing a diaper or other soiled article within the diaper mat shown in FIG. 7A with either a top pocket or a bottom pocket being opened and accessed by the user to insert the diaper.
Figure 7C:
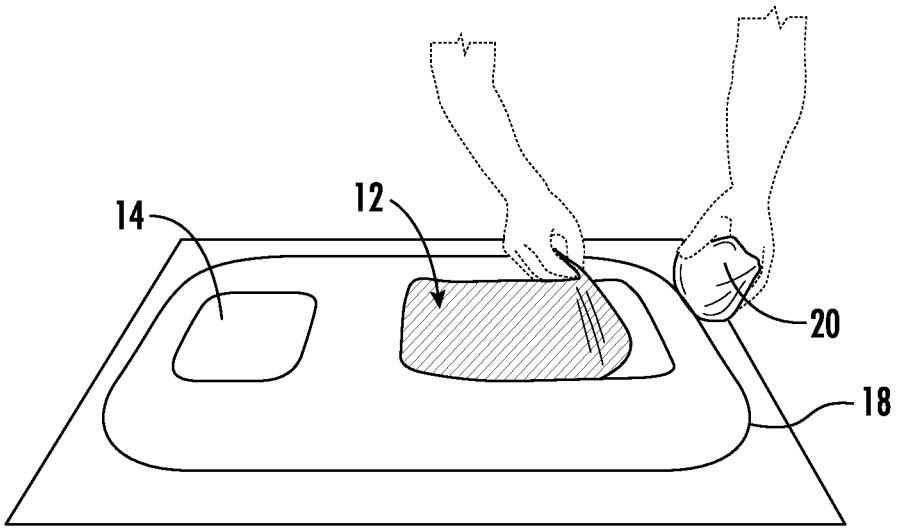
FIG. 7C is a perspective view showing an initial stage of the process of enrobing a dirty diaper or other soiled article within the diaper changing mat shown in FIG. 7A. The top flap in the process shown is folded up to reveal a bottom pocket. The dirty diaper is placed in the bottom pocket in the example shown.
Figure 7D:
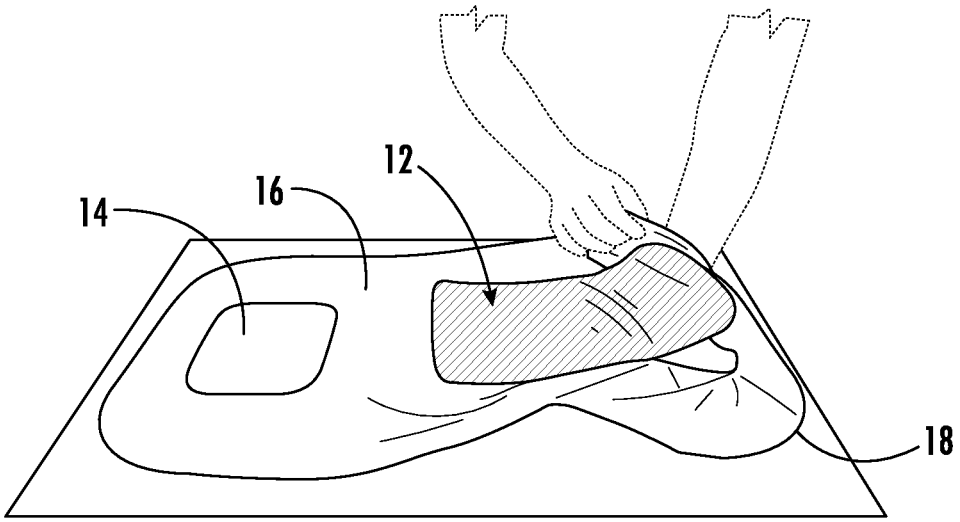
FIG. 7D shows a perspective view of a subsequent stage of the process of enrobing a dirty diaper using the diaper mat shown in FIG. 7A with the user's hand within the pocket opening in the previous stage (FIG. 7C) and inserting the dirty diaper therein.
Figure 7E:
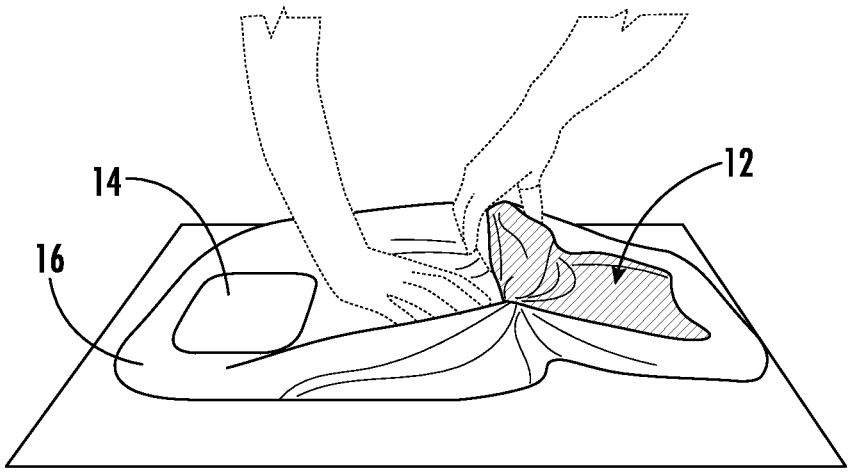
FIG. 7E is a perspective view of the next stage (after FIG. 7D) in the process of enrobing a dirty diaper within the diaper mat shown in FIG. 7A where the user reaches into the opposite pocket of where the diaper was inserted, in this case the top pocket and then inverts the diaper mat.
Figure 7F:
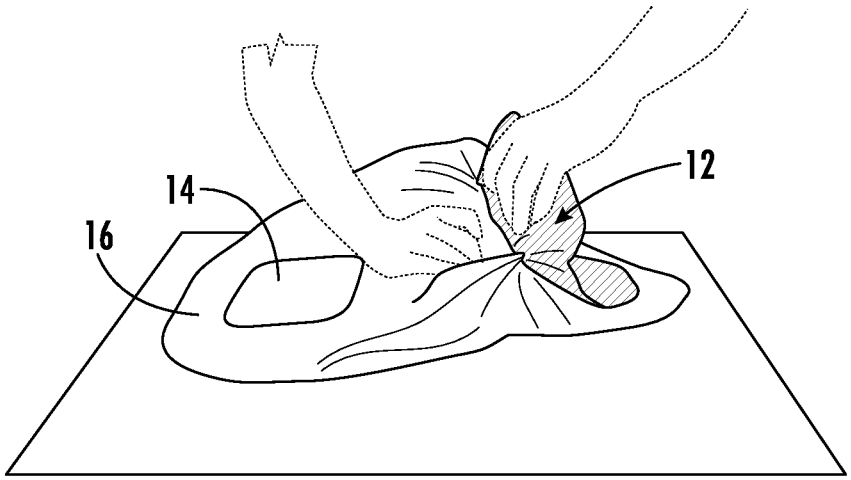
FIG. 7F is a perspective view of a subsequent stage (after FIG. 7E) of the process of enrobing a dirty diaper using the diaper mat of FIG. 7A showing the user inverting the mat by pulling the diaper through the opposite pocket.
Figure 7G:
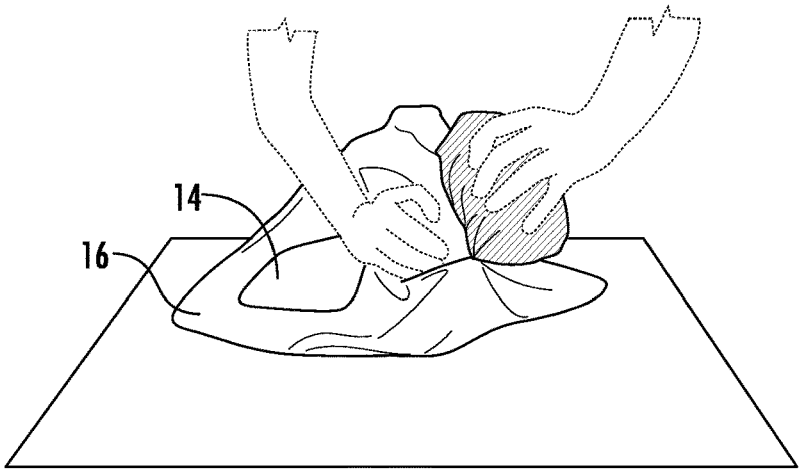
FIG. 7G shows a perspective view of a user continuing the process of enrobing a dirty diaper within the diaper mat shown in FIG. 7A.
Figure 7H:
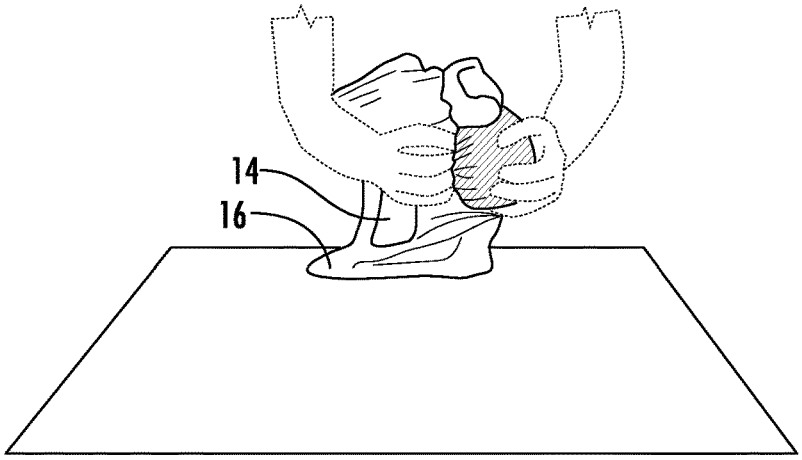
FIG. 7H is a perspective view of a subsequent stage (after FIG. 7G) of the process of enrobing a dirty diaper using the diaper mat of FIG. 7A.
Figure 7I:
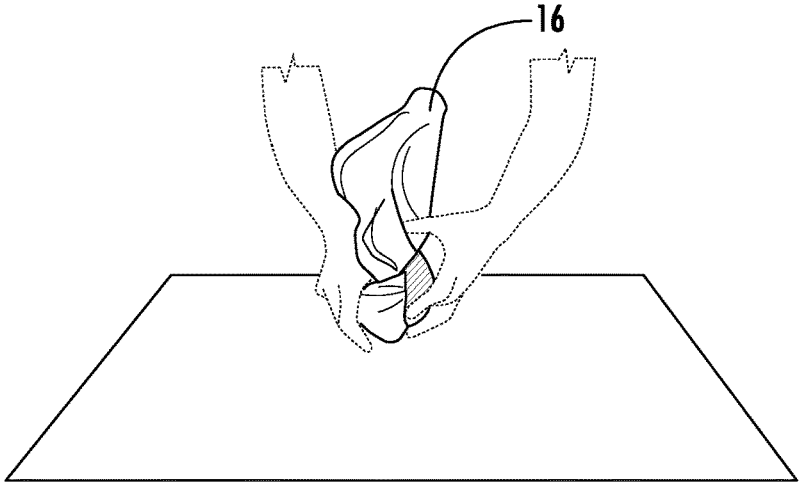
FIG. 7I shows a perspective view of a second inversion in the overall enrobing process of the dirty diaper using the diaper changing mat of FIG. 7A where a pocket revealed by the first inversion is used to receive the remaining portion of the mat tucked therein.
Figure 7J:
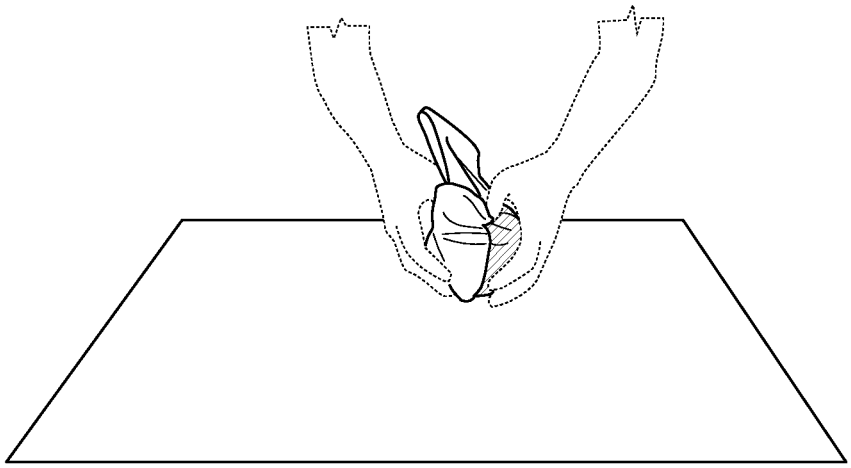
FIG. 7J is a perspective view as the process of tucking the mat into the revealed pocket.

For the design mentioned previously, the user turns the first pocket inside out to reveal the second pocket. With a different bonding configuration between the four layers, it creates two pockets 40, 42 opening that are accessible to the user at the same time such as shown in FIGS. 7A-71. The user can use one pocket to store the dirty diaper while using the other pocket to turn the diaper changing mat inside out. This design functions similarly to the previous design, but it requires the user to turn the pocket inside out only once instead of twice which can be simpler for some user. The pocket that is used to store the dirty diaper is useful, because it's a place to temporarily store the dirty diaper if there isn't a place to set it down and is out of reach from the baby. This design can also be done with three layers, but mess and smell aren't as securely contained as four layers. Having a temporarily storage pocket for dirty diaper can also be incorporated to all of the previously mentioned designs by modifying the bonding configuration.

For all designs shown and described herein, the size of the pockets can be adjusted by changing the width and length of the buttocks pad. By implementing folds 32 (pleat, z, or c folds) (See, for example FIGS. 11-12) of extra material to the pocket layers, the size of the pocket can be expanded when being unfolded naturally during operation. This is useful in some cases because it creates a new variable for pocket volume adjustment in a case when the width and length of the buttocks pad become the limiting factors. Pleats also add a Z-dimension to the absorbent that extends up or down from the XY plane which slows or channels urine so that it does not run off the edge of the absorbent area before it has time to wick into the absorbent.

The diaper changing mats 10 of the present disclosure may also utilize a buttocks pad curl-over flap 22. When bonding the layers together to form pockets, it's a u-shape bonding line 38 around the perimeter of the buttocks pad leaving one side open to form an opening for a pocket. The length of this u-shape bonding line 38 would determine unbonded material length that is the opening flap of the pocket. Long u-shape bonding line results in short opening flap, and short u-shape bonding line results in longer opening flap. Having a good length of opening flap would allow the user to use the flap to wrap around and hold the diaper while turning the pocket inside out, which can make it easier to operate.

For a typical buttocks pad 12 that is 9 inches width and 11.75 inches length, the range of flap length is typically from 0 to about 11 inches, more typically from about two to about nine inches, and most typically from about four inches to about seven inches along the buttocks pad length. For the buttocks pad 12 that's designed to be turned inside out twice, using a good flap length to wrap around the diaper during operation can naturally create a clean third pocket that the user could temporarily store dirty baby clothes or other materials after turning the pockets inside out for the second time.

In another design, the buttocks pad 12 can be removably attached with adhesive or other means of attachment to the plastic film as shown in FIGS. 15A-L. After changing a diaper and removing the baby/child from the upwardly facing surface of the mat, the user can peel the buttocks pad away from the base plastic film layer 16. Subsequently, the user can place the dirty diaper on top of the buttocks pad and turn the buttocks pad pouch inside out over the dirty diaper in a similar process if the entire mat were being initially inverted or stuff the soiled diaper inside the pouch between two layers and then flip the buttocks pad inside out. At the user's option, stuff the big piece of plastic film into the pouch also. Once the pouch is turned inside out, the opening for the second flip of the pouch is exposed. Thereafter, the enrobed diaper is inverted/flipped a second time (See FIGS. 15J-L such that the diaper is sealed inside two layers of plastic film material.

The mat is typically made of thin, waterproof plastic film with an integrated absorbent pad that is used to protect a baby and what is beneath the baby while a messy diaper is being changed. The combination of plastic film and absorbent pad is designed to stuff into a pouch that is, nominally, not more than about twice the volume of a dirty diaper filled with both urine and fecal matter. Caregivers would be inclined to use a diaper changing mat with these characteristics because there are times when a dirty diaper cannot be immediately disposed of disposal of and without a shielded dirty diaper, so the dirty diaper is put in an already-too-full diaper bag. The two inventions that make this objective feasible are making the area of the absorbent pad smaller than the area of the overall mat, and minimizing the volume of the absorbent pad.

A multi-layer pouch for diaper changing that is placed on top of a separate surface, or directly on a permanent surface like a floor or table. The pouch that is not part of a mat or is part of an overall mat can be made with a three-layer or four-layer construction. In a three-layer construction, the layers are absorbent and two layers of waterproof plastic film. The absorbent layer can be attached to one of the plastic layers by any means (100% bonded, perimeter bonded, spot bonded, corner bonded). The two layers of waterproof plastic film are bonded around their perimeter on three sides, leaving one side open. When diaper changing is completed, the user folds the diaper into a compact shape and places the dirty diaper inside the pouch between the two layers of waterproof plastic film. In the four-layer construction, the absorbent layer is attached to the waterproof plastic film layer next to it as in the three-layer construction. The other two layers of plastic film (green, for example) are the same color. They are attached to each other around three sides, leaving one side open. The open sides can be in the same position, offset by 90°, or offset by 180°. When the four-layer construction is used the open sides are typically offset by 180°, which means only one opening to the pouch is visible when the diaper is being changed. When the three-layer construction is used, a used diaper can be stored by stuffing it between the two layers sealed around three sides. Alternatively, the user can place the dirty diaper on top of the absorbent, reach a hand into the open end between the two layers, and turn the pouch inside out over the dirty diaper. When the four-layer construction is used, it can be used in both ways, i.e. the three-layer construction can be used. Once the pouch is turned inside out over the dirty diaper, the opening between the two layers of plastic film (green film) is exposed. Reaching into the opening between the two layers of plastic film (green layers, for example), turn the pouch inside out a second time, which completely seals the dirty diaper inside the pouch.

Figure 5A:
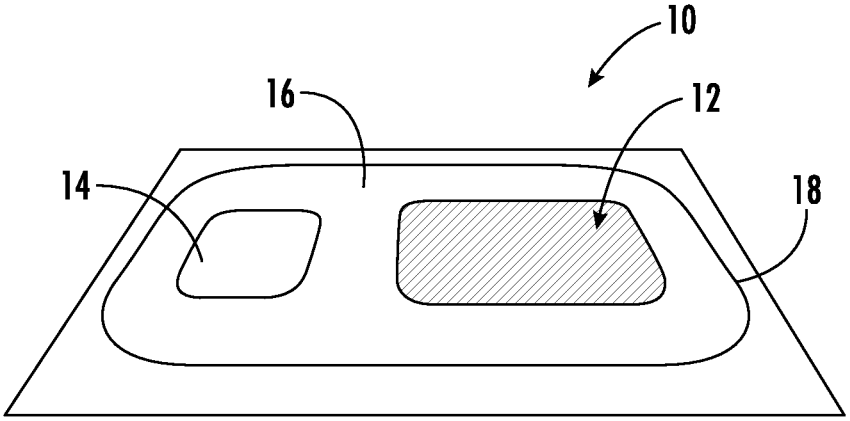
FIG. 5A is a perspective view of the diaper changing mat of DESIGN C.
Figure 5B:
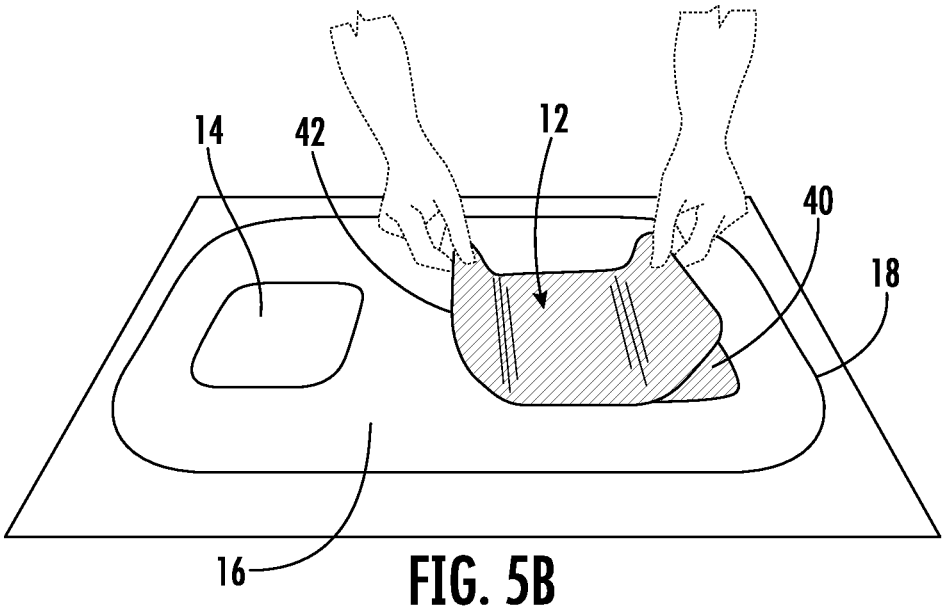
FIG. 5B is a perspective view showing an initial stage of a process for enrobing a diaper or other soiled article within the diaper mat shown in FIG. 5A. The dirty diaper is placed on the infant buttocks mat and a flap on either the bottom or top of the buttocks pad portion grasped.
Figure 5C:
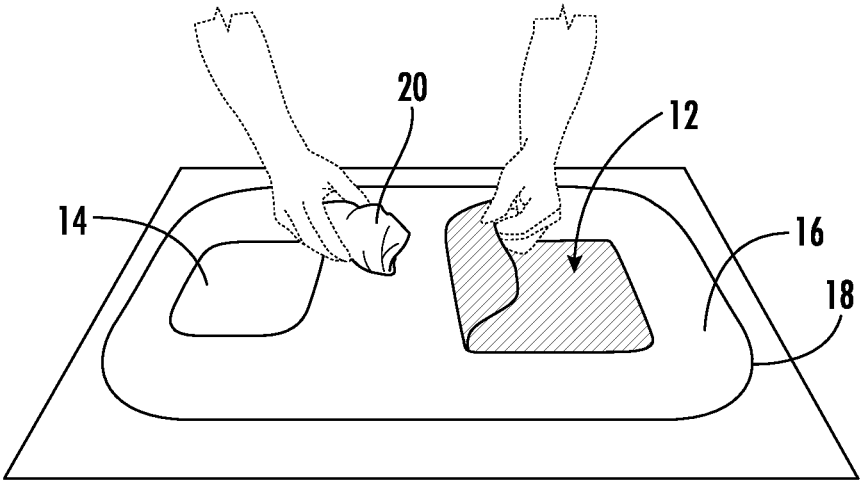
FIG. 5C is a perspective view showing a subsequent stage of the process of enrobing a dirty diaper within the diaper changing mat shown in FIG. 5A. The top flap in the process shown is folded up to reveal a bottom pocket.
Figure 5D:
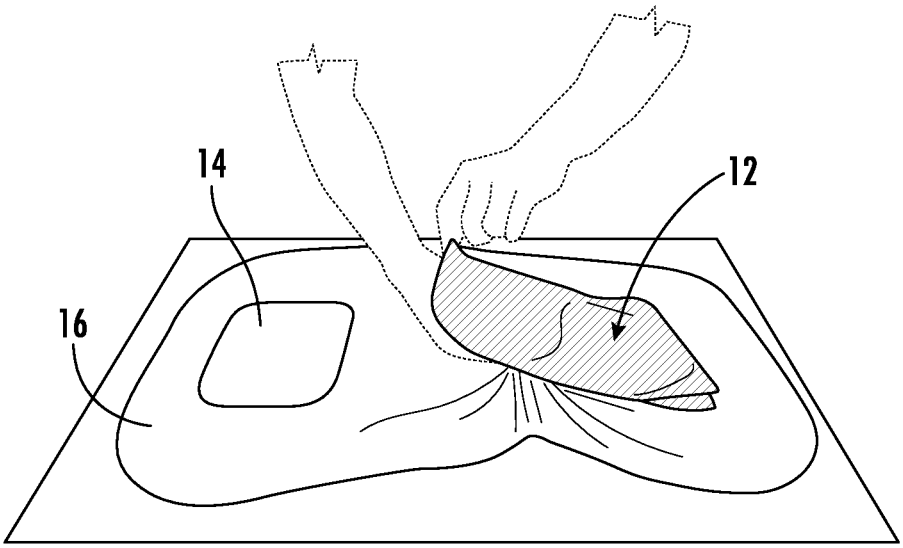
FIG. 5D shows a perspective view of the next stage of the process of enrobing a dirty diaper using the diaper mat shown in FIG. 5A with the user's hand within the pocket opening in the previous stage (FIG. 5C) and inserting the dirty diaper therein.
Figure 5E:
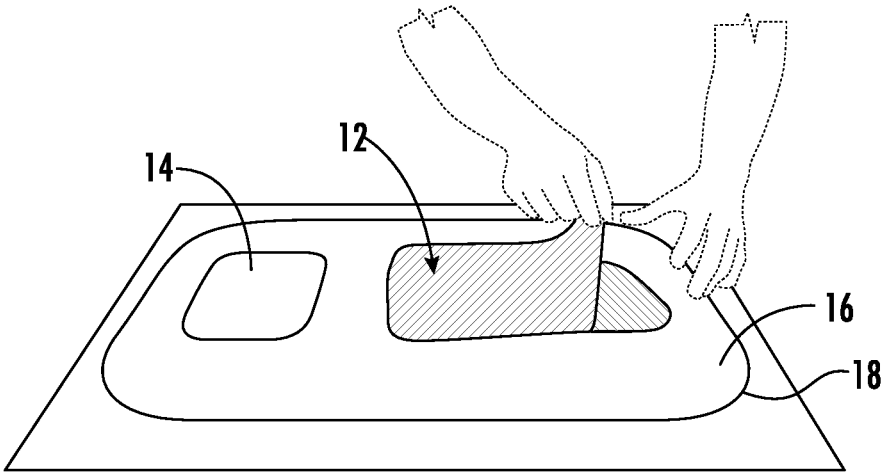
FIG. 5E is a perspective view of the next stage (after FIG. 5D) in the process of enrobing a dirty diaper within the diaper mat shown in FIG. 5A.
Figure 5F:
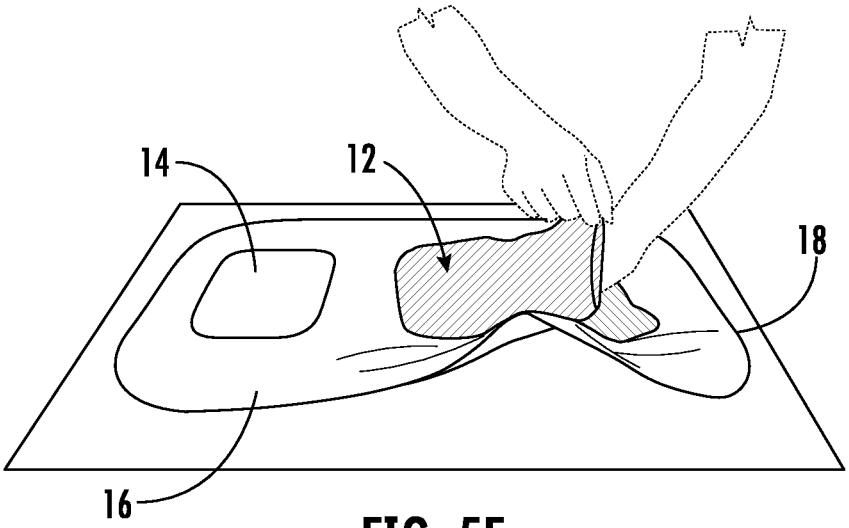
FIG. 5F is a perspective view of a subsequent stage (after FIG. 5E) of the process of enrobing a dirty diaper using the diaper mat of FIG. 5A.
Figure 5G:
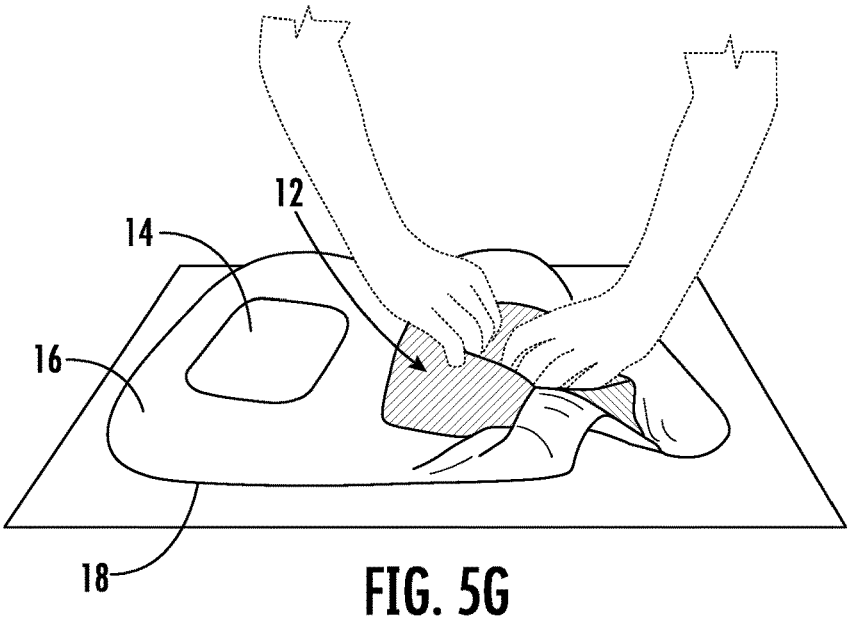
FIG. 5G shows a perspective view of a user continuing the process of enrobing a dirty diaper within the diaper mat shown in FIG. 5A.
Figure 5H:
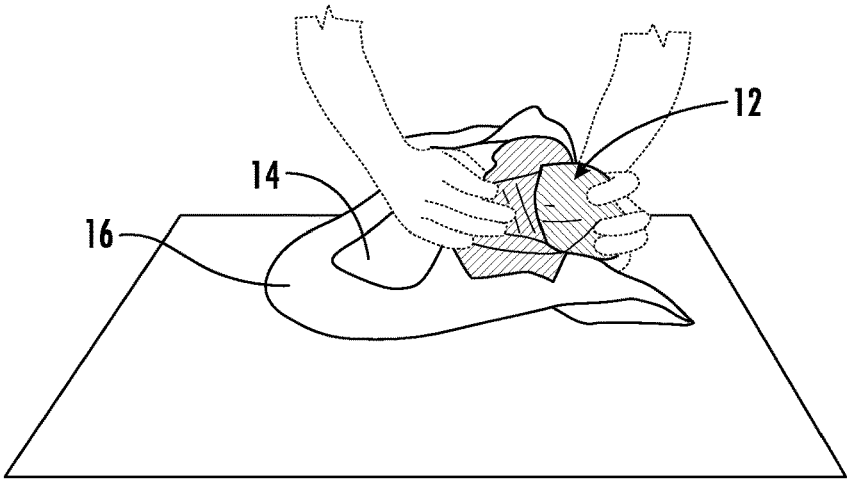
FIG. 5H is a perspective view of a subsequent stage (after FIG. 5G) of the process of enrobing a dirty diaper using the diaper mat of FIG. 5A.
Figure 5I:
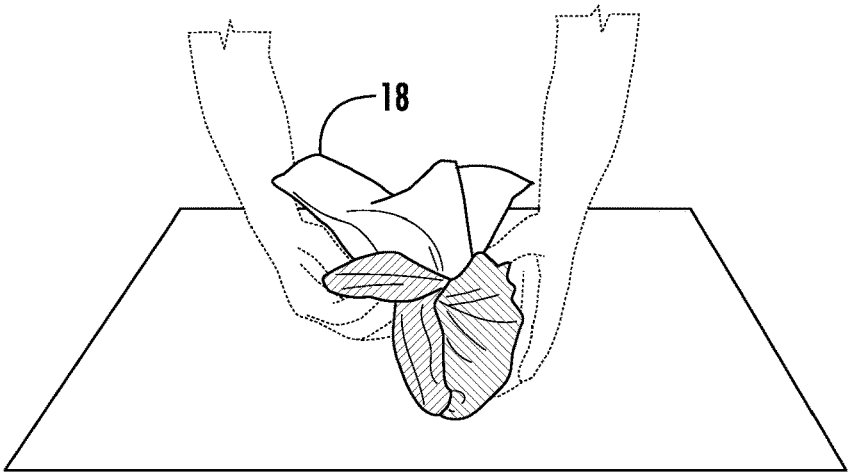
FIG. 5I shows a perspective view of a second inversion in the overall enrobing process of the dirty diaper using the diaper changing mat of FIG. 5A where a pocket revealed by the first inversion is used to receive the dirty diaper and mat a second time such that the second plastic film covers the overall dirty diaper and mat.
Figure 5J:
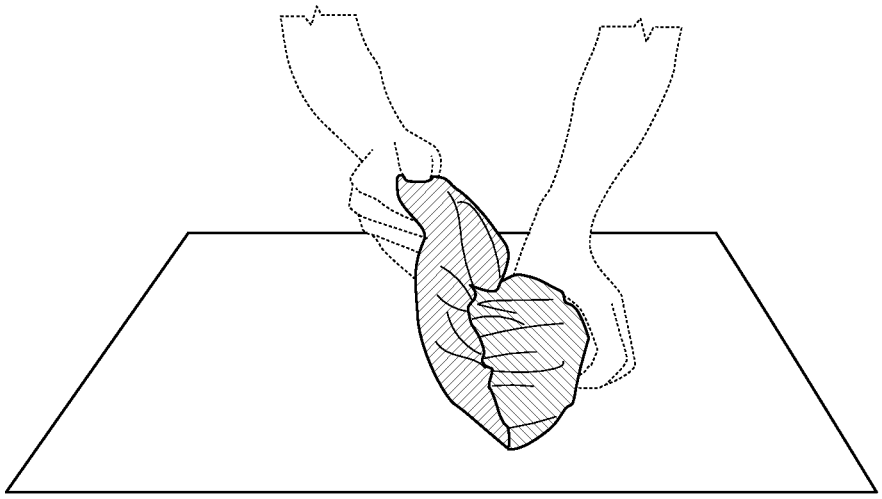
FIG. 5J is a perspective view as the process of inserting the dirty diaper and mat into the second pocket revealed by the first inversion is undertaken.
Figure 5K:
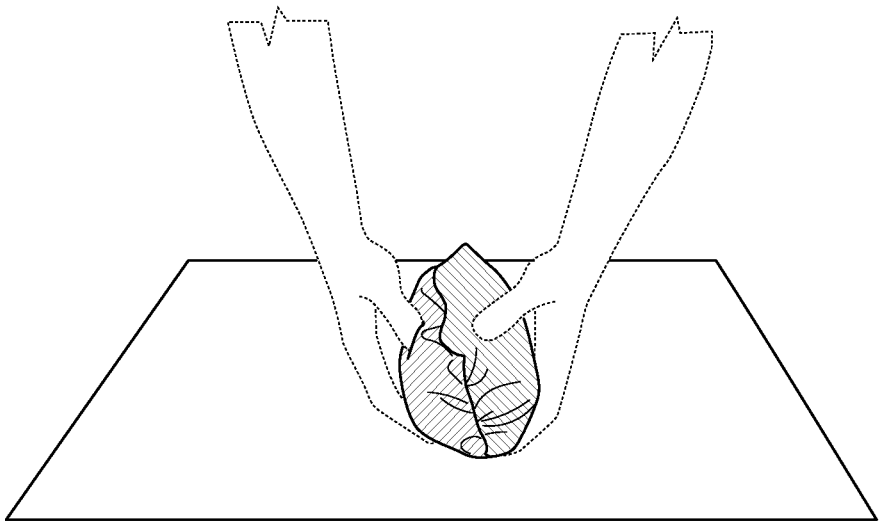
FIG. 5K is a perspective view showing the completed second inversion with excess material tucked into the second pocket and the entirety of the base portion of the diaper changing mat completely enrobed by the first plastic film and the second plastic film thus preventing leakage of any contaminates within the diaper by creating a disjointed pathway contaminates would have to travel in order to escape the double inversion of the overall product.

The buttocks pad pocket of the diaper changing mat previously discussed (DESIGN B) is designed to be turned inside out twice to securely contain the mess. The following description explains an alternative design (DESIGN C, FIGS. 4-5K) that can affectively function similar to the previous design, but it requires the user to turn the pocket inside out only once instead of twice. As shown in FIG. 5A, the outside visual of a complete product is the same as the previous design in term of sizing for the head pad, buttocks pad, and the overall size of the diaper changing mat.

Figure 4A:
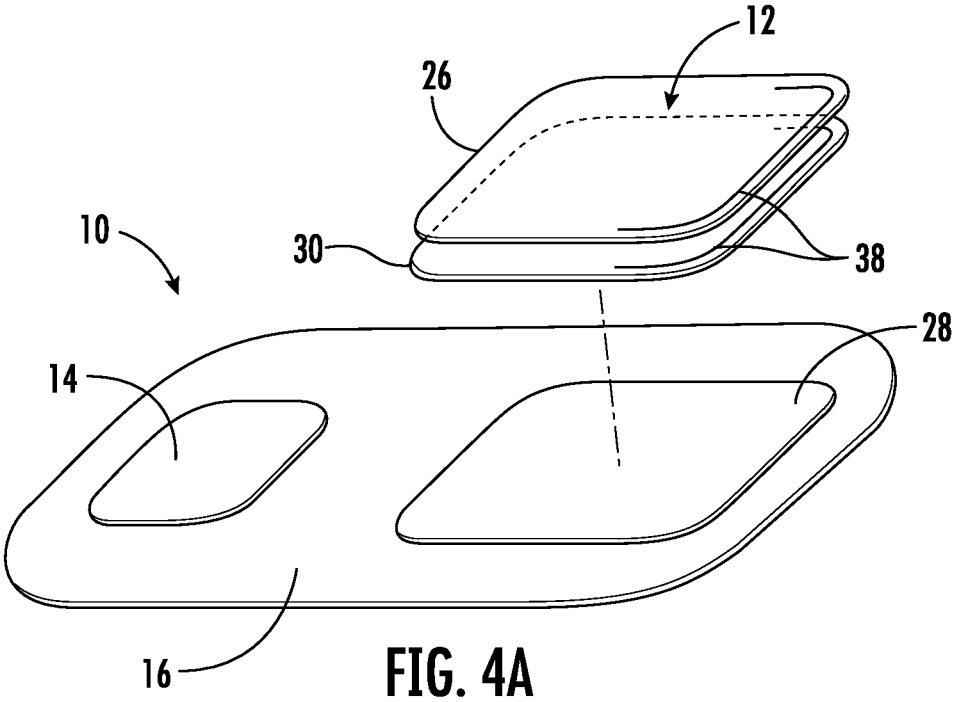
FIG. 4A is an exploded view of a diaper changing mat of DESIGN C and illustrates a possible bonding line between the buttocks absorbent layer and the first plastic film of the diaper changing mat of FIG. 4.
Figure 4B:
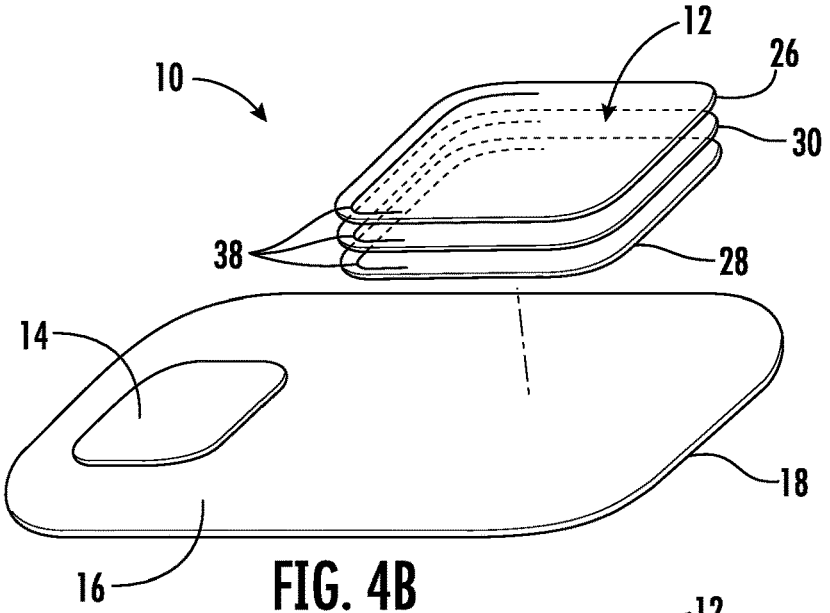
FIG. 4B is an exploded view of the diaper changing mat of DESIGN C and illustrates a possible bonding line between the buttocks absorbent layer, first plastic film, and second plastic film of the diaper changing mat of FIG. 4.
Figure 4C:
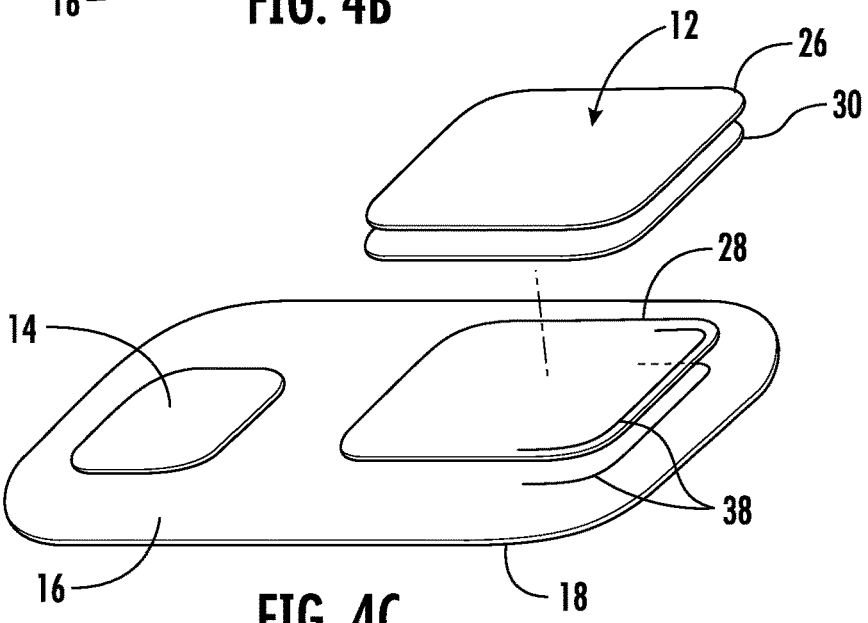
FIG. 4C is an exploded view of the diaper changing mat of DESIGN C and illustrates a possible bonding line between the second plastic film and the base plastic film of the diaper changing mat of FIG. 4.
Figure 4D:
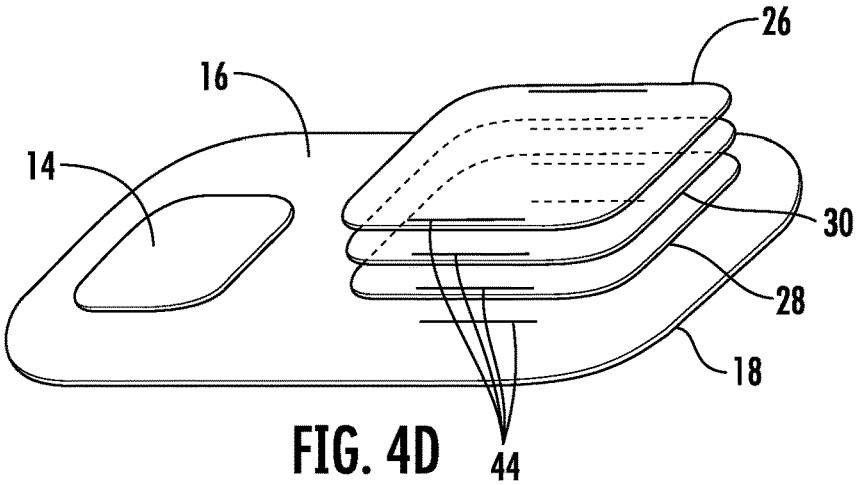
FIG. 4D is an exploded view of the diaper changing mat of DESIGN C and illustrates the bonding lines between the buttocks absorbent layer, first plastic film, second plastic film, and base plastic film of the diaper changing mat of FIG. 4.

As shown in FIG. 4A, the buttocks absorbent layer is bonded to the first plastic film in a u-shape line 38 at the bottom end. FIG. 4B shows that the buttocks absorbent layer, the first intermediate plastic film 28, and the second intermediate plastic film 30 are bonded in a u-shape line at the top end toward the head pad. FIG. 4C shows the second intermediate plastic film 30 bonded to the base plastic film layer 16 in another u-shape line at the bottom end. FIG. 4D shows that all layers of the buttocks pad are being sealed together by the side bonding lines 44. All the ends of the u-shape bonding lines 38 and side bonding lines 44 (FIG. 4A-D) should be connected to make a complete seal around the pockets, which it is in this case but not always required.

For this bonding configuration, it creates an open bottom pocket (FIG. 4) between the first intermediate plastic film and second intermediate plastic film, forming a space into which the user can insert the messy diaper. This pocket is useful, because it's a place to temporarily store the dirty diaper if there isn't a place to set it down and is out of reach from the baby. It also creates an open top pocket at which the user can reach in to turn the diaper changing mat inside out with the messy diaper inside. The process operation can be reversed in which the user can insert the messy diaper into the top pocket 42 and use the bottom pocket 40 to turn the diaper changing mat inside out while maintaining the same containment function. Since the buttocks pad is a square with rounded corners, the bonding lines can be switch around to have the two pockets' openings located on both sides, or one side and one top or bottom, instead of top and bottom pockets' openings as presented previously.

DESIGN D

Figure 6:
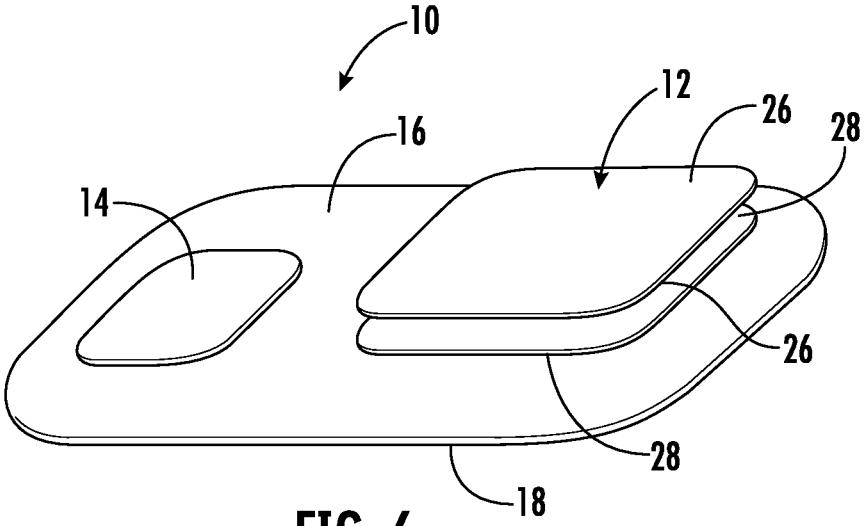
FIG. 6 is a front perspective view of a diaper changing mat according to another aspect of the present disclosure—DESIGN D.
Figure 7K:
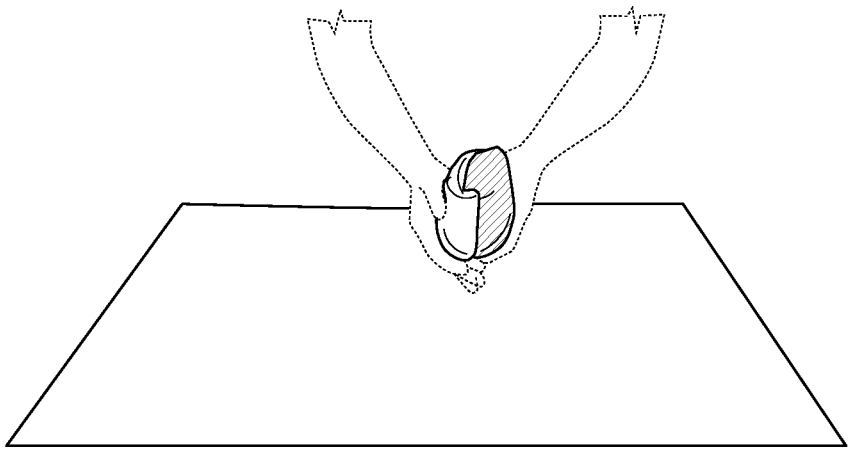
FIG. 7K is a perspective view showing the completed inversion and tucking of the mat to form the finished product with the diaper enrobed in a layer of plastic.

As described earlier, DESIGN C (FIGS. 4-5K) employs at least four different layers (the infant buttocks receiving top absorbent layer, a first intermediate plastic film below the top absorbent layer, a second intermediate plastic film below the first intermediate plastic film, and a base plastic film that forms a majority, more typically all of the bottom surface, of the diaper changing mat to form a pocket that can provide good barrier to contain a messy diaper. However, a three-layer design, DESIGN D, may be employed. FIGS. 6-7K show DESIGN D in exploded view with the buttocks absorbent layer, first plastic film, and base plastic film) that will be described in this section, it can provide adequate barrier to contain a messy diaper while using less material.

Figure 6A:
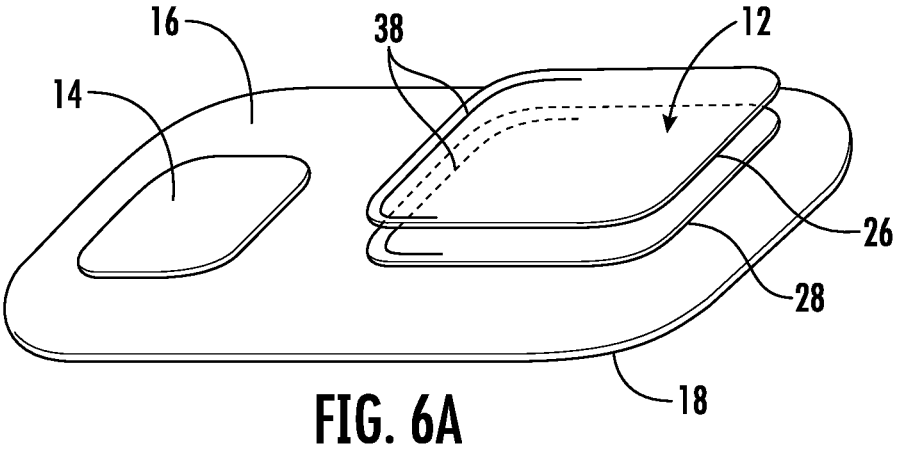
FIG. 6A is an exploded view of the diaper changing mat shown in FIG. 6 and illustrates possible bonding lines between the buttocks absorbent layer, intermediate plastic film, and base plastic film.
Figure 6B:
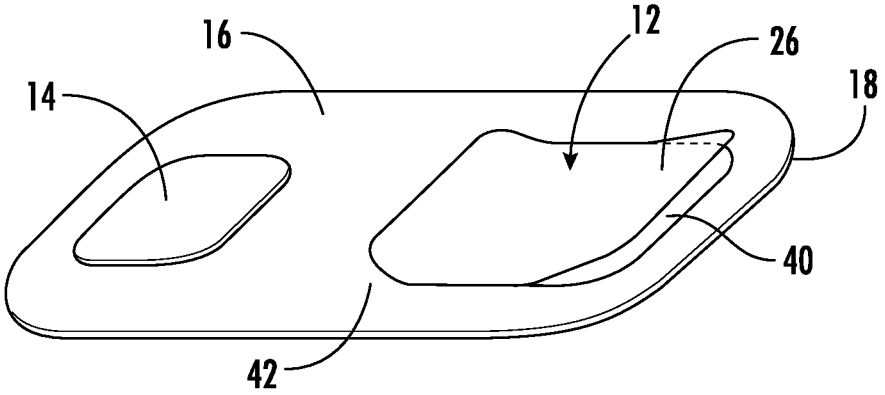
FIG. 6B is an isometric view of the diaper changing mat of DESIGN D illustrating two pockets formed between the base layer, an intermediate plastic layer and a buttocks pad.
Figure 6C:
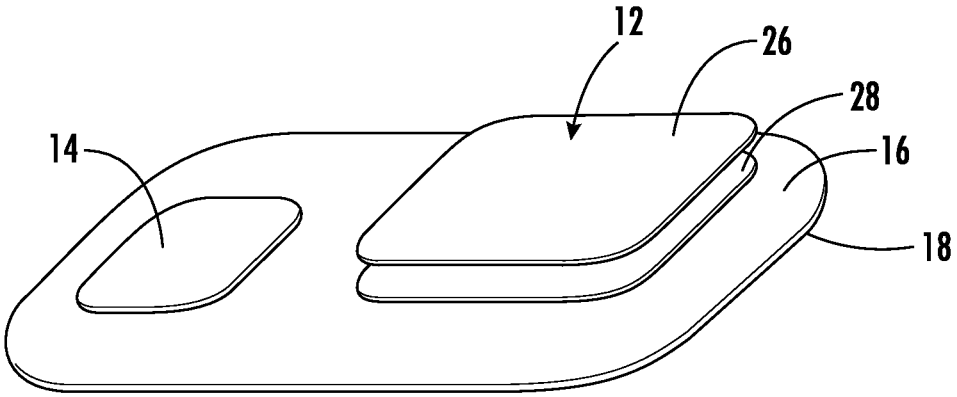
FIG. 6C is an exploded view of the diaper changing mat of DESIGN D illustrating the layers of the diaper changing mat, including the base plastic film, intermediate plastic layer and buttocks absorbent layer.
Figure 6D:
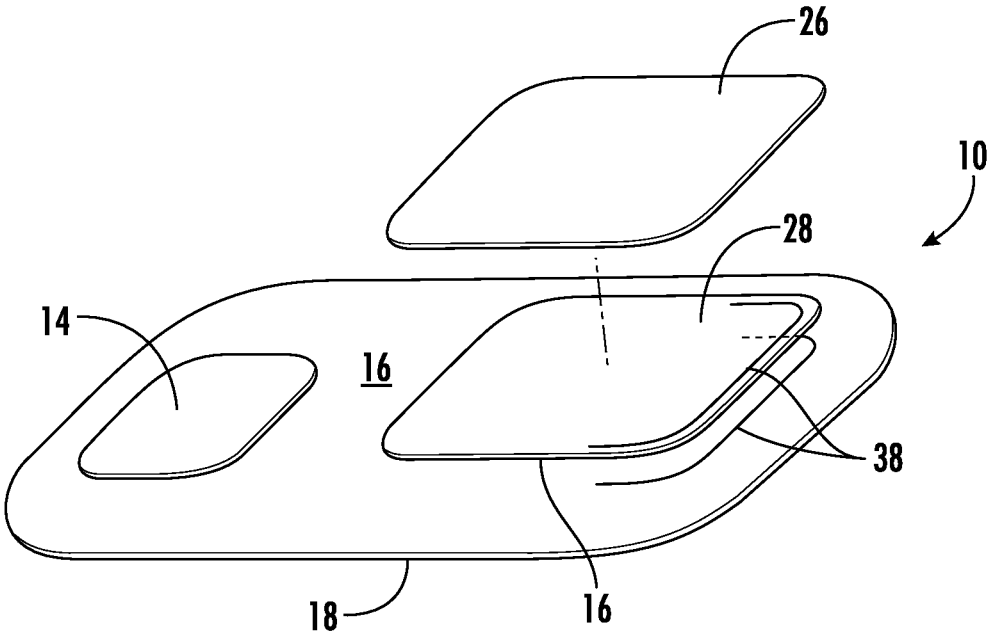
FIG. 6D is an exploded view of the diaper changing mat of DESIGN D and illustrates possible bonding lines between the buttocks absorbent layer, first plastic film, and base plastic film.
Figure 6E:
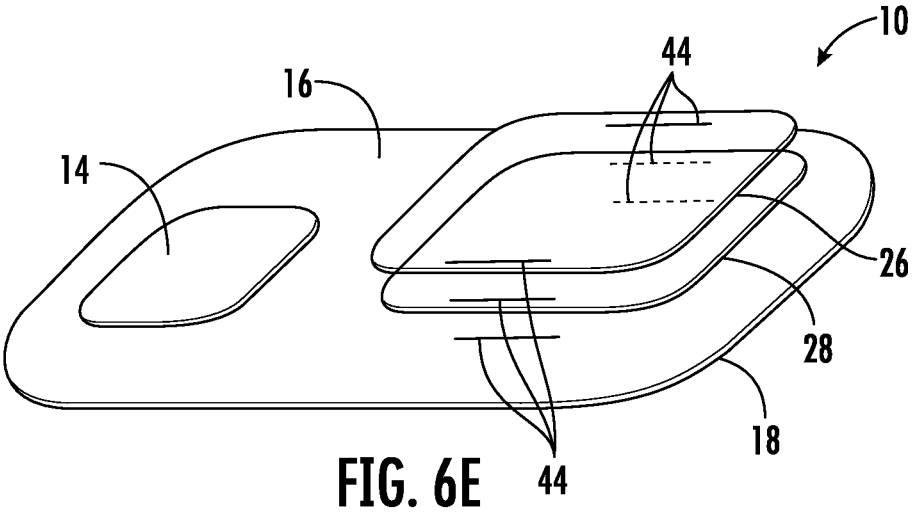
FIG. 6E is an exploded view of the diaper changing mat of DESIGN D and illustrates possible bonding lines between the buttocks absorbent layer, first plastic film, and base plastic film.

As shown in FIG. 6A, the buttocks absorbent layer is bonded to the first plastic film in a u-shape line at the top end. As shown in FIG. 6B, the first plastic film is bonded to the base plastic film in a u-shape line at the bottom end. FIG. 6C shows that all layers of the buttocks pad are being sealed together by the side bonding lines. The result is having an open bottom pocket (FIG. 6B) between the buttocks absorbent layer and the first plastic film to insert the messy diaper, and an open top pocket to turn the diaper changing mat inside out. Since the buttocks pad is typically shaped as a rectangle or square with rounded corners, the bonding lines can be switched around to have the two pockets' openings located on both sides, or one side and one top or bottom, instead of top and bottom pockets' openings as presented previously. The pockets can be on any side of the buttock pad 12, but are typically at the bottom or bottom and top of the buttocks pad 12.

DESIGN E

Figure 8:
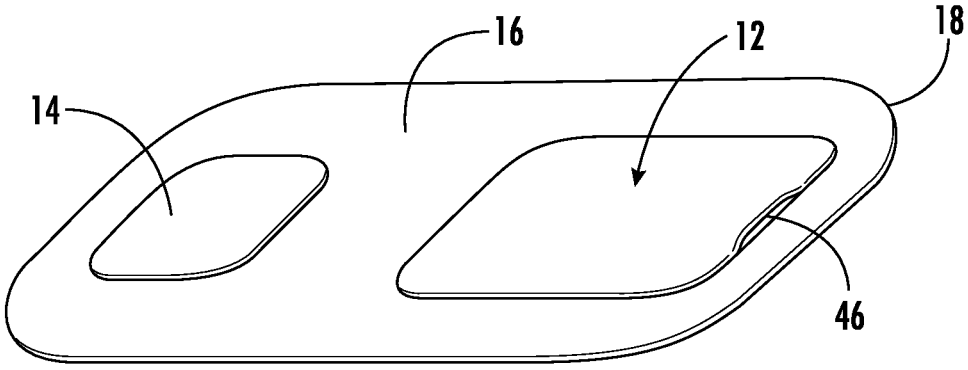
FIG. 8 is an isometric view of the overall shape and size of the diaper changing mat according to another aspect of the present disclosure—DESIGN E.
Figure 8A:
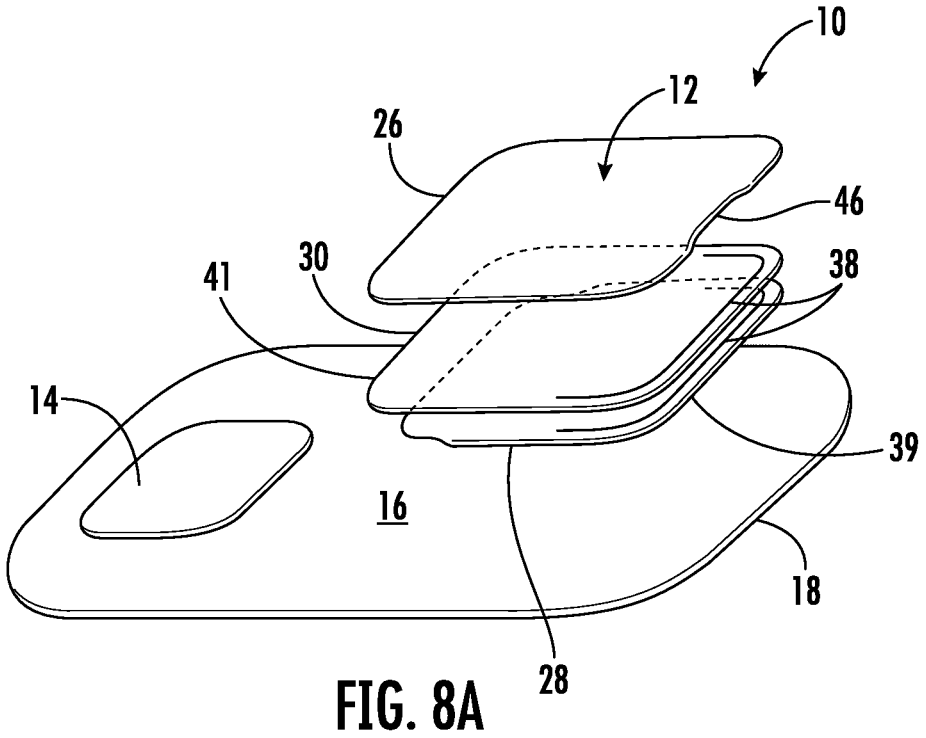
FIG. 8A is an exploded view of the diaper changing mat of DESIGN E and illustrates a possible bonding line between the first plastic film and the second plastic film.

Here, DESIGN E, which has at least four layers, will have the combined functionality of both DESIGN B (regarding being able to turn the pocket inside out twice for extra containment security) and DESIGN C (regarding having a place to temporarily store the dirty diaper that is out of reach from the baby). As shown in FIG. 8, there may be a notch 46 at the bottom of the buttocks pad that makes DESIGN E different in appearance from previous designs. As shown in FIG. 8A in exploded view, the notch 46 is only applied to the buttocks absorbent layer 26, and it is an indication to visually show the separation between the buttocks absorbent layer 26 and the intermediate plastic film 30.

Figure 8B:
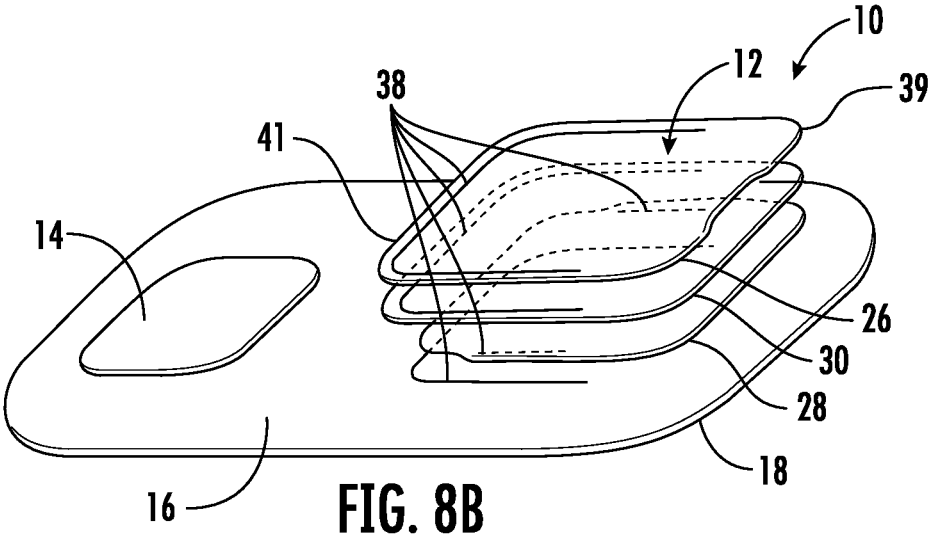
FIG. 8B is an exploded view of the diaper changing mat of DESIGN E and illustrates the bonding line between the buttocks absorbent layer, first plastic film, and base plastic film.
Figure 9A:
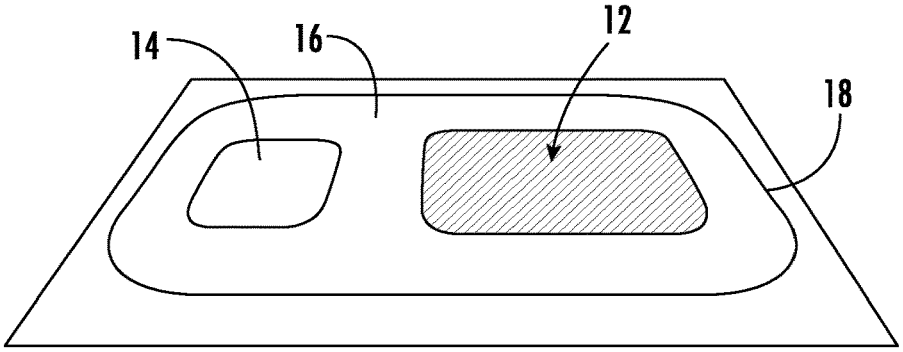
FIG. 9A is a front perspective view of an exemplary diaper changing mat shown in FIG. 8 having an insert pocket at the foot end of the diaper changing mat prior to being used to wrap a dirty diaper.
Figure 9B:
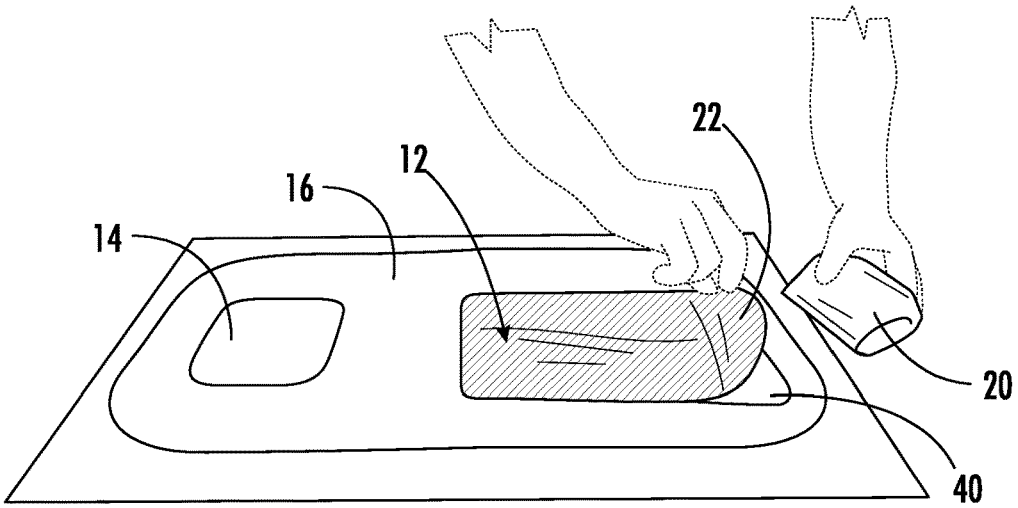
FIG. 9B is a front perspective view of the user inserting a diaper into the pocket of the diaper changing mat of DESIGN E.
Figure 9C:
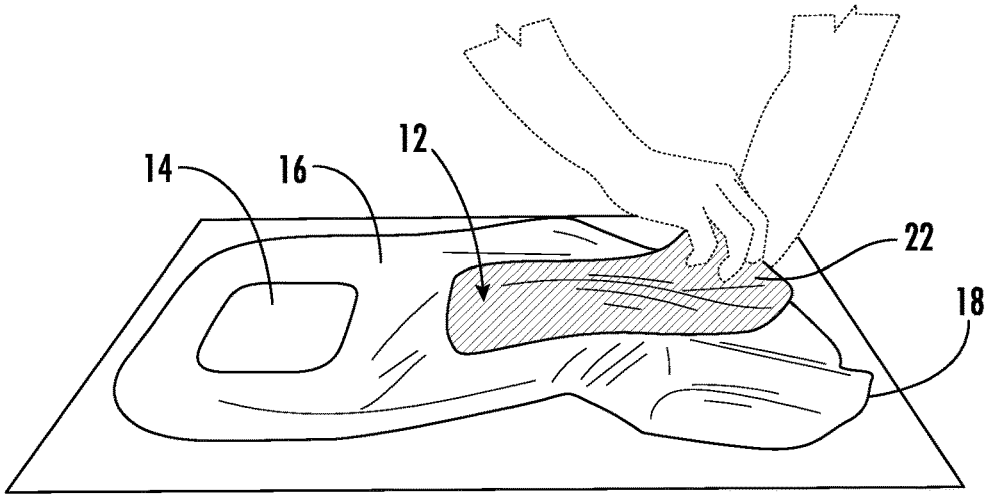
FIG. 9C is a front perspective view of the user inserting the diaper completely into the bottom end pocket of the diaper changing mat between the top buttocks absorbent layer and the plastic film layer immediately below, which for the first pocket.
Figure 9D:
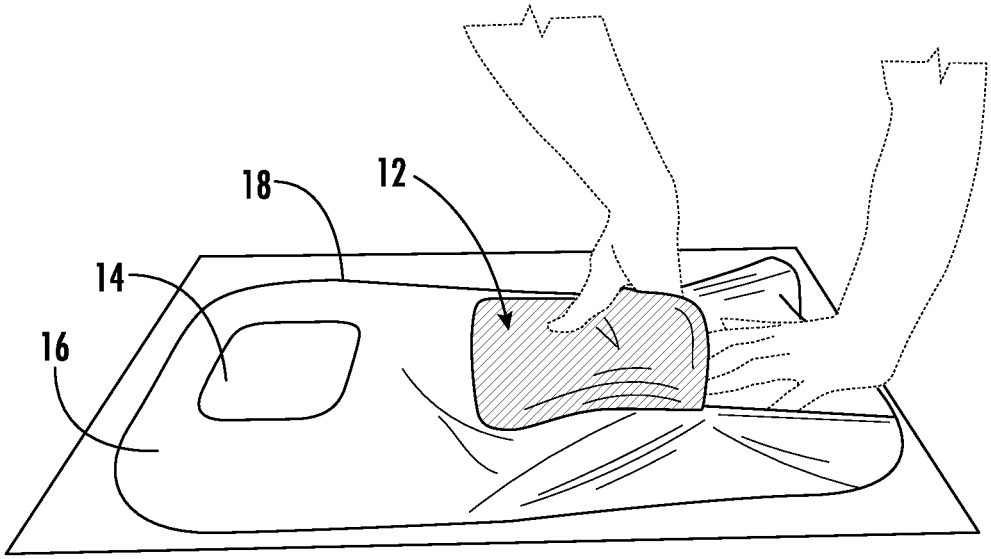
FIG. 9D is a front perspective view of the user reaching in and grabbing the diaper from a second pocket defined by a second plastic film below the first plastic film and the base plastic film.
Figure 9E:
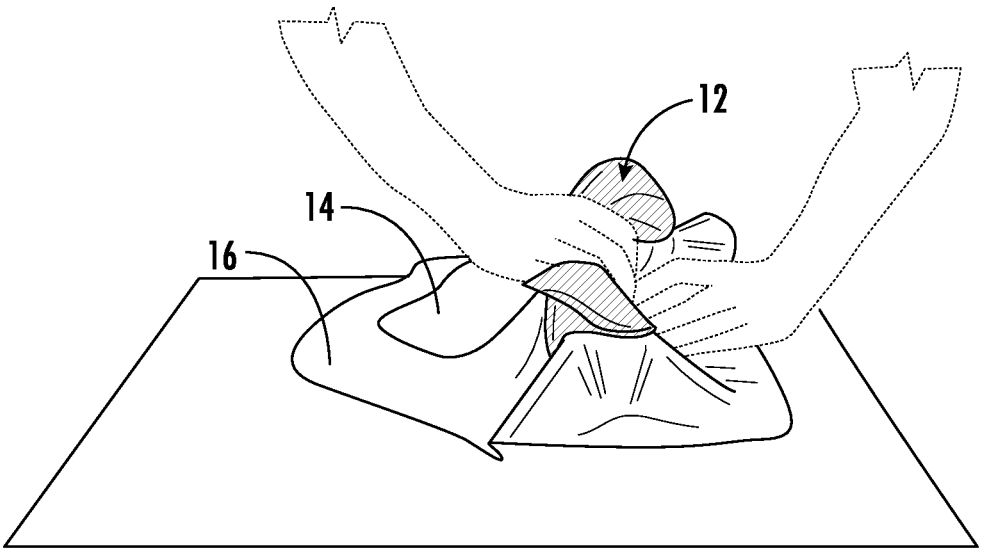
FIG. 9E is a front perspective view of a further stage in the initial inversion process where the user is grabbing the diaper using the second pocket and inverting the diaper changing mat inside out.
Figure 9F:
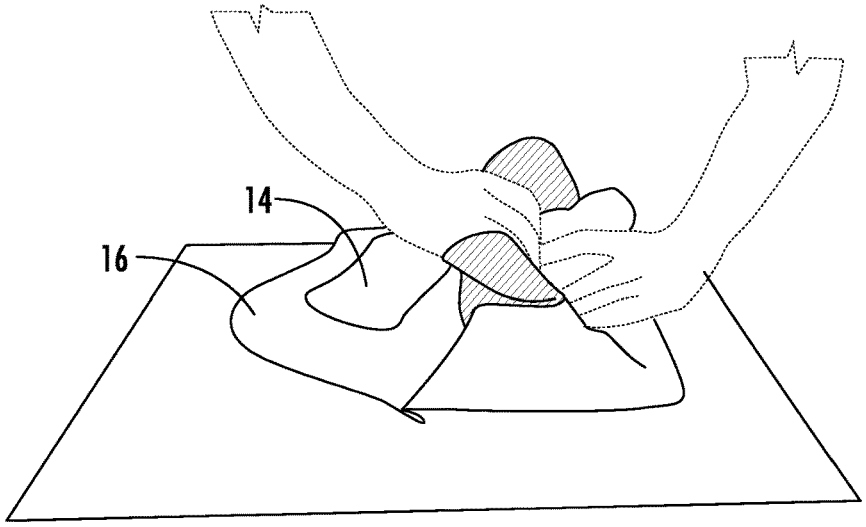
FIG. 9F is a front perspective view of a further stage of the initial inversion process shown in FIG. 9E.
Figure 9G:
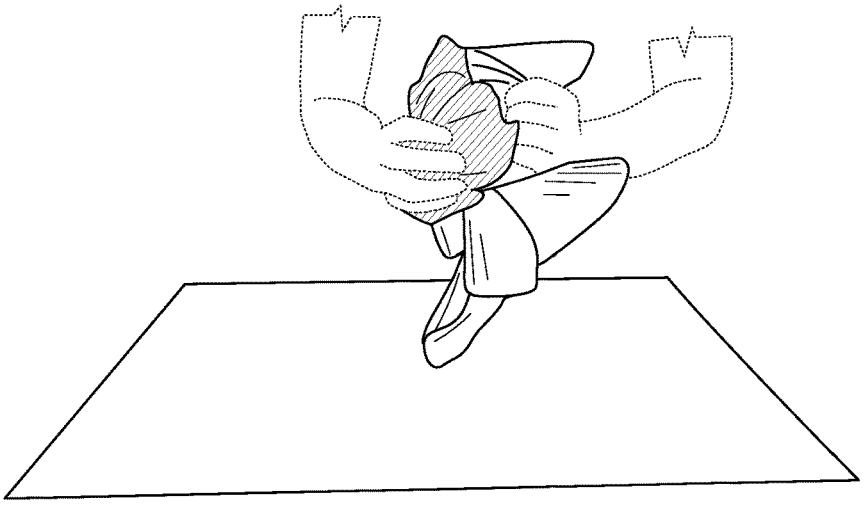
FIG. 9G is a front perspective view of a user further inverting the diaper within the mat beyond the stage shown in FIG. 9F.
Figure 9H:
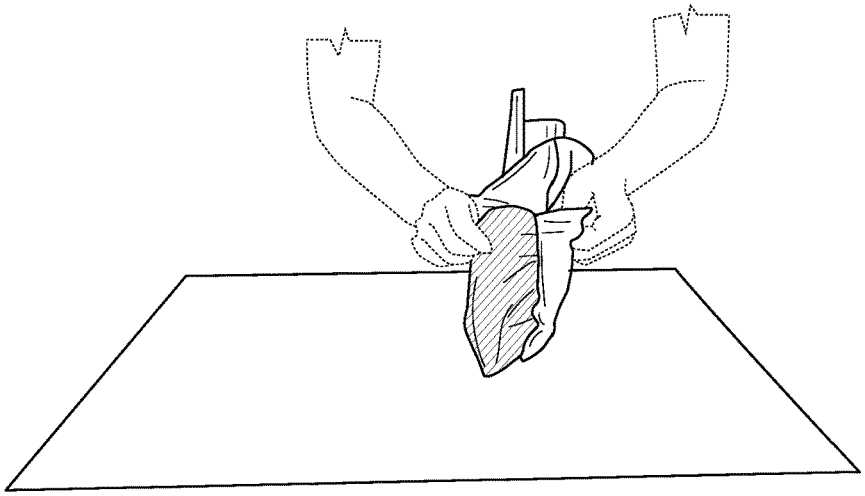
FIG. 9H is a front perspective view showing the user further along in the inversion process than the stage shown in FIG. 9G and tucking the last portion of the mat into the revealed pocket.
Figure 9I:
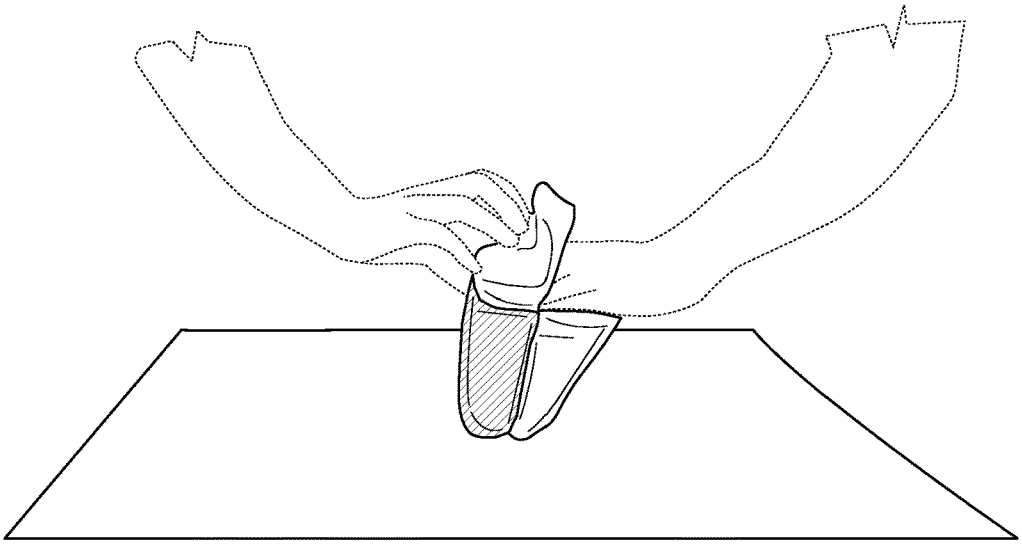
FIG. 9I is a front perspective view showing a stage where the user is tucking the excess from the diaper mat into the second pocket.
Figure 9J:
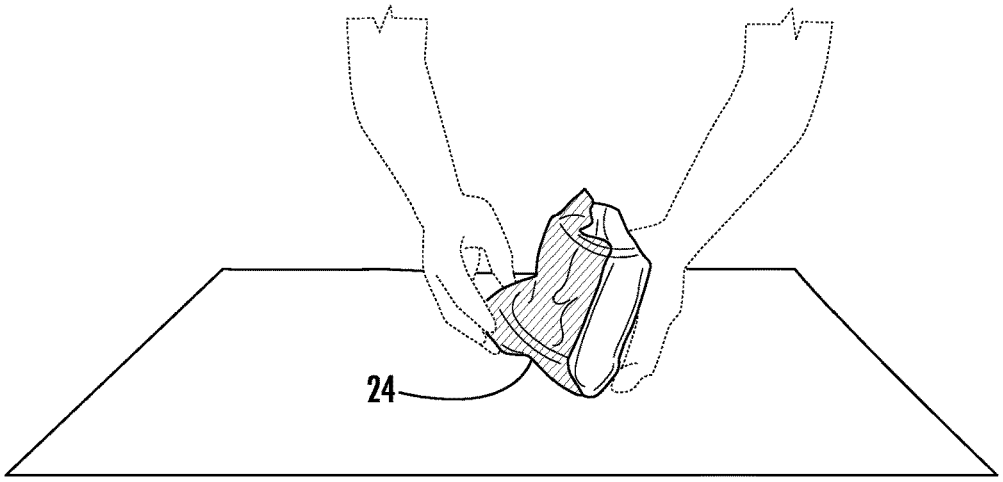
FIG. 9J is a front perspective view showing the user identifying the revealed pocket on the left side, which was revealed after the initial inversion of the mat enrobing the diaper.
Figure 9K:
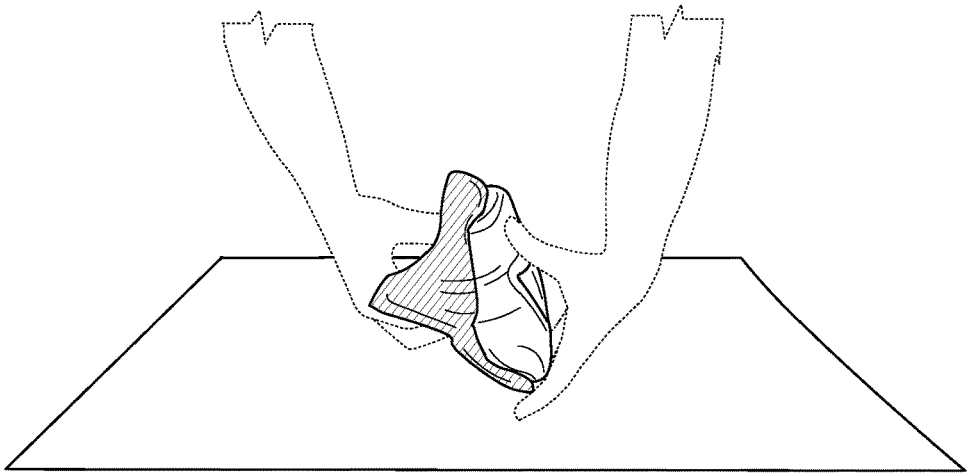
FIG. 9K is a front perspective view of the beginning of a second inversion of the mat where the user inverts the diaper into the interior of the revealed pocket by pulling the pocket on the left side upward and pushing the center section downward with the user's thumb or other portion of the user's hand.
Figure 9L:
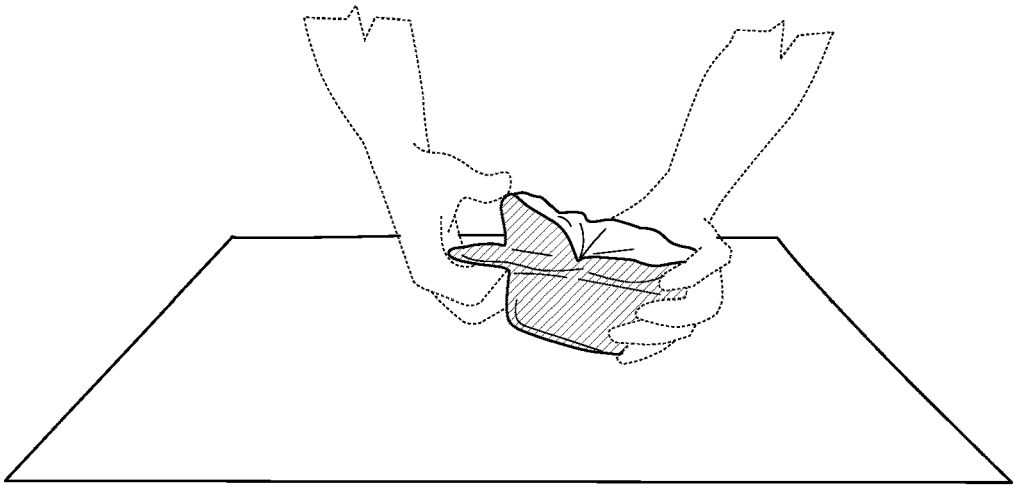
FIG. 9L is a front perspective view of a middle stage of the second inversion in the process of enrobing a diaper within the diaper changing mat according to this aspect of the present disclosure.
Figure 9M:
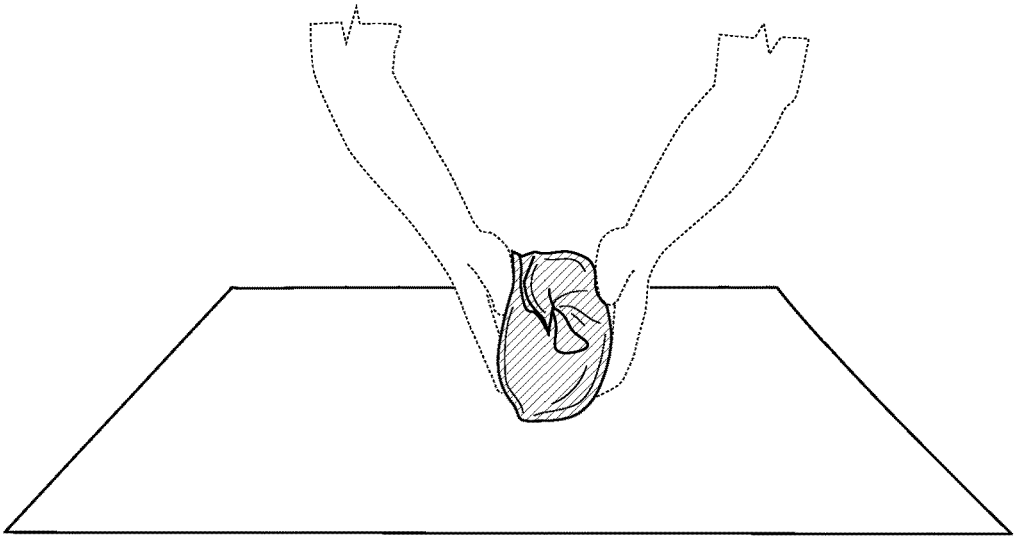
FIG. 9M is a front perspective view of the dual inverted diaper in the finished form.
Figure 10:
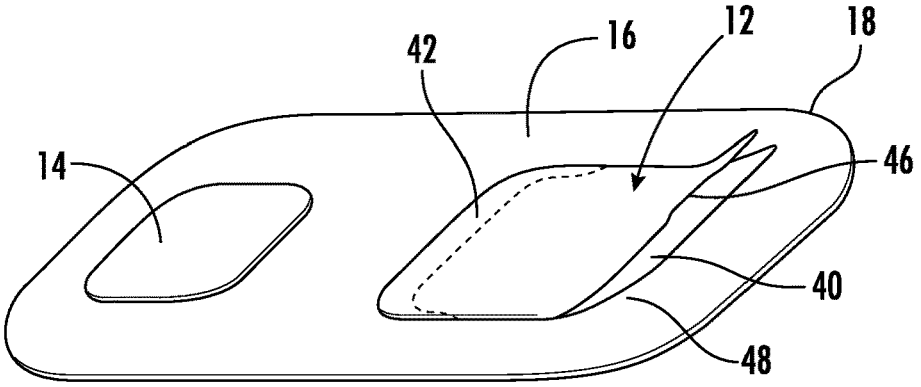
FIG. 10 is an isometric view of the pockets' locations of the diaper changing mat shown in FIG. 8—DESIGN E.

The intermediate plastic film 30 is bonded to the intermediate plastic film 28 in a u-shape bonding line 38 at the bottom end 39. At the top end 41 in FIG. 8B, there's a longer u-shape bonding line 38 that bonds the buttocks absorbent layer 26, the intermediate plastic film 30, and the intermediate plastic film 28. Since the intermediate plastic film 28 is shorter in length, its top end cannot reach the longer u-shape bonding line 38 to create a seal. Therefore, it creates an opening at the top end of the intermediate plastic file 28 that is in between the intermediate plastic film 30 and the base plastic film layer 16.

As shown in FIGS. 9A-M and 10, there is an open bottom pocket 40 between the buttocks absorbent layer and the first plastic film to insert the messy diaper. There's also a second open bottom pocket 48 at which the user can reach in and turn the pocket inside out. Both of the described pockets have the openings at the bottom end, and the notch 46 of the buttocks absorbent layer is the indication to visually separate these two pockets. After being turned inside out, the open top pocket opening 42 (the actual pocket is in between intermediate plastic film 30 and the intermediate plastic film 28, see FIG. 8B for exploded view) at the top end of the second plastic film would be accessible on the outside to which the user can reach in and turn the pocket inside out for a second time.

The diaper would be completely contained after being turned inside out for the second time in which the diaper changing mat would now appear as a containment bag; half of the bag would have three-layers barrier (buttocks absorbent layer 26, plastic film 28, and base plastic film layer 16) to contain the diaper 20 while the other half is a one-layer barrier (plastic film 30). For the half that has only one layer barrier, that layer can be made with thicker material for smell or durability protection similarly to the other half that has the three-layers barrier.

When inserting the dirty diaper into the first bottom pocket 40 (FIG. 10), the user may have to lift up buttocks absorbent layer that could be contaminated with messes from the baby. For this rare occasion, it would not be sanitary for the user to touch the buttocks absorbent layer. This problem can be solved by bonding another waterproof plastic film to the buttocks absorbent layer that is directly underneath and also to exact shape and size or at least approximately the exact same size of the buttocks absorbent layer. As a result, the user would be touching the clean plastic layer when lifting up to insert the dirty diaper into the first bottom pocket 32. This would make the diaper changing mat's overall design have a five-layers design instead of four as described previously for DESIGN E.

DESIGN F (4 Layers)

The size of the buttocks pad can be adjusted by changing the dimensions of the width and length of the pad. Not only is this used for adjusting the surface area of the buttocks pad but also the volume of the pocket when the diaper changing mat is being turned inside out. In that case, increasing or decreasing surface area is in direct correlation with the volume of the buttocks pad being increased or decreased. As an alternative way to adjust sizing that will be discussed in the following, DESIGN F implements a fold of extra material to the buttocks pad to increase the volume of the pocket while maintaining the same surface area of the buttocks pad.

Figure 11:
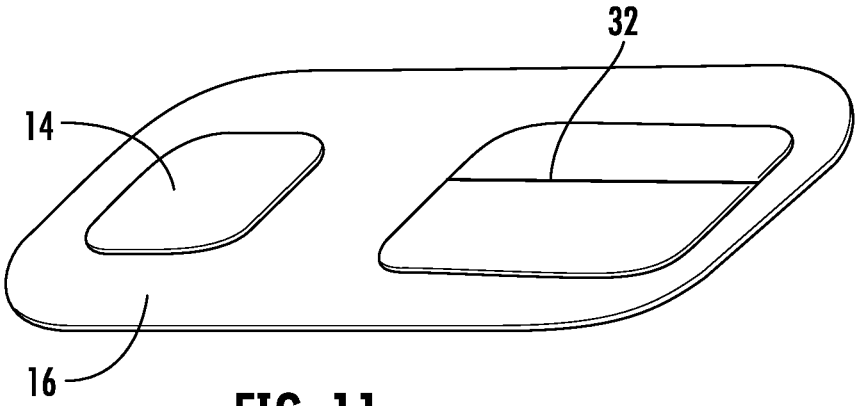
FIG. 11 is an isometric view of the overall shape and size of a diaper changing mat according to another aspect of the present disclosure—DESIGN F.
Figure 12:
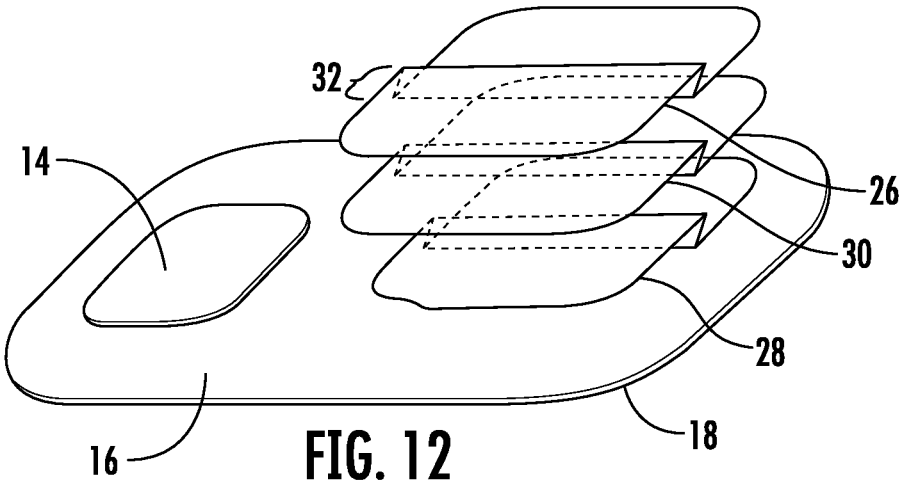
FIG. 12 is an exploded view showing details of the pleat folds of DEISGN F.
Figure 13A:
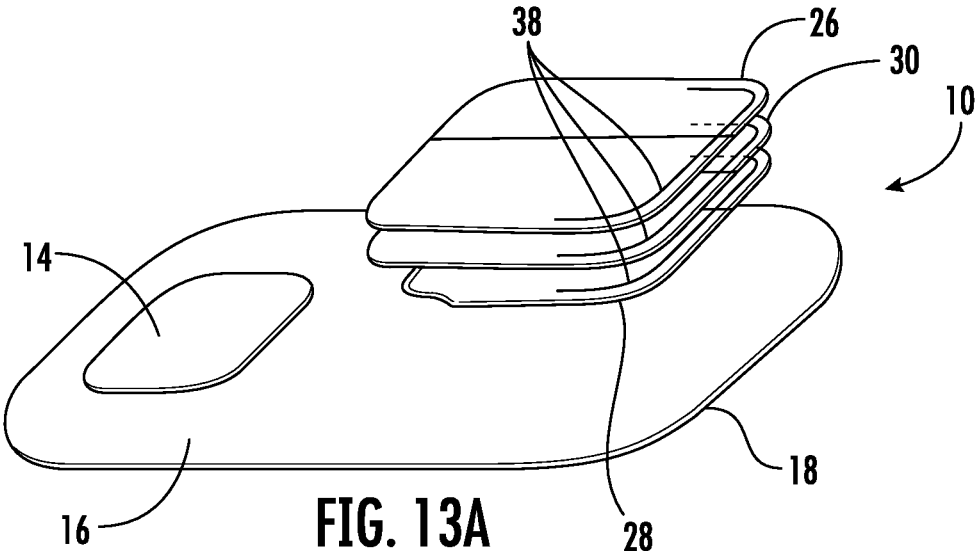
FIG. 13A is an exploded view of the design of FIG. 11 illustrating a possible bonding line between the buttocks absorbent layer, first plastic film, and a second plastic film.

As shown in FIG. 11, the appearance of a complete product is the same as DESIGN B except for the folding line along the length of the buttocks pad from the top to the bottom. In an exploded view (FIG. 12), the folding lines reveal pleat folds 32 for the buttocks absorbent layer 26, first intermediate plastic film 30, and second intermediate plastic film 28. All three layers are bonded by a short u-shape bonding line 38 at the bottom end as shown in FIG. 13A. The pleat fold is then created after all three layers are bonded. A single pleat or a multiplicity of pleats, which are typically parallel or at least substantially parallel with one another, can be incorporated into the design. The advantage of a multiplicity of pleats is that the pleats create Z-dimensional barriers (barriers that protrude from the plane of the absorbent) that slow the rate of urine runoff so that urine can we wicked into and absorbed by the absorbent rather than run off the absorbent before it can be absorbed. Slowing down the rate of urine runoff with pleats can be done by adding pleats to the entire multilayer structure of the buttocks pad, or it can be done to only the nonwoven layer that sits over the absorbent, or it can be done to any combination of layers in the buttocks pad because the object is simply to create Z-dimension barriers that slow the rate of urine runoff. This concept can be incorporated into all of the different designs described herein. All three layers are then bonded to the base plastic film layer 16 by a long u-shape bonding line 38 at the top end (see FIG. 13B). Since the intermediate plastic film 28 is shorter in length, its top end cannot reach the long u-shape bonding line 38 to create a seal. Therefore, it creates an opening at the top end of the intermediate plastic film 28 that is in between the intermediate film 30 and the base plastic film layer 16.

Figure 14:
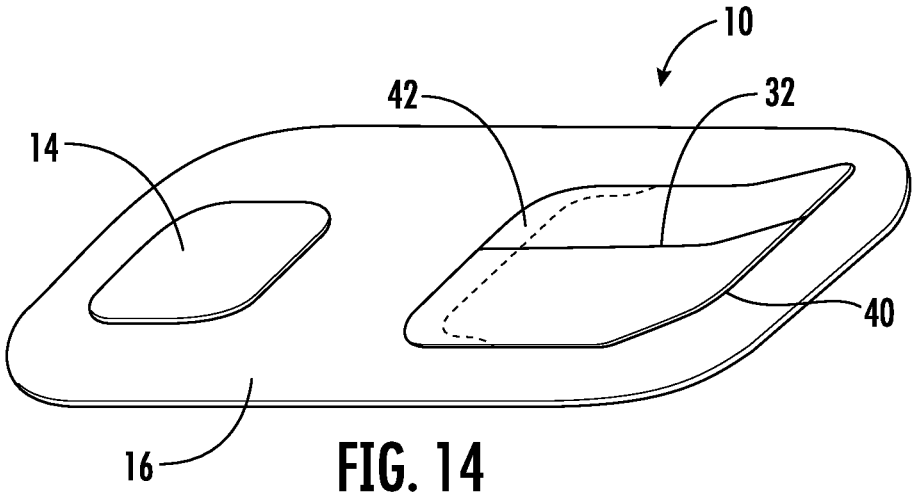
FIG. 14 illustrates the location of pockets in the design of FIG. 11.
Figure 15A:
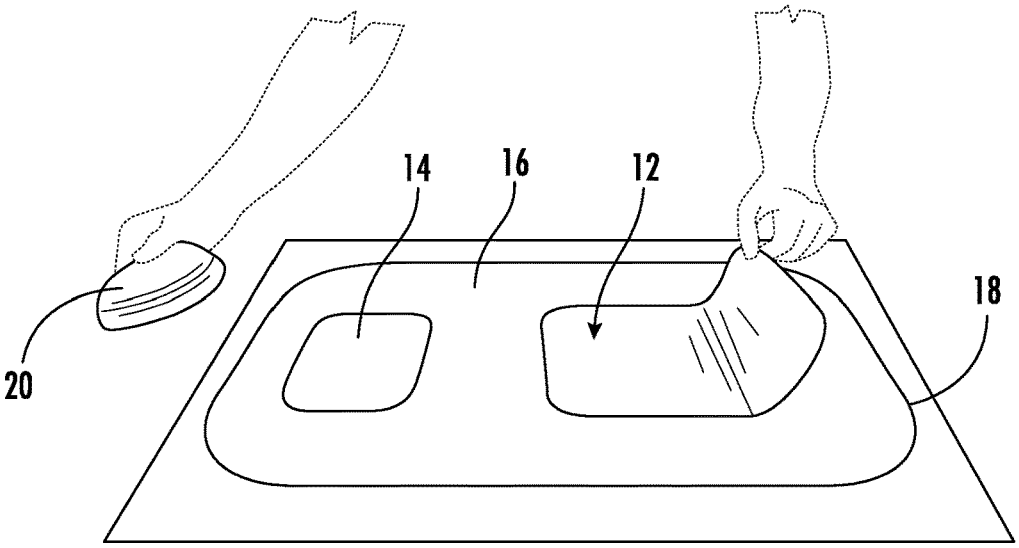
FIG. 15A is a front perspective view showing a diaper changing mat according to another aspect of the present disclosure where the infant buttocks pad is removable—DESIGN G.
Figure 15B:
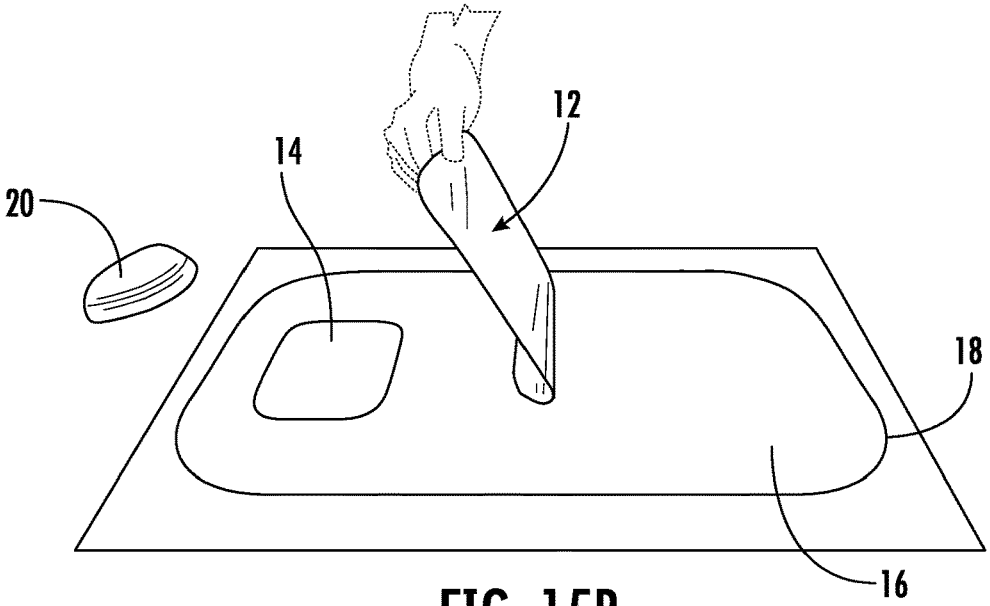
FIG. 15B is a front perspective view of the user removing the multilayer buttocks pad portion of the diaper changing mat shown in FIG. 15A.
Figure 15C:
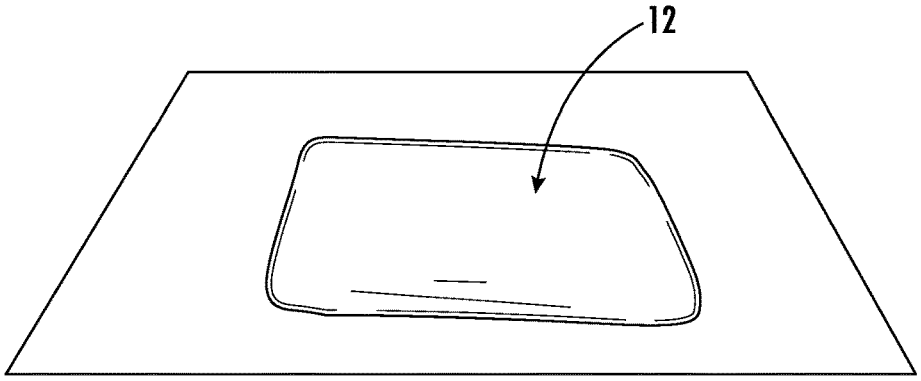
FIG. 15C is a front perspective view of the buttocks pad removed from engagement with the overall diaper changing mat shown in FIG. 15A.
Figure 15D:
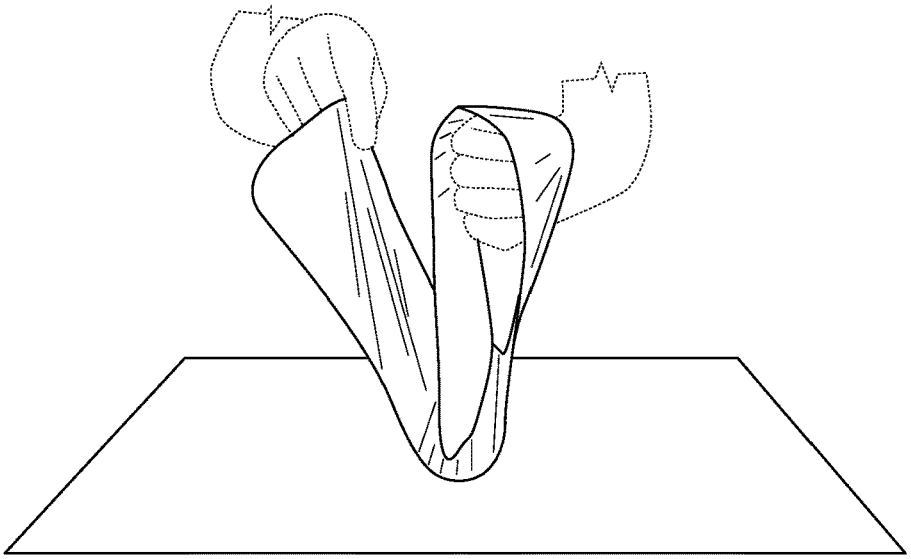
FIG. 15D is a front perspective view depicting the layers of the buttocks pad before the layers are formed, where the buttocks pad includes an absorbent layer and three additional plastic film layers and wherein the three plastic film layers may be used to create the buttocks pad.
Figure 15E:
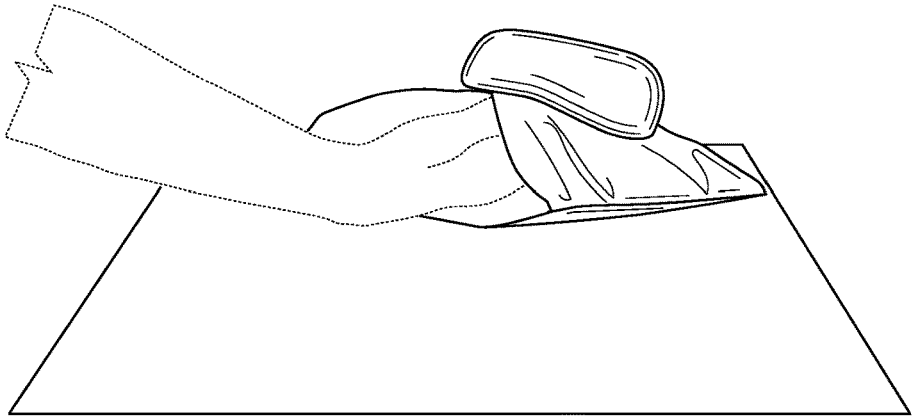
FIG. 15E is a front perspective view showing the user reaching within a first pocket of the buttocks absorbent pad and grasping a dirty diaper on the top absorbent surface of the buttocks absorbent pad.
Figure 15F:
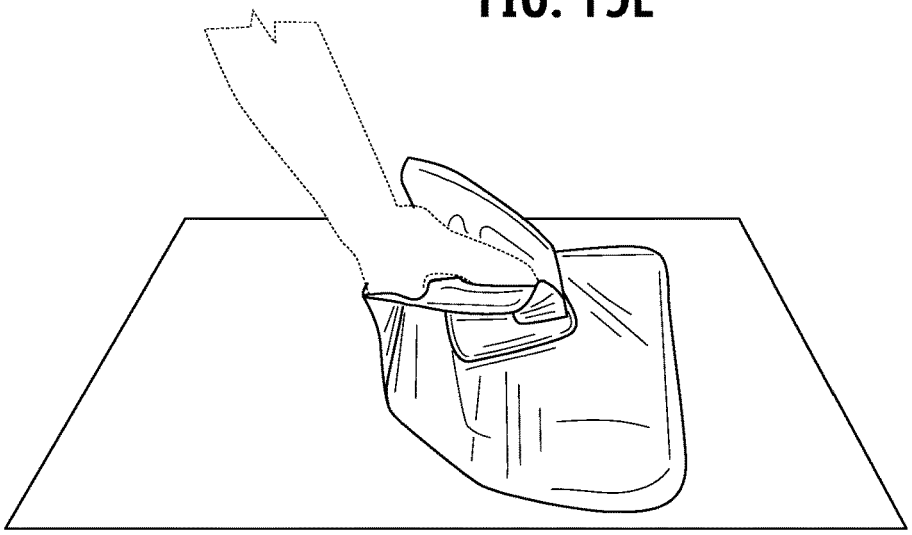
FIG. 15F is a front perspective view showing a user with part of the hand within a pocket between a first layer and a second layer of plastic film and the other part of the hand grasping the exterior of the diaper while that portion of the hand is shielded from touching the diaper with a portion of a first plastic film.
Figure 15G:
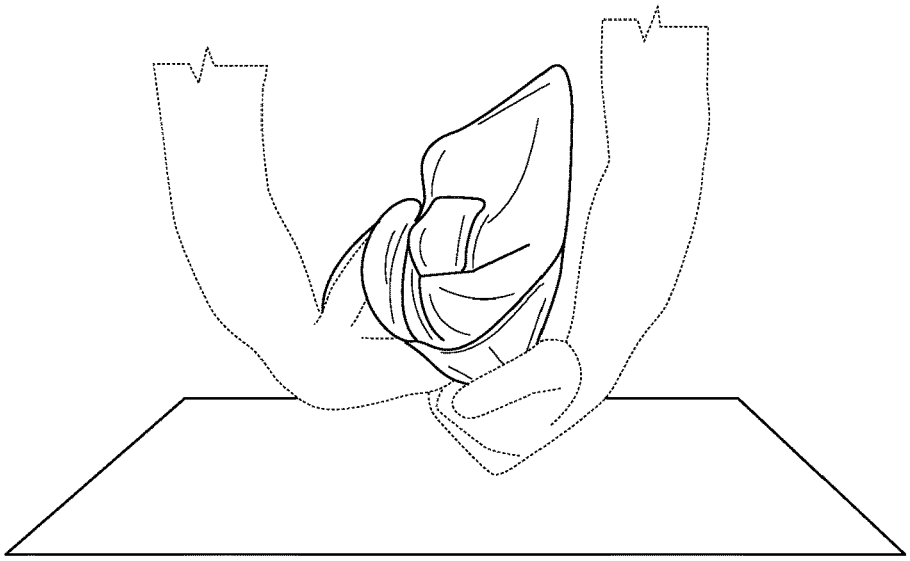
FIGS. 15G-I are perspective views showing the user in various stages of inverting the diaper into an interior portion of the buttocks pad.
Figure 15H:
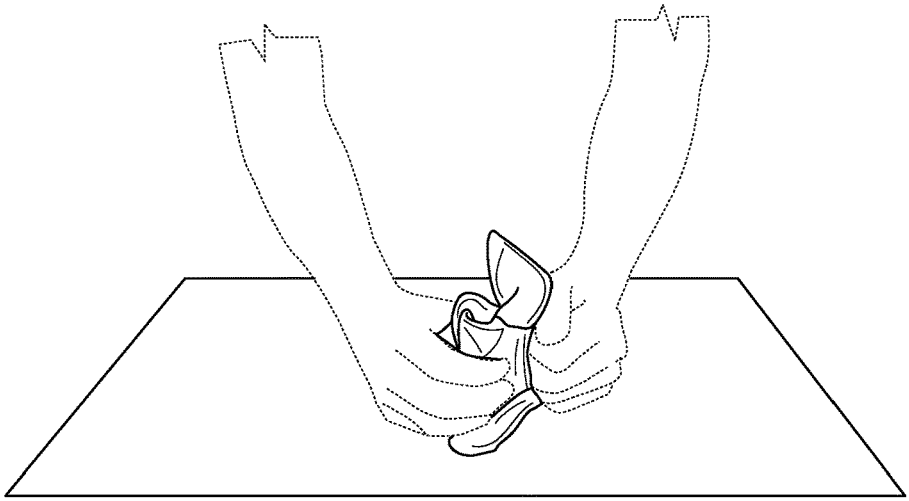
Figure 15I:
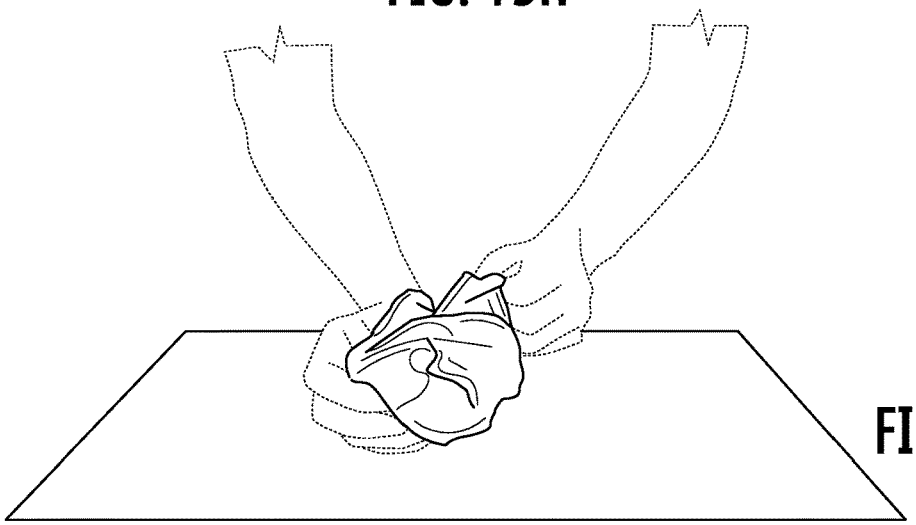
Figure 15J:
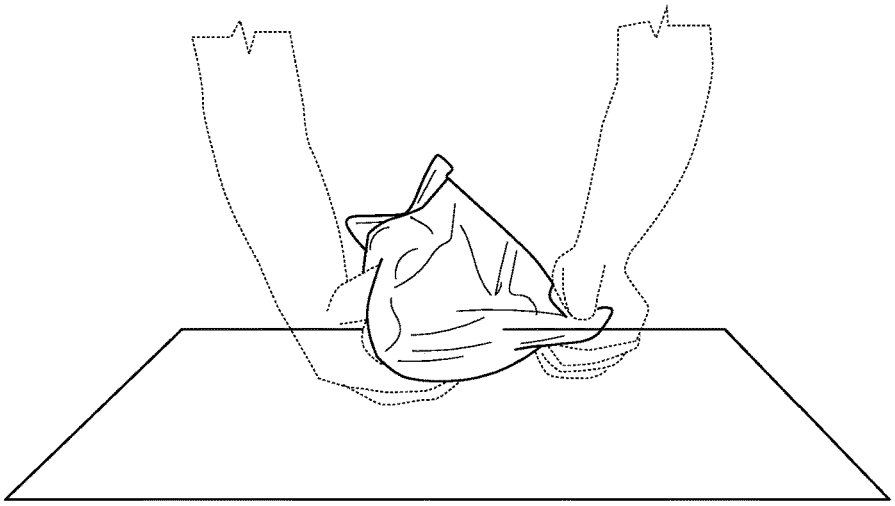
FIGS. 15J-L are a perspective view showing the user inverting the overall buttocks pad a second time into another pocket on the side after the first inversion to enrobe the diaper a second time in the second layer of plastic film such that the third layer of plastic film and the second layer of plastic film are exterior facing layers of plastic and none of the diaper is exposed as shown in FIG. 15L.
Figure 15K:
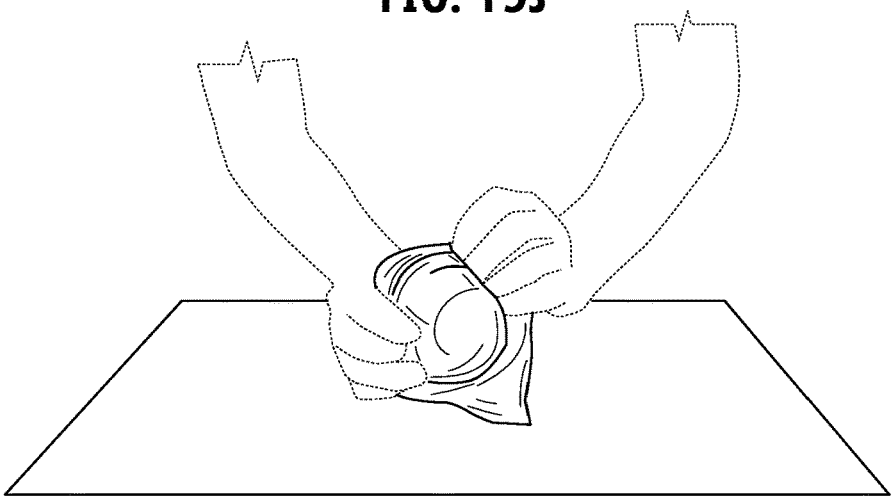
Figure 15L:
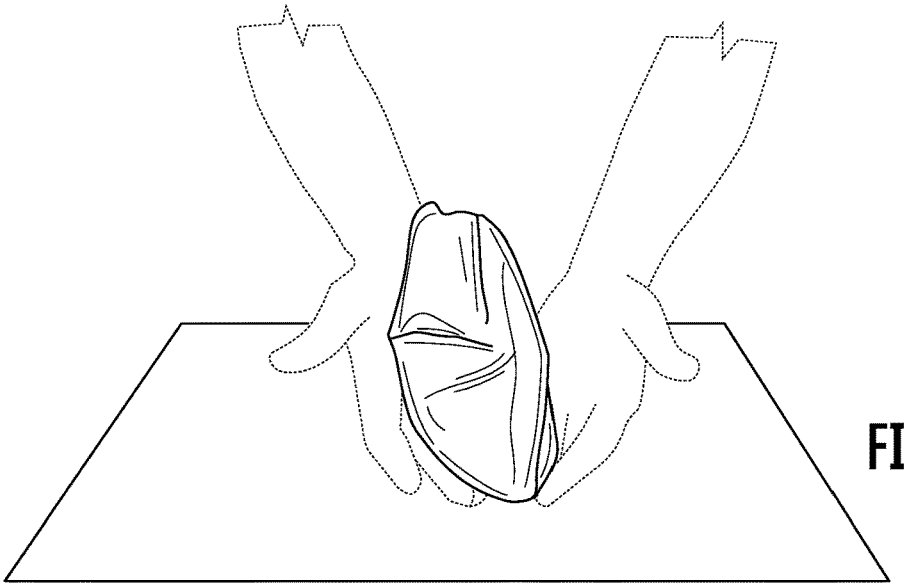
Figure 16A:
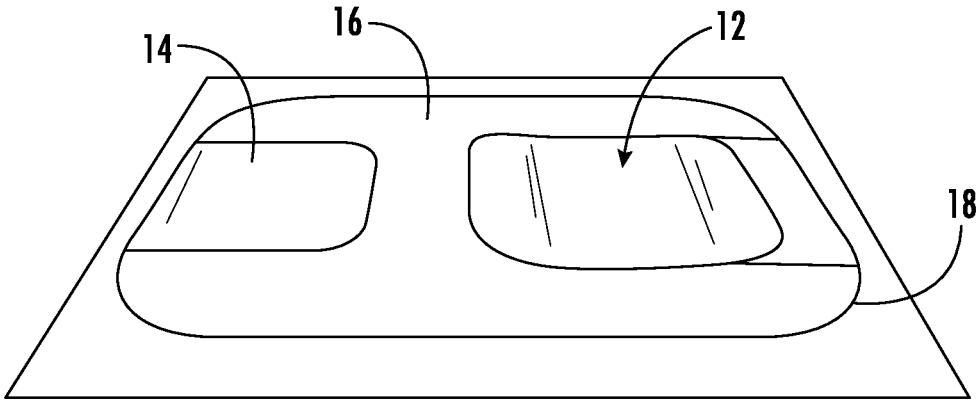
FIG. 16A is a front perspective view showing a diaper mat according to another aspect of the present disclosure—DESIGN H—where the diaper changing mat includes first, second and base layers of plastic material formed from a single plastic film folded over to create three layers and a head pad also folded from the same plastic film to form the head pad after it is at least partially or wholly heat sealed to the main diaper mat portion around its perimeter or perimeter portion substantially adjacent the perimeter of the head pad portion.
Figure 16B:
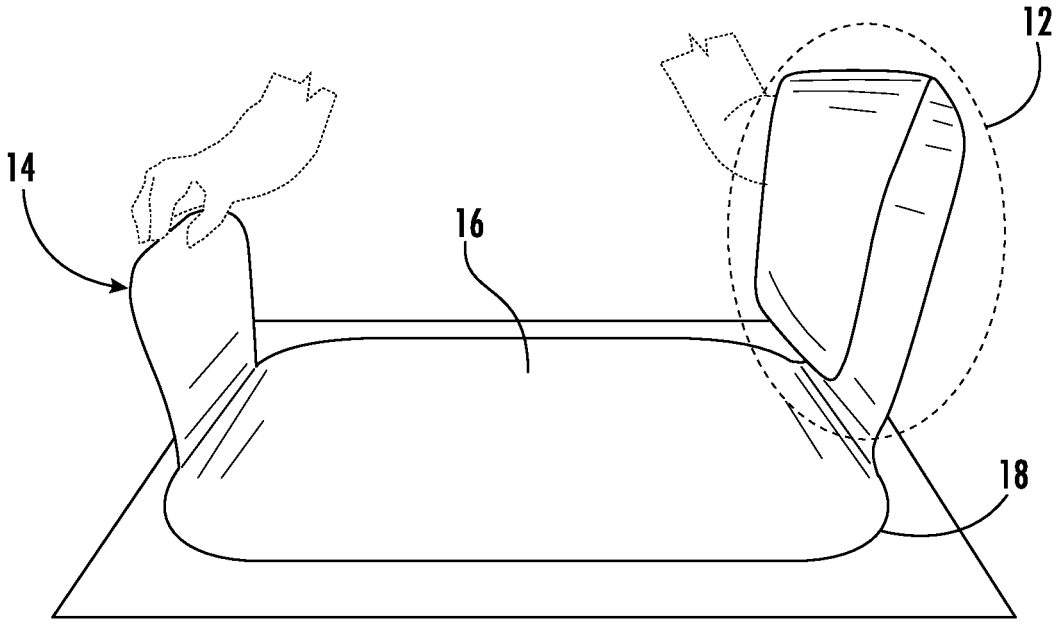
FIG. 16B is a front perspective view showing the multilayers of plastic film formed from a single plastic sheet prior to being heat sealed to form the diaper changing mat according to another aspect of the present disclosure.
Figure 16C:
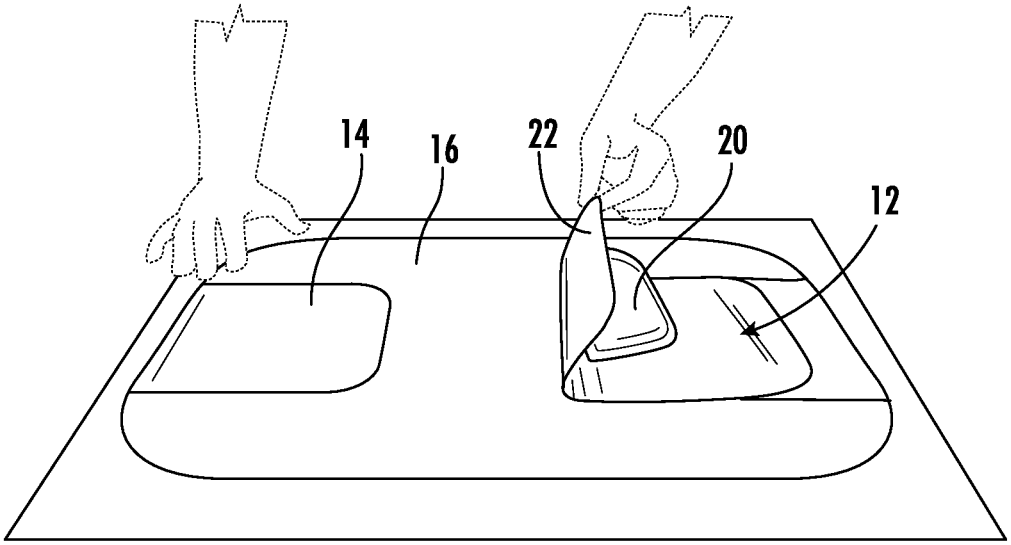
FIGS. 16C-D is a front perspective view showing the user initially (FIG. 16C) taking a top portion of the buttocks mat and folding it over the diaper, grasping the diaper and the folded top portion prior to an initial inversion of the diaper and mat, which is shown completed in FIG. 16I.
Figure 16D:
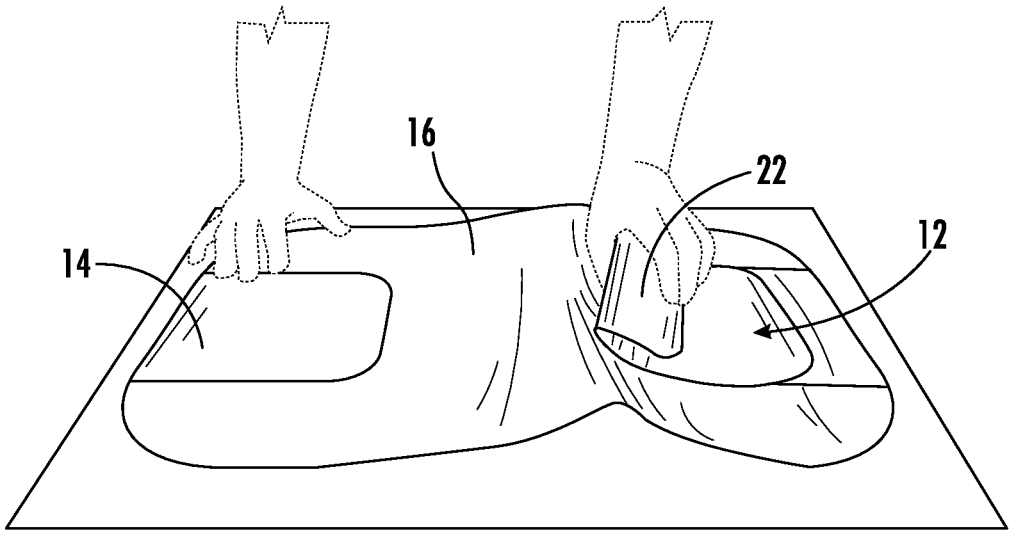
Figure 16E:
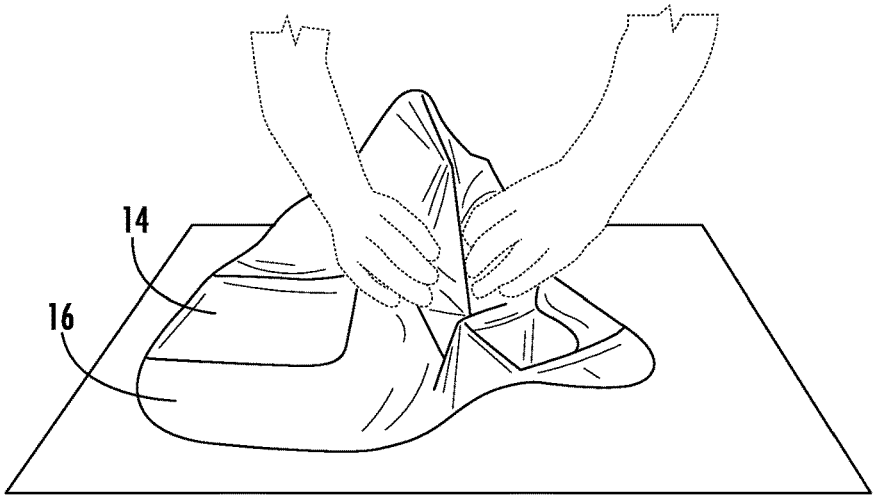
FIGS. 16E-I are front perspective view of the consecutive stages of the diaper mat being initially inverted to fold it over the diaper.
Figure 16F:
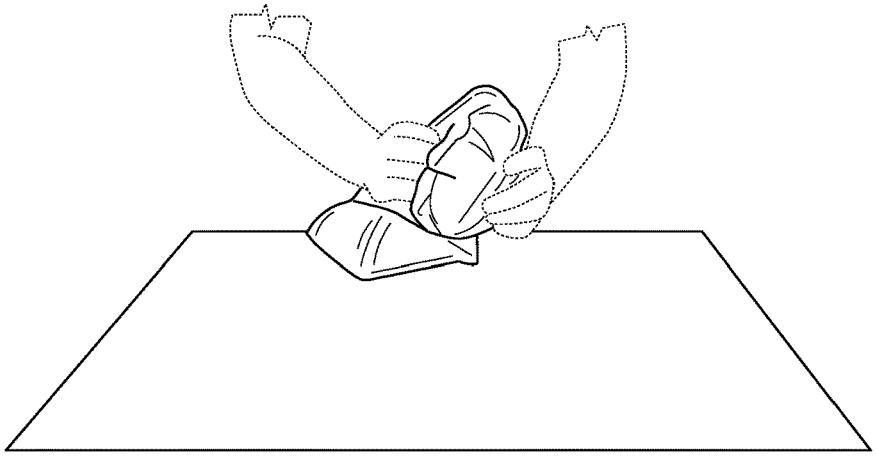
Figure 16G:
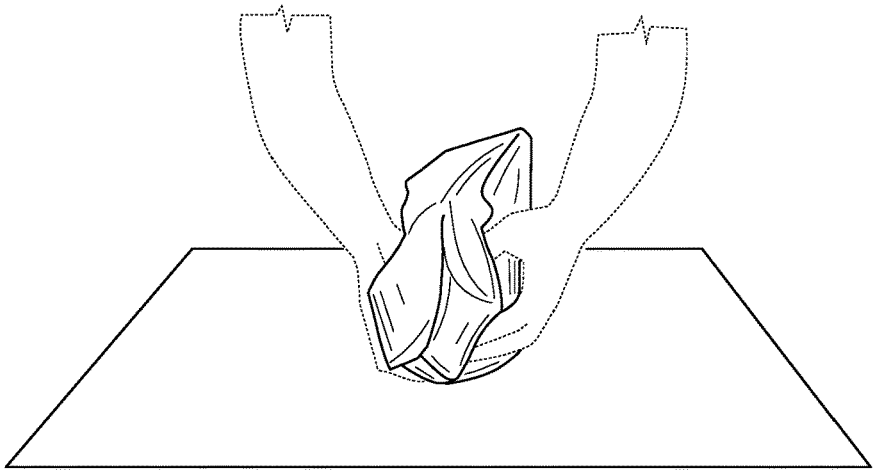
Figure 16H:
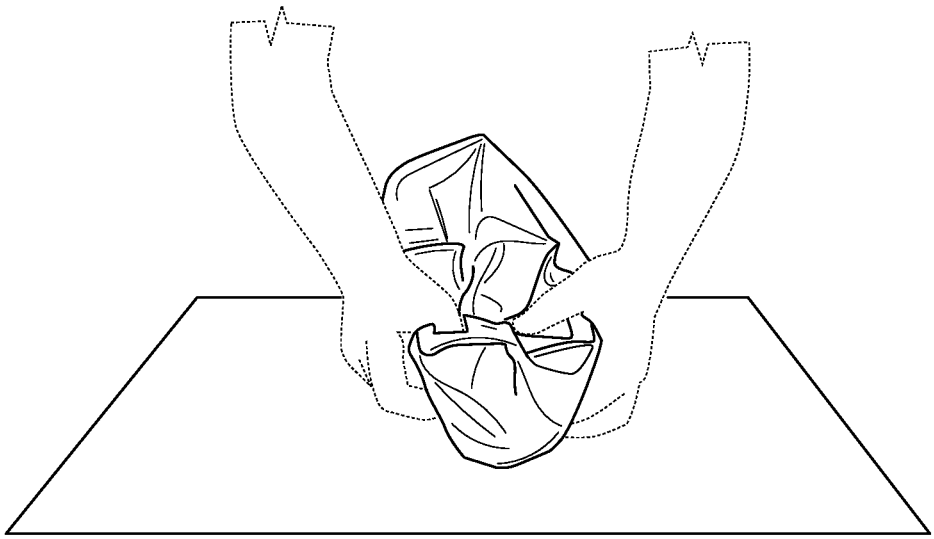
Figure 16I:
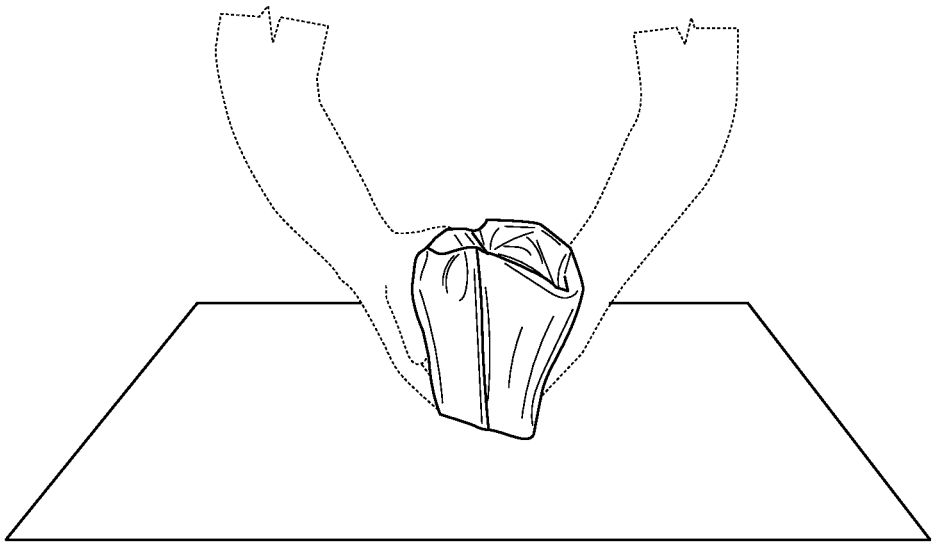
Figure 16J:
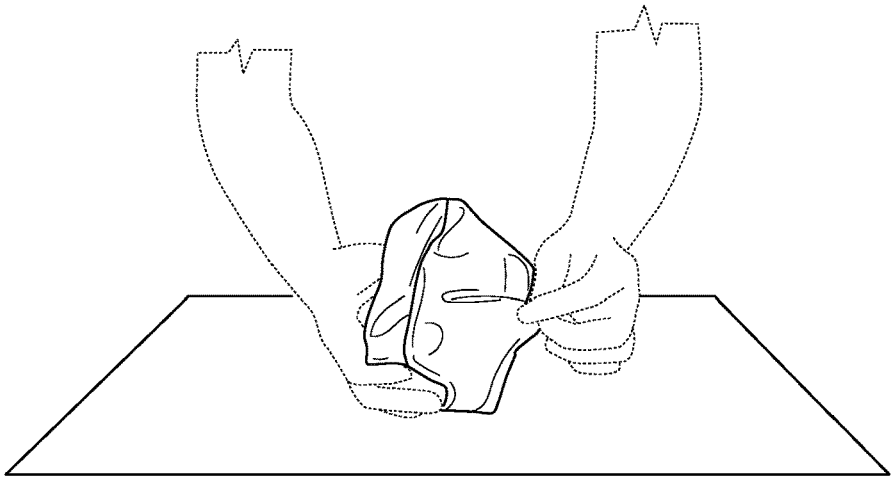
FIG. 16J is a front perspective view of the beginning of identifying a second flap on the right hand side of the initially inverted mat and grasping the flap to reveal the second pocket used to invert the mat into during the second inversion.
Figure 16K:
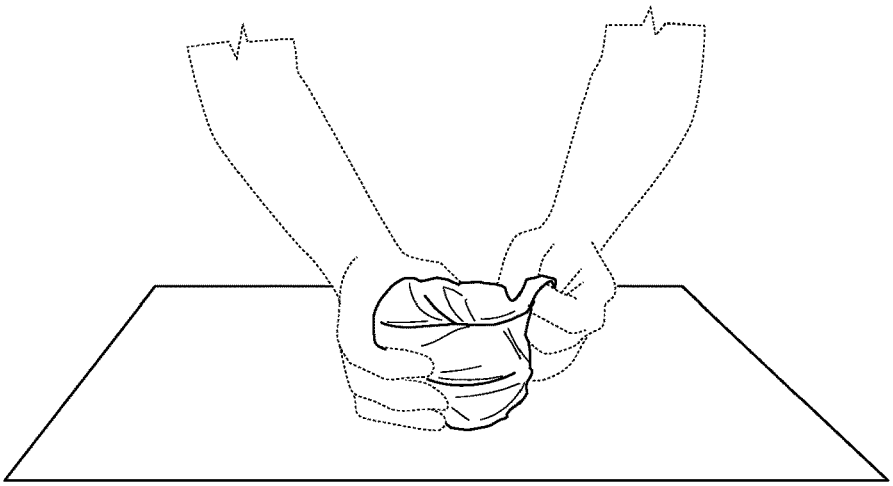
FIG. 16K-L show the user undertaking a second inversion where the second layer of plastic film and the first layer of plastic film form the outside of the enrobed diaper when the second inversion is completed after inverting the mat and diaper into the second pocket (FIG. 16L).
Figure 16L:
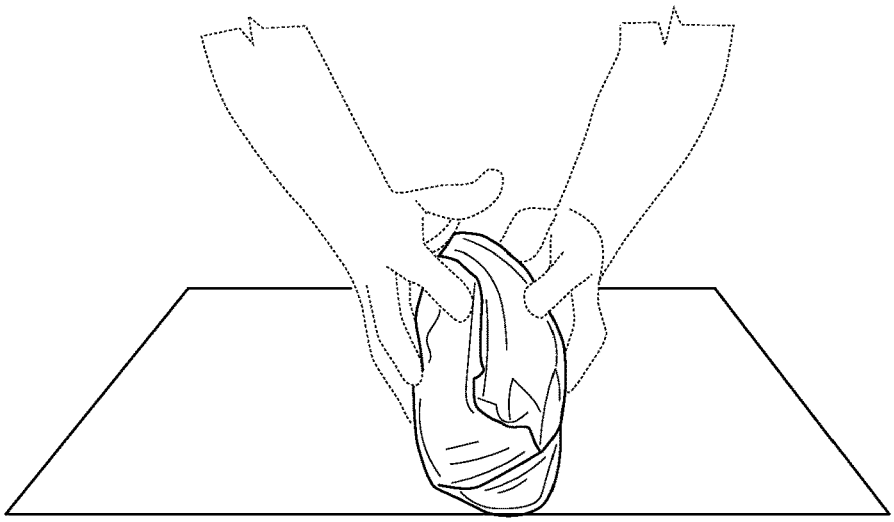

With this bonding configuration, the pockets' locations are the same as DESIGN B. There is an open bottom pocket 40 (see FIG. 14) at which the user can reach in and turn the pocket inside out. After being turned inside out, the top pocket opening 42 (the actual pocket is in between the first plastic intermediate film 30 and the second plastic intermediate film 28, see FIG. 12 for exploded view) at the top end of the second plastic film would be accessible on the outside to which the user can reach in and turn the pocket inside out for a second time.

Figure 18:
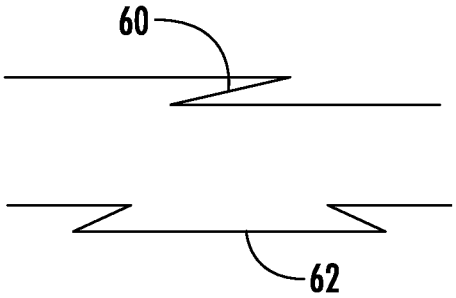
FIG. 18 illustrates different types of folds.

The pleat fold described for DESIGN F allows the buttocks pad to unfold and expand to a desirable size when turning the pocket inside out. As previously discussed herein, it was stated that the nominal width of a normal buttocks pad can be up to 15 in. With a pleat fold width of four inches, the buttocks pad's overall width would be 11 inches to have a similar pocket volume to that of a normal buttocks pad with 15 inches width without the pleat fold. With the pleat fold as an alternative design to the buttocks pad, it creates another variable (pleat fold width) of which the overall size of the diaper changing mat can be adjusted. The type of fold of one or multiple folds within one buttocks pad that would work for this design includes pleat or Z fold 60 and C fold 51 (FIGS. 11-12 and 18). The fold 32 doesn't have to be applied to all three layers; buttocks absorbent layer, first intermediate plastic film, and second intermediate plastic film. It can also work when a fold is applied to only one or two layers as needed. For instance, the buttocks pad is designed to be turned inside out twice where the second time can be more difficult as it has more material to be turned inside out. In that case, it would only be necessary to apply the fold to the second plastic film to make it expandable since it's the layer that is constricting the pocket when it's being turned inside out for the second time.

DESIGN G (4 Layers)

Figure 13B:
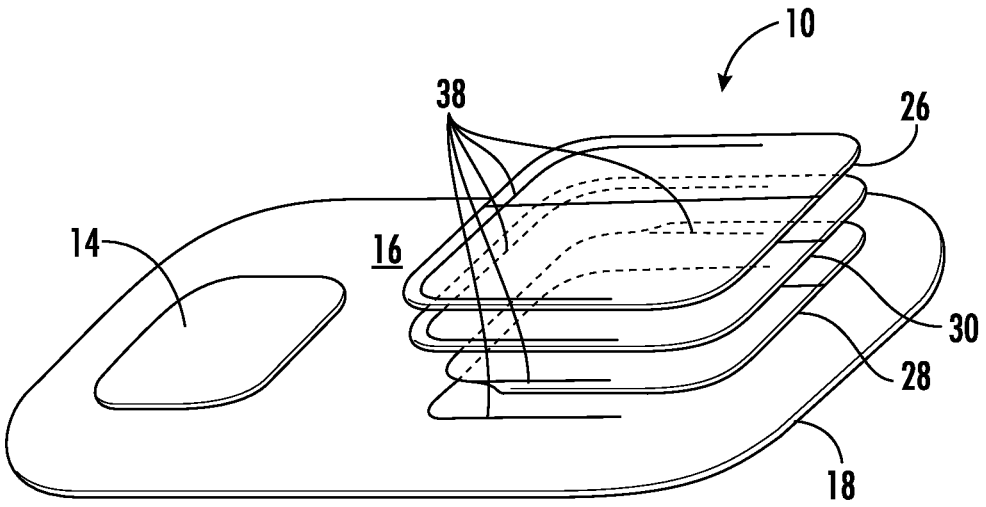
FIG. 13B is an exploded view of the design of FIG. 11 illustrating possible bonding lines between the buttocks absorbent layer, first plastic film, second plastic film, and base plastic film.
Figure 19A:
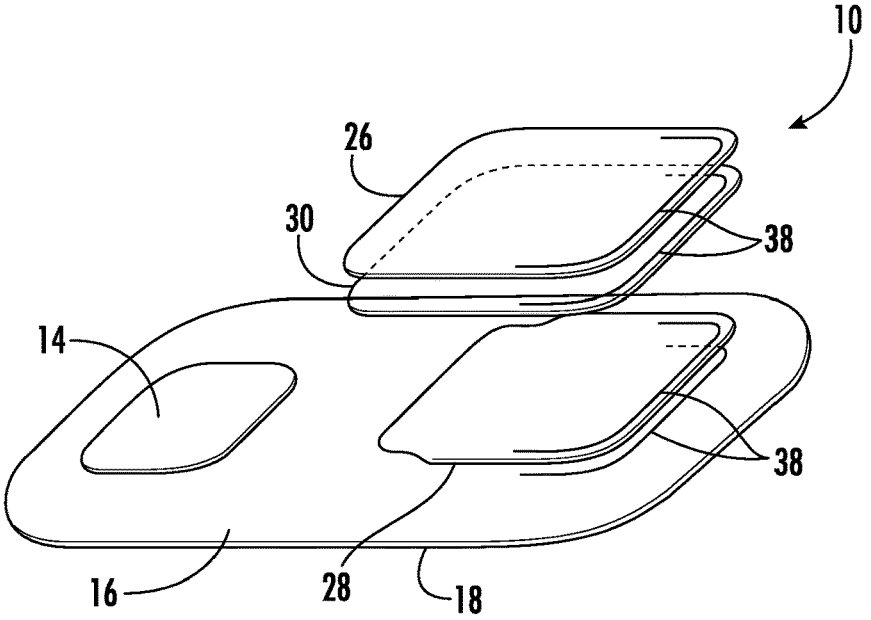
FIG. 19A is an exploded view illustrating an exemplary bonding line between the buttocks absorbent layer and first plastic film and a bonding line between the second plastic film and the base plastic film.
Figure 19B:
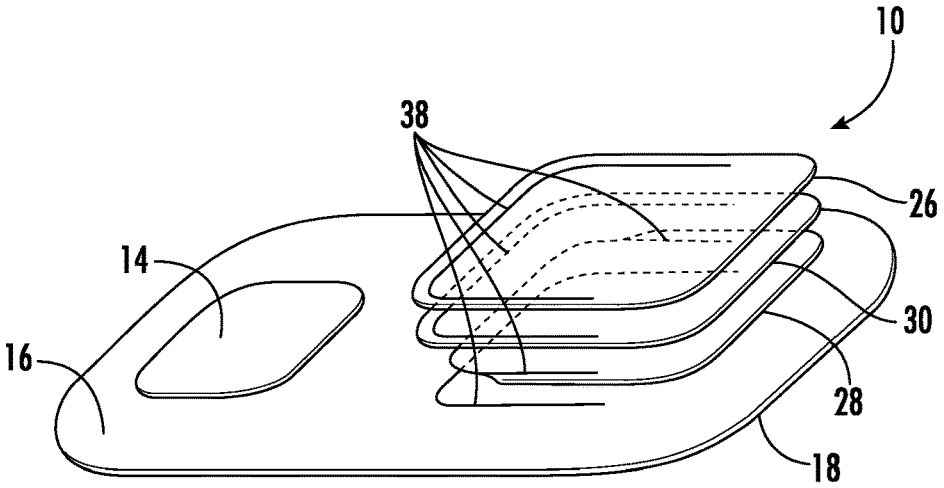
FIG. 19B is an exploded view illustrating bonding lines between the buttocks absorbent layer, first plastic film, second plastic film, and base plastic film.

For DESIGN B (standard DESIGN) and DESIGN F, the second plastic film 28 is bonded to the absorbent layer 26 and the first intermediate plastic film 30 by a short u-shape bonding line 38 (see FIG. 13A) before bonding all three to the base plastic film layer 16 by a long u-shape bonding line 38 (see FIG. 13B). This determines the locations of the first pocket (between second plastic film and base plastic film) and second pocket (between first and second plastic film) when turning the pockets inside out. For DESIGN G, the second plastic film 28 is bonded to the base plastic film layer 16 by a separate u-shape bonding line 38 before being bonded to the absorbent layer 26, first intermediate plastic film 30 (the absorbent layer and first plastic film is bonded together by another u-shape bonding line 38), and base plastic film layer 16 by a long u-shape bonding line 38 (see FIG. 19A, 19B). Since the second intermediate plastic film 28 is shorter in length, its top end cannot reach the long u-shape bonding line 38 to create a seal. Therefore, it creates an opening at the top end of the second plastic film 28 that is in between the first plastic film 30 and the base plastic film layer 16.

Figure 20:
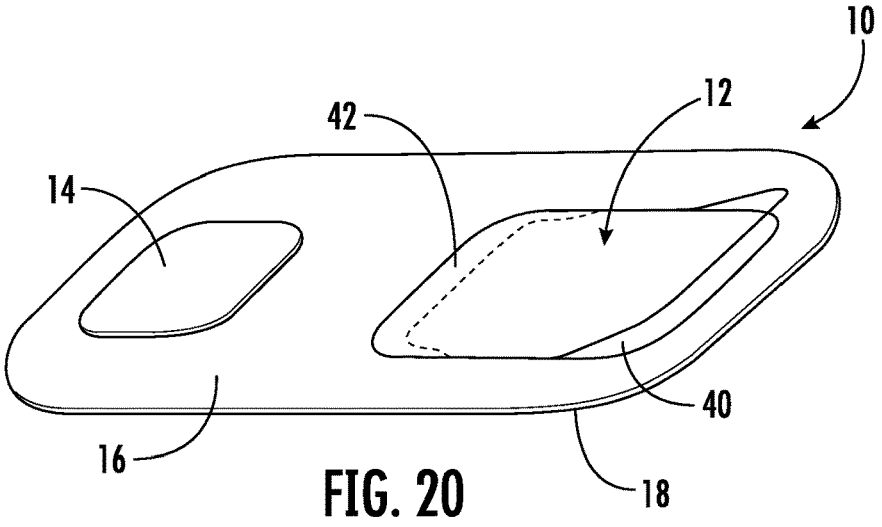
FIG. 20 Is an isometric view illustrating the pockets' locations in the design shown in FIGS. 19A-B.

The first pocket is now between the first and second plastic film with a bottom opening 40 (See FIG. 20), and the second pocket 42 is between the second plastic film and the base plastic film layer 16 with a top opening 42 (see FIG. 20). This design simply changes the locations of the pockets, which can be easier to operate in some cases.

Buttocks Pad Curl-Over Flap

Bonding lines configuration determines the location and functionality of the pockets that often includes a u-shape bonding line locate at the bottom side and long u-shape bonding line at the top side of the buttocks pad. Each bonding line is designed to seal two or more layers of material together. Although not always required, the ends of these bonding lines should be connected to make a complete seal around the pockets. Connections at bonding lines' end points also apply to bonding configuration that includes more than just bottom side and top side u-shape bonding lines.

Figure 21:
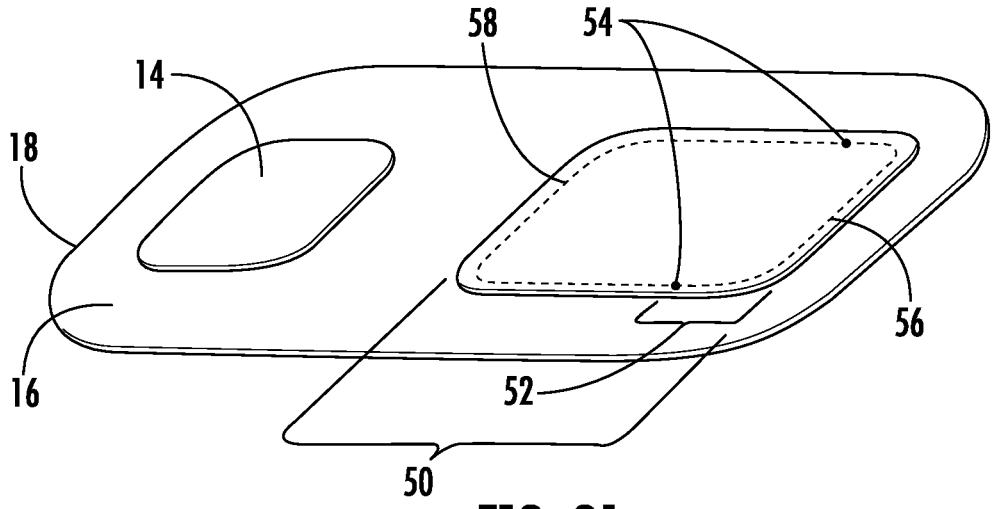
FIG. 21 is an isometric view illustrating how the bonding lines are being dimensioned.
Figure 22:
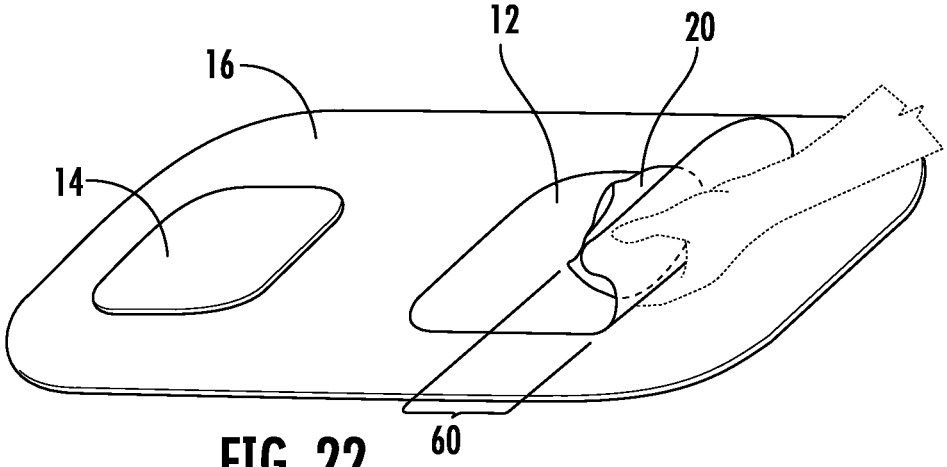
FIG. 22 is an isometric view illustrating the function of the buttocks pad's curl-over flap.

As DESIGN F, for example, (FIG. 13A, 13B), the ends of the bottom u-shape bonding line 38 should be connected to the ends of the long u-shaped bonding line 58 as shown in FIG. 21 at the connection point 54. Since there's a separate bottom u-shape bonding line 56 that bonds the absorbent layer 26, first intermediate plastic film 30, and second intermediate plastic film 28 together, it creates a flap 22 of material that's not bonded to the base plastic film layer 16. The distance between connection point 54 and the bottom edge of the buttocks pad is the flap length 52. Moving that connection point 54 would change the dimension of that flap length 52. A good amount of length will give the user enough material to curl up and wrap around the dirty diaper 20 after diaper changing as shown in FIG. 22.

It is useful because the user can use the flap 22 to wrap and hold on to the diaper while turning the first pocket (first pocket is between the second plastic film and base plastic film as DESIGN F is still being used as an example) inside out for cleanliness and ease of use. For a standard buttocks pad that is about 9 inches wide and about 11.75 inches long. The range of flap length 52 is typically from 0 or about 0 to about 11 inches, more typically from about two to about nine inches, and most typically from about four inches to about seven inches along the buttocks pad length. For a flap length that is 0 inches, the user can still use it to wrap around the dirty diaper, but not as easily as having the flap length that is greater than 0 inches. For a flap length that is 11 inches, the pocket that is used as the second pocket is typically then the only pocket available to be turned inside out. Since the flap length is at almost maximum length of the buttocks pad, it is long enough to fully wrap around the diaper before turning the pocket inside out, which still provides good containment barrier around the dirty diaper.

Figure 23:
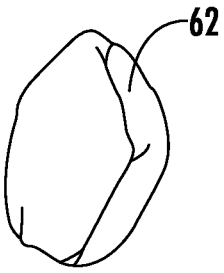
FIG. 23 is an isometric view illustrating the third pocket's location.

After the person uses the flap to curl up and wrap around the dirty diaper and turning all the pockets inside out, a completely clean third pocket will appear in which the user can use it to temporarily store dirty baby clothes or other materials. The layers that are being curled up include the absorbent layer 26, first intermediate plastic film 30, and second intermediate plastic film 28 (FIG. 13A, 13B, 22). The bonding configuration for this design makes the second pocket lay between the first plastic film and second plastic film, which means part of the pocket is being curled up. That curled up part 60 of the second pocket is the part that will become the third pocket 62 after the second pocket is being turned inside out as shown in FIG. 23.

Integrating the flap to wrap around the dirty diaper for at least DESIGNS B, E, and F will work well to create a third pocket as that extra pocket will appear naturally in the process of turning the first and second pockets inside out. For DESIGN A, C, D, and G, it's still possible to create that extra pocket; however, it may be difficult to happen naturally and, in some cases, that extra pocket may not be as clean.

The absorbent utilized in any of the diaper changing mats or buttocks pads of the present disclosure can be constructed in several different ways, each way meets a different balance of objectives. For older babies (older than 9 months), a minimal absorbent may be utilized. The absorbent (of size prescribed elsewhere herein) can be a single layer of nonwoven ranging in basis weight from about 15 grams per square meter (g/sq. m) to about 150 g/sq. m, more typically from about 25 g/sq. m to about 90 g/sq. m and most typically from about 30 g/sq. m to about 50 g/sq. m. The nonwoven can be any spunbond material, though polypropylene (including a hydrophobic polypropylene), polyester, and polyethylene are more typically used. Uniquely, a polypropylene infused with one or more surfactants in the interior area of the mat to make it hydrophilic and not infused with surfactant around the perimeter to make it hydrophobic so that it contains unbound urine may be used in the mats of the present disclosure to break the surface tension of the urine to allow it to be more readily absorbed by the absorbent. The nonwoven can also be spunlace, which is hydroentangled staple fibers, typically polyester, rayon, cellulose, or cotton. Alternatively, it can be a multilayer construction of spunbond (next to baby's skin) and the staple fibers as previously described. In addition, superabsorbent can be added to the multilayer construction with the superabsorbent furthest from the skin (this is modern diaper construction). In all cases, the typical embodiment is a nonwoven that is treated to reduce the surface tension in the area away from the perimeter so that urine flows into the nonwoven rather than running over the top of the nonwoven (again, typical diaper construction in the middle of the absorbent area, but different around the perimeter to contain unbound urine). Older babies rarely urinate during diaper changing because they know better and have some degree of voluntary control. When they do urinate during diaper changing, the amount of urine expelled is generally only from about 1 ml to about 60 ml and most usually from about 5 to about 20 ml so the absorbent capacity needed is minimal. The total absorbent capacity differentiates this invention from disposable diapers. Disposable diapers for older babies have absorbent capacity in the range of from about 100 to 400 ml.

Maximum absorbent is typically desired in the case of diaper changing mats used for younger babies, typically younger than nine months. The absorbent for younger babies is more robust because, even though younger babies have bladders that hold only about 50 ml of urine, younger babies have less voluntary control and may completely void their bladders during diaper changing. This is not common, but it does happen. The absorbent in diaper changing mat for younger babies can be of several different constructions. It can be all of the constructions used for older babies plus the additional construction of adding a layer of cellulosic paper or spunlace or meltblown beneath any of the nonwoven layers so that the absorbent does not directly touch the baby's skin. When paper is a layer of the multilayer absorbent, the basis weight of the paper is typically from about 5 to about 50 g/sq. m, more typically from about 10 to about 30 g/sq. m, most typically from about 15 to about 25 g/sq. m. By way of example, toilet paper is typically from about 15 to about 20 g/sq. m. The basis weight of the entire composite absorbent is typically in the range of from about 15 to about 100 g/sq. m, more typically in the range of from about 25 to about 60 g/sq. m, and most typically from about 35 to about 45 g/sq. m.

Design of the absorbent used in the diaper change mat and pouch is typically a balance of several competing constraints: maximize thickness to provide enough cushion at the head section and absorb as much urine and mess as possible at the buttocks section; maximize surface area—to have enough cover area when leakage occurs and spreads at the buttocks section; minimize thickness and surface area so that when compressed and folded, it would fit almost invisibly in a pocket or purse. It would also reduce weight and shipping cost; maximize flexibility and softness—to provide comfort to the baby; minimize flexibility and softness to provide material stiffness for ease of material handling during manufacturing.

In practice, for a 16×26 diaper changing mat for bigger babies with buttocks and head absorbent pads sized as stated, the basis weight of the absorbent is typically from about 20 to about 70 g/sq. m, more typically from about 25 to about 50 g/sq. m, and most typically from about 30 to about 40 g/sq. m. For a 13 inch by 21 inch diaper changing mat for newborn babies with buttocks and head absorbent pads sized as stated herein, the basis weight of the absorbent is typically from about 30 to about 120 g/sq. m, more typically from about 40 to about 90 g/sq. m, and most typically from about 50 to about 60 g/sq. m. Both of these sizes are typically scaled using the Golden Ratio of 1 to about 1.6. Other sizes can be scaled using the Golden Ratio as a guide too. The absorbent basis weight, regardless of size follows these metes and bounds.

For 16×26" pouch: head pad is typically 5.5 inches by 7 inches and the buttocks pad is typically about 11.75 by 9 inches.

For 13×21 inch pouch: the head pad is typically 5 inches×6 inches and the buttocks pad is typically about 10.75 inches by 8 inches. However, the pouch dimensions can be 13 inches by 22 inches. FIG. 1 shows a typical orientation of the head pad and buttocks pad on the diaper changing mat.

Below is a table describing the thickness, g/sq·m, and breakdown of layers for a few disposable mats, reusable mats, and hospital pads.

| | | | | Ratios | | |
|---|---|---|---|---|---|---|
| | poly back | head pad | butt pad | poly back:head pad | poly back:butt pad | poly back:(head pad + butt pad) |
| width | 16 | 7 | 9 | 2.29 | 1.78 | 1 |
| length | 26 | 5.5 | 11.75 | 4.73 | 2.21 | 1.51 |
| area | 394.54 | 36.57 | 103.82 | 10.79 | 3.80 | 2.81 |

Below is another Table that shows the mini disposable diaper mat of the present disclosure with five layer design compared to other pad products currently on the market.

| Product | Dimensions of mat | Layers (Top to bottom | Weight (oz) | sqr yard | oz/yard^2 |
|---|---|---|---|---|---|
| Mini disposable diaper mat | 17.5" × 13.25" | Nonwoven | 0.075 | 0.1789 | 0.4192 |
| | 14.5" × 11.125" | Cellulose | 0.0452 | 0.12447 | 0.3631 |
| | | Absorbent | 0.2438 | 0.12447 | 1.9587 |
| | | Cellulose | 0.0452 | 0.12447 | 0.3631 |
| | 17.5" × 13.25" | Polyethylene | 0.1171 | 0.17890 | 0.6546 |
| Attends Discreet Underpad (Hospital Pad) | 31" × 19" | Nonwoven | 0.2140 | 0.45448 | 0.4709 |
| | | Absorbent | 1.4287 | 0.45448 | 3.1436 |
| | | Poly | 0.2557 | 0.45448 | 0.5626 |
| Salmon colored pad (Hospital Pad) | 35" × 35" | Nonwoven | 0.2240 | 0.94522 | 0.2370 |
| | 31" × 31" | Absorbent | 3.0438 | 0.74151 | 4.1049 |
| | 69" × 35" | Poly | 1.4589 | 1.86343 | 0.7829 |
| HARTZ Dog pee pad | 21" × 21" | Nonwoven | 0.0907 | 0.34028 | 0.2665 |
| | 18.5" × 18.5" | Cellulose | 0.1344 | 0.26408 | 0.5089 |
| | | Absorbent | 0.4373 | 0.26408 | 1.6559 |
| | | Cellulose | 0.1344 | 0.26408 | 0.5089 |
| | 21" × 21" | Poly | 0.1905 | 0.34028 | 0.5598 |
| TENA Underpads (Hospital Pad) | 17" × 24" | Nonwoven | 0.1086 | 0.31481 | 0.3450 |
| | 19.5" × 13.5" | Absorbent | 0.3052 | 0.20313 | 1.5025 |
| | 17" × 24" | Poly | 0.1340 | 0.31481 | 0.4256 |
| Washable/Reusable Diaper Mat | 18.5" × 28.25" | 55% polyester 45% viscose | 3.3722 | 0.40326 | 8.3623 |
| | | 100% polyester laminated polyurethane | 2.0510 | 0.40326 | 5.0860 |
| Washable/Reusable Diaper Mat | 27.5" × 19" | 80% cotton 20% polyester | 2.5006 | 0.40316 | 6.2024 |
| | | 100% vynil coated polyester | 2.9350 | 0.40316 | 7.2799 |

-continued

| Product | gsm | Thickness (mll) | Total Weight (oz) | Total Absorbent Weight gsm (with nonwoven) | Total Absorbent Basis Weight gsm (no nonwoven) |
|---|---|---|---|---|---|
| Mini disposable diaper mat | 14.21 | NA | 0.5263 | 105.23 | 91.02 |
| | 12.31 | NA | | | |
| | 66.40 | NA | | | |
| | 12.31 | NA | | | |
| | 22.19 | 1.5 | | | |
| Attends Discreet Underpad (Hospital Pad) | 15.97 | NA | 1.8984 | 122.56 | 106.59 |
| | 106.59 | NA | | | |
| | 19.08 | 1.5 | | | |
| Salmon colored pad (Hospital Pad) | 8.04 | NA | 4.7267 | 147.22 | 139.18 |
| | 139.18 | NA | | | |
| | 26.54 | 1 | | | |
| HARTZ Dog pee pad | 9.04 | NA | 0.9873 | 99.68 | 90.46 |
| | 17.25 | NA | | | |
| | 56.14 | NA | | | |
| | 17.25 | NA | | | |
| | 18.98 | 1.5 | | | |
| TENA Underpads (Hospital Pad) | 11.70 | NA | 0.5478 | 62.64 | 50.94 |
| | 50.94 | NA | | | |
| | 14.43 | 1.5 | | | |
| Washable/Reusable Diaper Mat | 283.53 | NA | 5.4232 | 283.53 | 283.53 |
| | 172.44 | 19 | | | |
| Washable/Reusable Diaper Mat | 210.30 | NA | 5.4356 | 210.30 | 210.30 |
| | 246.83 | 19 | | | |

DubleRoo product referred to in the table below is a diaper changing mat according to an aspect of the present disclosure.

| Product | Folded Volume (cubic inches) | Volume per sq ft of mat | Unfolded Size | Company | Disposable of Washable | Price |
|---|---|---|---|---|---|---|
| DubleRoo ™ | 2.25 | 0.73 | 26 × 17 | F&V ™ | Disposable | $29.99 for 36 |
| Rocinha disposable changing pads | 5.45 | 3.55 | 17 × 13 | Rocinha | Disposable | $25.99 for 100 |
| Attends Discrete Underpad | 32.81 | 5.71 | 36 × 23 | McKesson | Disposable | $31.01 for 15 |
| TENA underpads | 22.78 | 7.59 | 24 × 18 | Essity | Disposable | $7.53 for 25 |
| Blue Snail quilted changing pad | 52.99 | 21.74 | 27 × 13 | Shaoxing Limeiyuan Home Textiles Clothing Co. | Washable | $15.95 for 3 |
| Skipaddle Changing Station | 129.38 | 28.98 | 27.5 × 23.4 | Skip*Hop | Washable | $19.99 for 1 |
| Pronto Signature Changing Station | 387.75 | 109.24 | 23.5 × 21.7 | Skip*Hop | Washable | $30.00 for 1 |
| Go Change | 157.50 | 52.39 | 22.2 × 19.5 | Munchkin | Washable | $14.99 for 1 |

Currently available products have considerably more absorbent capacity than diaper changing mat of the present disclosure. As shown in the table just above, please note that the basis weight of typical currently available products ranges from 62.64 g/sq. m to 283.53 g/sq. m. The diaper changing mat of the present disclosure's absorbent basis weight will be closer to about 50 g/sq. m or less, more typically about 40 g/sq. m or less. Also, all of the other prior products have absorbent that is edge-to-edge with the poly back sheet, which means even more absorbent capacity. Other products optimize to maximize absorbent capacity. The diaper changing mats of the present disclosure reduce the size of the absorbent material to more accurately reflect what is needed and thereby minimize folded up size and increase usability and widespread availability of the diaper changing mat.

The diaper changing mats of the present disclosure also have dimensional ratios so that they are pleasing to the eye. This feature is not to be discounted. This was achieved by utilizing the Golden Ratio for the overall size of the diaper changing mat. However, the size of the two absorbent pads utilized in the mat do not utilize the Golden Ratio, but are designed for the most efficacy and most visual appeal.

FIGS. 16A-16L shows the process of use and the initial shape prior to sealing to create the final design of a diaper changing mat 10 formed from a single sheet of plastic film that can have a head portion and/or a buttocks portion that have their layers form from the same unitary sheet of plastic material as the base plastic film layer 16. The design of FIGS. 16A-16L is similar in construction and use as DESIGN C, but is made from a single sheet of plastic film that is then folded over in sections to form the head pad and/or the buttocks pad in a construction similar to DESIGN C after the layers are sealed as discussed above in regard to DESIGN C.

Figure 17:
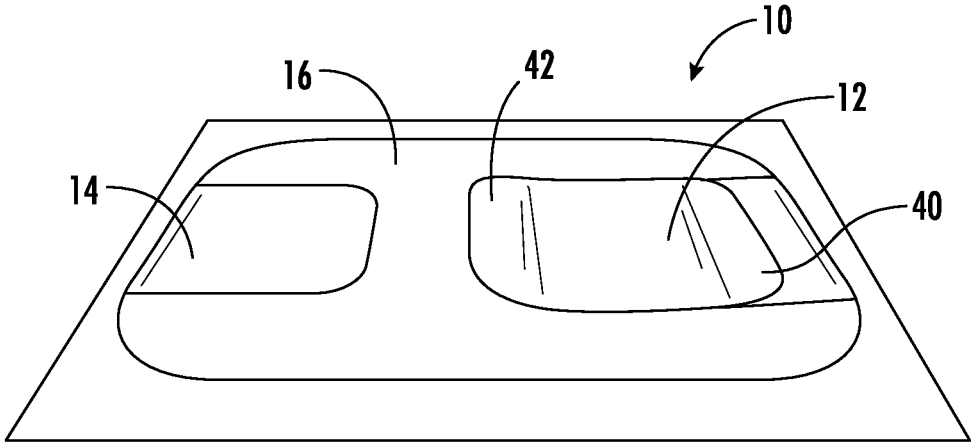
FIG. 17 is an isometric view of a diaper mat formed from multiple folded layers of plastic material to form at least the buttocks pad portion when heat sealed according to another aspect of the present disclosure—DESIGN I.
Figure 17A:
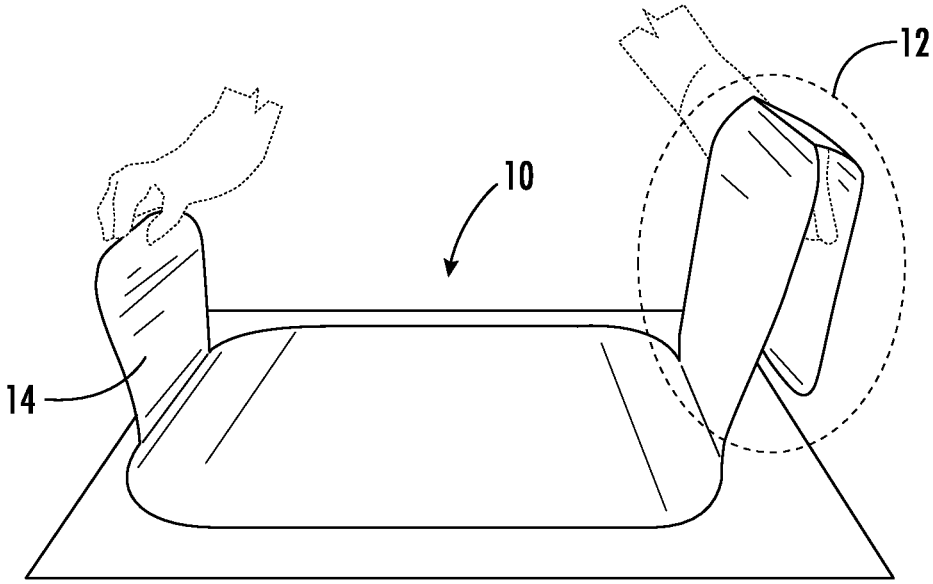
FIG. 17A is a front perspective view of a diaper mat prior to final formation according to another aspect of the present disclosure where layers of a buttocks pad are formed from a buttocks absorbent layer, a first plastic film, a second plastic film, and a base layer plastic film and the first plastic film, second plastic film and base layer of plastic film are created from one plastic film sheet that is folded to create the three layers of the buttocks pad and optionally the head pad (in any of the folded embodiments) may be formed from one or more folded layers from the same plastic film as well although shown as formed from one layer, a plurality of layers may be used to create a thicker head pad.
Figure 17B:
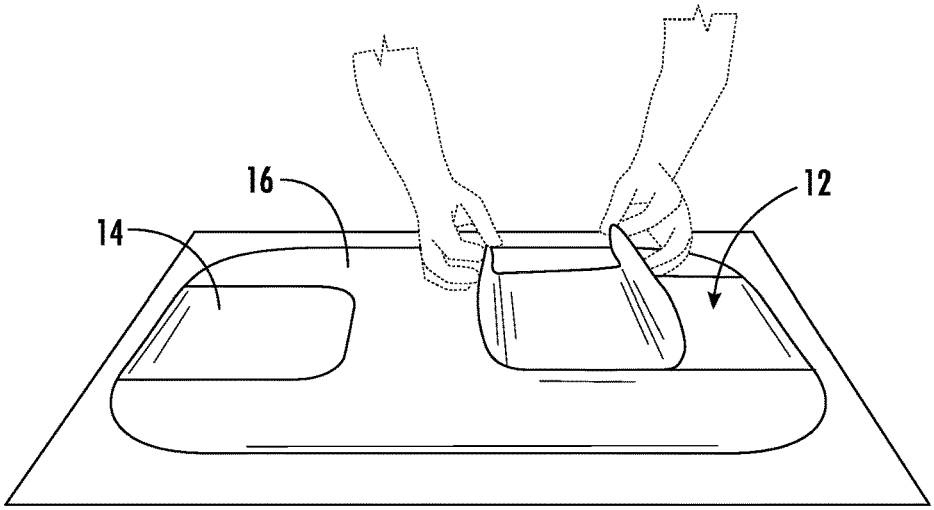
FIG. 17B is a front perspective view showing a formed diaper mat from the folded layers of plastic and the top pocket and bottom pocket of the buttocks mat portion of the diaper mat according to the design shown in FIG. 17A.
Figure 17C:
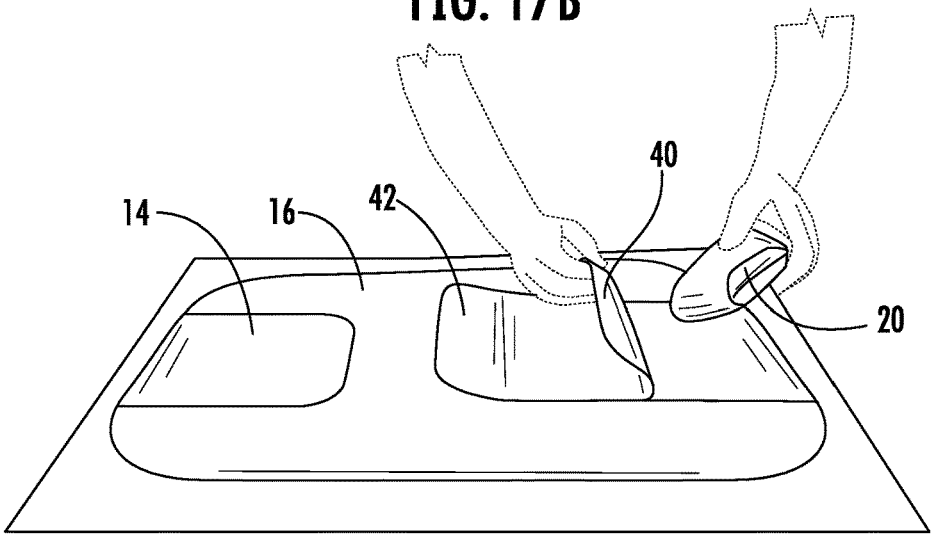
FIG. 17C is a front perspective view showing the user inserting a diaper between the first plastic film layer and second plastic film layer in the bottom pocket portion of the diaper mat, but the top pocket could initially be used instead as well.
Figure 17D:
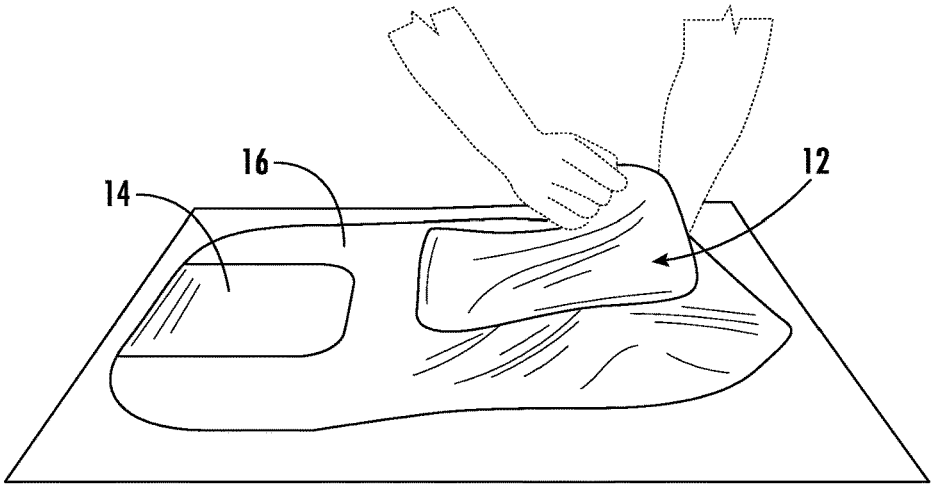
FIG. 17D is a front perspective view showing the user completing inserting the diaper into the bottom pocket shown in FIGS. 17B-C.
Figure 17E:
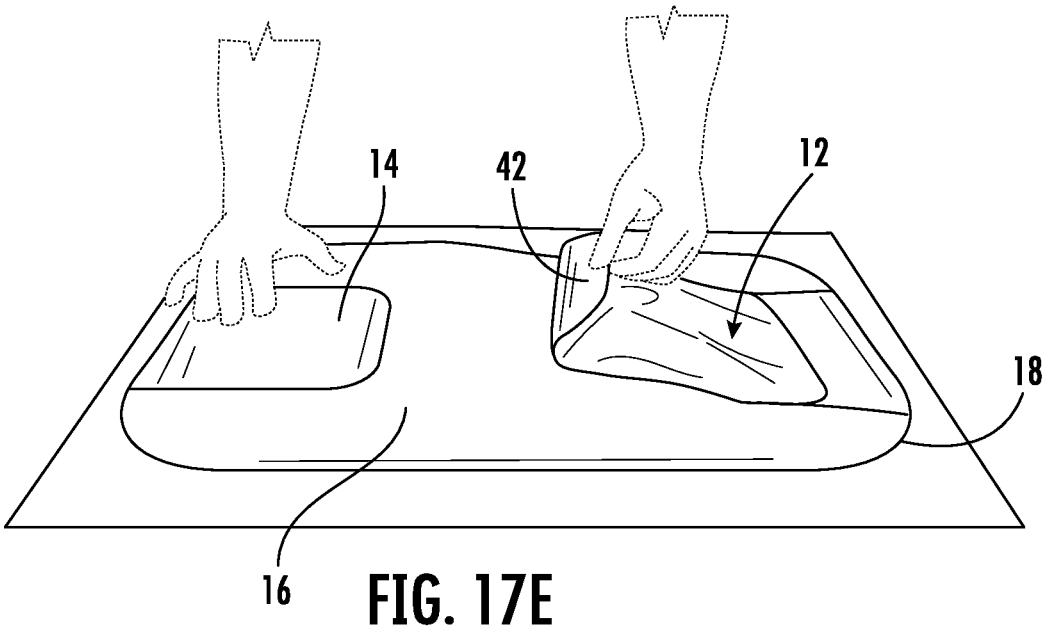
FIG. 17E is a perspective view sowing the user flipping the flap of the top pocket over toward the bottom of the mat to facilitate reaching into the top facing pocket of the buttocks portion.
Figure 17F:
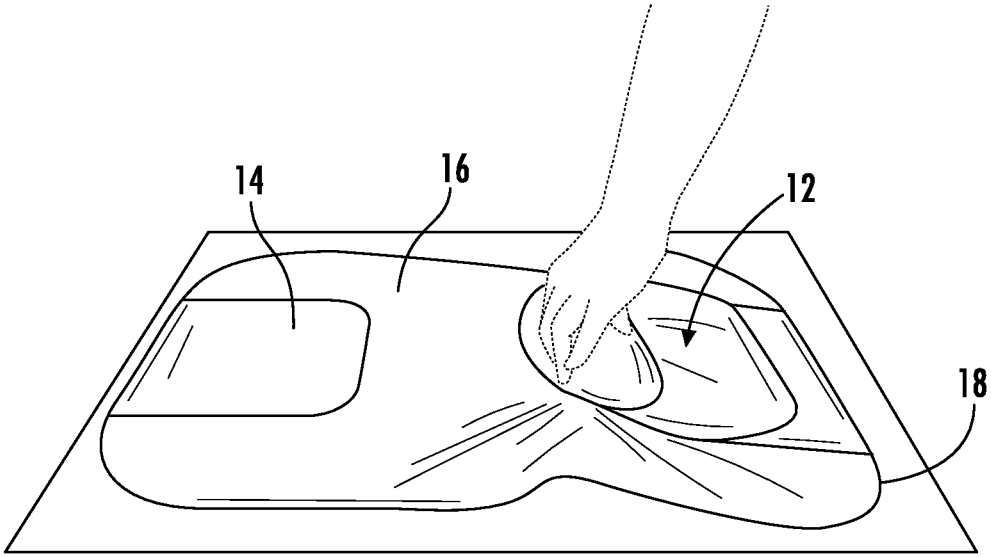
FIG. 17F is a front perspective view showing the user grasping the diaper and the flap of the top pocket/second layer of plastic film prior to starting the inversion of the mat to enrobe the diaper in the plastic film of the mat.
Figure 17G:
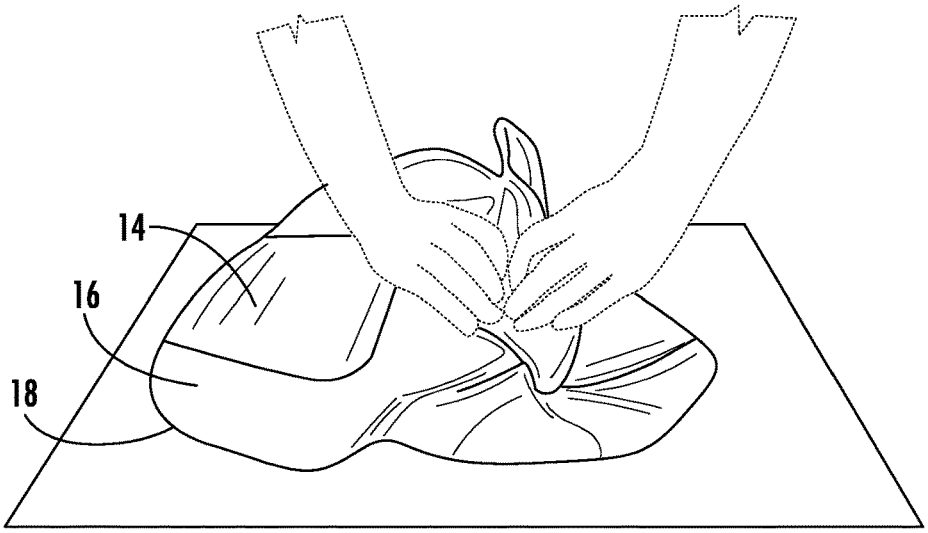
FIGS. 17G-H show the user inverting the mat and position the diaper through the pocket to turn the diaper changing mat inside out.
Figure 17H:
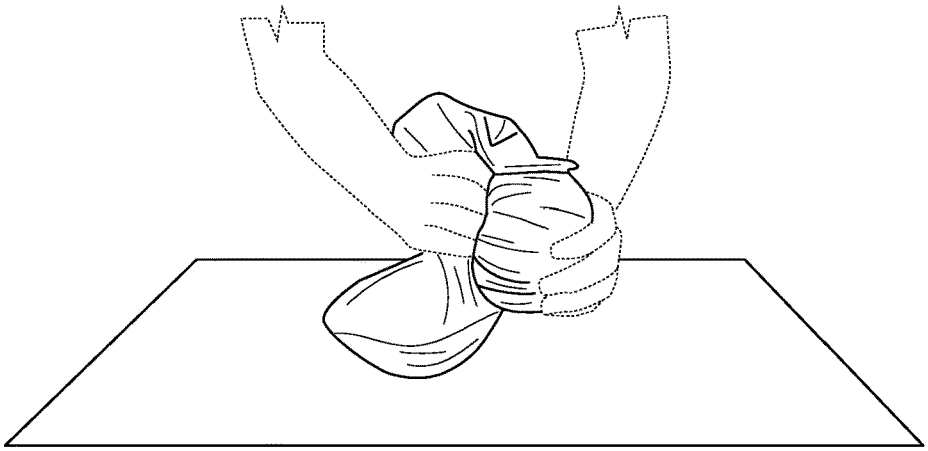
Figure 17I:
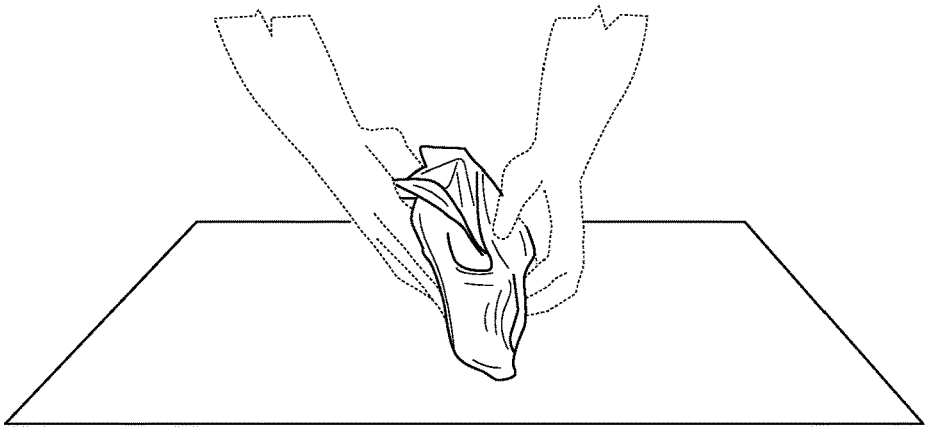
FIGS. 17I-J show the next stages of a user tucking excess diaper mat within the pocket to form a finished enrobed diaper where the diaper is enrobed within the diaper changing mat.
Figure 17J:
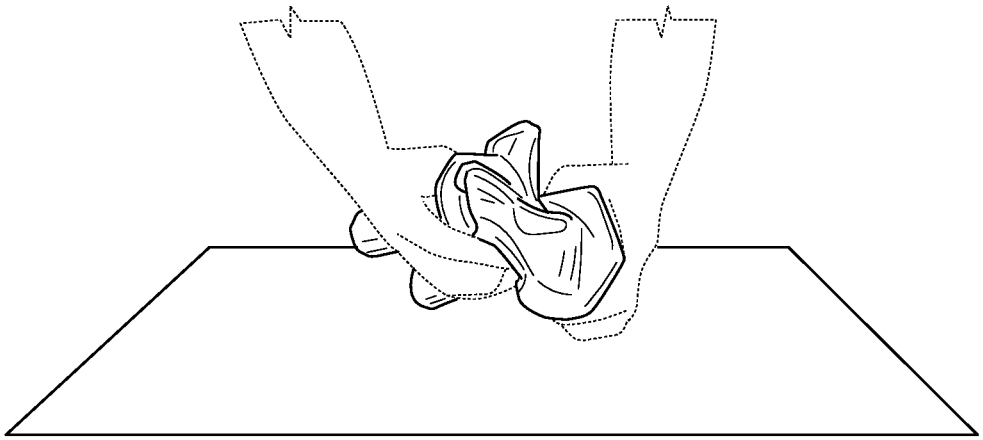
Figure 17K:
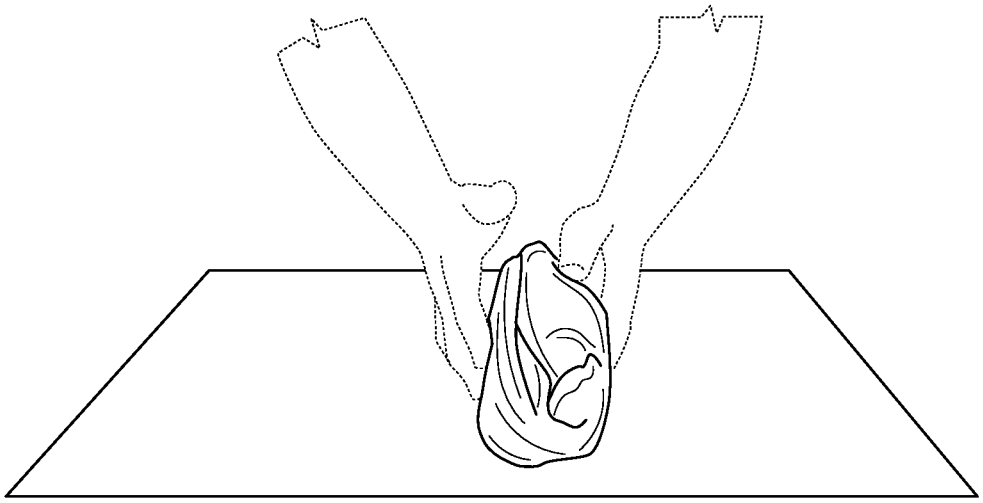
FIG. 17K is a perspective view of a user that has completed the tucking of the excess diaper mat to form the finished enrobed diaper where the diaper is enrobed within the diaper changing mat.

FIGS. 17-17K show the process of using and the initial shape of a design similar to DESIGN D, but constructed from a single unitary sheet of plastic materials cut to allow the layers of the head pad, when used, and the buttocks pad 12. The buttocks pad 12 and head pad are typically formed from section/layers folded over in an accordion style manner. The final design is created when the layers are sealed in a manner as discussed above. The folded over layers that form the buttocks pad 12 are at least the absorbent layer, the intermediate plastic layer 28, the intermediate plastic layer 30 and the base plastic film layer 16, which again are all created from the same sheet of plastic film.

The folded designs discussed immediately above may have an advantage over layered designs in manufacturing processing as well as seam strength.

In a similar manner, the other designs of the present disclosure can also be constructed from a single unitary sheet of material and the layers sealed to create the finished product.

It will be understood by one having ordinary skill in the art that construction of the described devices and systems and other components is not limited to any specific material unless otherwise expressly stated. Other exemplary embodiments of the devices and products disclosed herein may be formed from a wide variety of materials, unless described otherwise herein. Typically, the systems of the present disclosure are typically produced from plastic components, various sensors, and metal materials, but the particular materials used are often not critical, but generally speaking lighter materials that remain sturdy are most preferred given the portable and retrofittable nature of the devices and systems of the present disclosure.

What is claimed is:

1. A foldable diaper changing mat comprising:

a foldable base layer of a changing mat having a surface engaging side and an upward facing side and a top edge and a bottom edge; and an infant buttocks receiving pad portion having a top end facing the top edge of the foldable base layer of the changing mat and a bottom end facing the bottom edge of the foldable base layer of the changing mat, wherein the infant buttocks receiving pad portion is engaged with the upward facing side and proximate the bottom edge of the foldable base layer of the changing mat and wherein the infant buttocks receiving pad portion has at least one intermediate layer of material and a top, absorbent-containing layer wherein the foldable base layer of the changing mat, at least one intermediate layer and the top, absorbent-containing layer are sealed so as to create a top edge facing pocket and a bottom edge facing pocket that are separated from one another.

2. The foldable diaper changing mat of claim 1, wherein the top, absorbent-containing layer comprises an amount of an absorbent that is generally planar in shape and a body-side liner over the top of the absorbent that prevents the absorbent that may contain urine and/or feces from contacting skin of an infant if placed on a top surface of the body-side liner and wherein the absorbent is a non-woven material.

3. The foldable diaper changing mat of claim 2, wherein the top, absorbent-containing layer is engaged to the at least one intermediate layer about a perimeter of the top, absorbent-containing layer or proximate the perimeter of the top, absorbent-containing layer to provide a physical interruption to wicking around or proximate the perimeter of the top, absorbent-containing layer and wherein the absorbent is a spunbond polypropylene.

4. The foldable diaper changing mat of claim 3, wherein the absorbent further comprises a surfactant printed on a top surface of the absorbent, but not within 0.25 inches of the perimeter of the top, absorbent-containing layer.

5. The foldable diaper changing mat of claim 4, wherein the amount of the absorbent is such that it has an absorbent capacity of not more than about 60 ml of urine.

6. The foldable diaper changing mat of claim 1, wherein the foldable diaper changing mat further comprises a head pad portion and the head pad portion has a top surface area and the infant buttocks receiving pad portion has a top surface area and the foldable base layer of the changing mat has a top surface area and wherein the combined top surface area of the head pad portion and the infant buttocks receiving pad portion is no more than 80 percent of the top surface area of the foldable base layer of the changing mat and wherein the head pad portion and the infant buttocks receiving pad portion are not connected to one another.

7. The foldable diaper changing mat of claim 1, wherein at least the foldable base layer of the changing mat is biodegradable.

8. The foldable diaper changing mat of claim 1, wherein the foldable diaper changing mat is in a folded position forming a folded diaper changing mat and the folded diaper changing mat has a volume of about 3.35 cubic inches or less and a length of about 2.75 inches or less, a width of about 3.25 inches or less and a thickness of about ⅜ inch or less.

9. The foldable diaper changing mat of claim 1, wherein the at least one intermediate layer of material comprises a single intermediate plastic layer and the foldable base layer of the changing mat is a plastic film; and wherein the top, absorbent-containing layer comprises an amount of an absorbent and the top, absorbent-containing layer is engaged to the at least one intermediate layer about a perimeter of the top, absorbent-containing layer or proximate the perimeter of the top, absorbent-containing layer to provide a physical interruption to wicking around or proximate the perimeter of the top, absorbent-containing layer and wherein the absorbent is a spunbond polypropylene.

10. The foldable diaper changing mat of claim 1, wherein the at least one intermediate layer of material is a single intermediate layer of material that is engaged to the foldable base layer of the changing mat and the top, absorbent-containing layer to form a first pocket between the foldable base layer of the changing mat and a single intermediate layer and a second pocket between the top, absorbent-containing layer and the single intermediate layer.

11. The foldable diaper changing mat of claim 10, wherein the first pocket is the top edge facing pocket facing the top edge of the foldable base layer of the changing mat, and the second pocket is the bottom edge facing pocket facing the bottom edge of the foldable base layer of the changing mat.

12. The foldable diaper changing mat of claim 11, wherein the foldable diaper changing mat further comprises a head pad portion and the head pad portion has a top surface area and the infant buttocks receiving pad portion has a top surface area and the foldable base layer of the changing mat has a top surface area and wherein the combined top surface area of the head pad portion and the infant buttocks receiving pad portion is no more than 80 percent of the top surface area of the foldable base layer of the changing mat and wherein the head pad portion and the infant buttocks receiving pad portion are not connected to one another.

13. The foldable diaper changing mat of claim 1, wherein the infant buttocks receiving pad portion comprises at least two intermediate plastic layers and the at least two intermediate plastic layers and the top, absorbent-containing layer of the infant buttocks receiving pad portion substantially vertically align with one another in a stacked configuration; and wherein the top, absorbent-containing layer comprises an amount of an absorbent and the top, absorbent-containing layer is engaged to one of the at least two intermediate layers about a perimeter of the top, absorbent-containing layer or proximate the perimeter of the top, absorbent-containing layer to provide a physical interruption to wicking around or proximate the perimeter of the top, absorbent-containing layer and wherein the absorbent is a spunbond polypropylene.

14. The foldable diaper changing mat of claim 1, wherein the at least one intermediate layer of materialconsists of two intermediate plastic layers and the top edge facing pocket comprises a moveable flap spanning at least a majority of a width of the infant buttocks receiving pad portion.

15. The foldable diaper changing mat of claim 14, wherein the bottom edge facing pocket comprises a moveable flap spanning at least a majority of the width of the infant buttocks receiving pad portion.

16. The foldable diaper changing mat of claim 1, wherein the bottom edge facing pocket comprises a moveable flap spanning at least a majority of a width of the infant buttocks receiving pad portion.

17. The foldable diaper changing mat of claim 1 further comprising a head portion that is separated from the infant buttocks receiving pad portion on the upward facing side of the foldable base layer of the changing mat when the foldable diaper changing mat is completely unfolded.

18. A method of sealing a used diaper within a foldable diaper changing mat comprising the steps of:

placing the used diaper within a bottom edge facing pocket or a top edge facing pocket of the foldable diaper changing mat to form a diaper containing pocket, wherein the foldable diaper changing mat comprises:

a base layer having a surface engaging side and an upward facing, infant engaging side and a top edge and a bottom edge; and an infant buttocks receiving pad portion having a top end facing the top edge of the base layer and a bottom end facing the bottom edge of the base layer, wherein the infant buttocks receiving pad portion is engaged with the upward facing, infant engaging side and proximate the bottom edge of the base layer and wherein the infant buttocks receiving pad portion has at least one intermediate layer and a top, absorbent-containing layer, absorbent wherein the base layer, the at least one intermediate layer and the top, absorbent containing layer are engaged with one another so as to create the top edge facing pocket and the bottom edge facing pocket that are different pockets and separated from one another;

reaching on the outside of the diaper containing pocket to physically grasp the used diaper without directly physically touching the diaper; and inverting the foldable diaper changing mat by flipping the foldable diaper changing mat inside out a first time to form a single inverted diaper containing mat.

19. The method of claim 18 further comprising the step of inverting the single inverted diaper containing mat a second time to further enrobe the diaper in another layer of material.

20. A foldable diaper changing mat comprising:

a foldable base layer having a surface engaging side and an upward facing side and a top edge and a bottom edge; and an infant buttocks receiving pad portion having a top end that faces the top edge of the foldable base layer and a bottom end that faces the bottom edge of the foldable base layer, wherein the infant buttocks receiving pad portion is engaged with the upward facing side and proximate the bottom edge of the foldable base layer and wherein the infant buttocks receiving pad portion comprises a first intermediate layer, a second intermediate layer, and a top absorbent-containing layer and wherein the foldable base layer, the first intermediate layer, the second intermediate layer and the top, absorbent-containing layer are sealed so as to create a top edge facing pocket and a bottom edge facing pocket that are separated from one another and do not share any of the same internal volume.

* * * * *